US006812636B2

(12) United States Patent
Porter et al.

(10) Patent No.: US 6,812,636 B2
(45) Date of Patent: Nov. 2, 2004

(54) LIGHT-EMITTING DEVICE HAVING LIGHT-EMISSIVE PARTICLES PARTIALLY COATED WITH LIGHT-REFLECTIVE OR/AND GETTER MATERIAL

(75) Inventors: John D. Porter, Berkeley, CA (US); Roger A. Pearson, San Jose, CA (US); Kazuo Kajiwara, Tokyo (JP); Haruo Kato, Tsushima (JP); Lawrence S. Pan, Los Gatos, CA (US); Shiyou Pei, Saratoga, CA (US); Theodore S. Fahlen, San Jose, CA (US)

(73) Assignees: Candescent Technologies Corporation, Los Gatos, CA (US); Candescent Intellectual Property Services, Inc., Los Gatos, CA (US); Sony Corporation, Tokyo (JP)

( * ) Notice: Subject to any disclaimer, the term of this patent is extended or adjusted under 35 U.S.C. 154(b) by 182 days.

(21) Appl. No.: 09/823,815

(22) Filed: Mar. 30, 2001

(65) Prior Publication Data

US 2002/0167262 A1 Nov. 14, 2002

(51) Int. Cl.[7] ..... H01J 1/62
(52) U.S. Cl. ..... 313/496; 313/495; 313/553
(58) Field of Search ..... 313/461, 474, 313/463, 466, 479, 495, 496, 483, 553, 113; 445/24; 252/301.4 S, 301.6 S

(56) References Cited

U.S. PATENT DOCUMENTS

| | | | | | |
|---|---|---|---|---|---|
| 3,564,136 | A | | 2/1971 | Gilmour et al. | 348/800 |
| 3,965,278 | A | | 6/1976 | Duinker et al. | 427/54 |
| 4,146,657 | A | * | 3/1979 | Gordon | 427/109 |
| 4,975,619 | A | | 12/1990 | Datta et al. | 313/466 |
| 5,012,155 | A | | 4/1991 | Datta et al. | 313/461 |
| 5,418,062 | A | * | 5/1995 | Budd | 428/403 |

(List continued on next page.)

FOREIGN PATENT DOCUMENTS

| | | |
|---|---|---|
| EP | 996141 A2 | 4/2000 |
| JP | 09-082245 | 3/1997 |
| WO | WO 99/00822 | 1/1999 |

OTHER PUBLICATIONS

Levy et al. "Phosphors For Full–Color Microtips Fluorescent Displays," International Display Research Conference, Oct. 15–17, 1991, pp. 20–23.

*Primary Examiner*—Ashok Patel
*Assistant Examiner*—Karabi Guharay
(74) *Attorney, Agent, or Firm*—Ronald J. Meetin

(57) ABSTRACT

A light-emitting device (52) suitable for a flat-panel cathode-ray tube display contains a light-emissive region (66) formed over a plate (64). The light-emissive region contains a plurality of light-emissive particles (72). Part of the outer surface of each light-emissive particle is conformally covered with a coating (74) that provides light reflection or/and gettering.

72 Claims, 14 Drawing Sheets

U.S. PATENT DOCUMENTS 5,453,659 A 9/1995 Wallace et al. ..... 313/495
5,477,105 A 12/1995 Curtin et al. ..... 313/422
5,498,925 A 3/1996 Bell et al. ..... 313/497
5,520,563 A 5/1996 Wallace et al. ..... 445/24
5,548,181 A 8/1996 Jones ..... 313/309
5,576,596 A 11/1996 Curtin et al. ..... 313/422
5,606,225 A 2/1997 Levine et al. ..... 315/169.3
5,614,785 A 3/1997 Wallace et al. ..... 315/496
5,628,662 A 5/1997 Vickers et al. ..... 445/24
5,656,889 A 8/1997 Niiyama et al. ..... 313/553
5,670,296 A * 9/1997 Tsai ..... 430/312
5,689,151 A 11/1997 Wallace et al. ..... 313/495
5,693,438 A 12/1997 Liu et al. ..... 430/28
5,835,991 A 11/1998 Niiyama et al. ..... 313/553
5,844,361 A 12/1998 Petersen et al. ..... 313/495
5,849,442 A 12/1998 Liu et al. ..... 430/28
5,859,502 A 1/1999 Spindt et al. ..... 315/169.3
5,866,978 A 2/1999 Jones et al. ..... 313/495
5,869,928 A 2/1999 Liu et al. ..... 313/495
5,879,795 A 3/1999 Haase et al. ..... 428/323
5,931,713 A 8/1999 Watkins et al. ..... 445/55
5,936,342 A 8/1999 Ono et al. ..... 313/495
5,945,780 A 8/1999 Ingle et al. ..... 313/495
5,966,108 A 10/1999 Ditzik ..... 345/74
5,982,082 A 11/1999 Janning ..... 313/336
6,046,539 A 4/2000 Haven et al. ..... 313/461
6,049,165 A 4/2000 Spindt et al. ..... 313/495
6,084,345 A 7/2000 Janning ..... 313/495
6,100,633 A 8/2000 Okumura et al. ..... 313/486
6,447,908 B2 * 9/2002 Yun et al. ..... 428/403
6,604,972 B1 * 8/2003 Yamano ..... 445/24

* cited by examiner

LIGHT-EMITTING DEVICE HAVING LIGHT-EMISSIVE PARTICLES PARTIALLY COATED WITH LIGHT-REFLECTIVE OR/AND GETTER MATERIAL

FIELD OF USE

This invention relates to the configuration and manufacture of light-emitting devices suitable for use in flat-panel displays such as flat-panel cathode-ray tube ("CRT") displays.

BACKGROUND ART

A flat-panel display CRT display typically consists of an electron-emitting device and an oppositely situated light-emitting device. The electron-emitting device, or cathode, contains electron-emissive elements that emit electrons across a relatively wide area. An anode in the light-emitting device attracts the electrons toward light-emissive regions distributed across a corresponding area in the light-emitting device. The anode can be located above or below the light-emissive regions. In either case, the light-emissive regions emit light upon being struck by the electrons to produce an image on the display's viewing surface.

FIG. 1 presents a side cross section of part of a conventional flat-panel CRT display such as that described in U.S. Pat. No. 5,859,502 or U.S. Pat. No. 6,049,165. The display of FIG. 1 is formed with electron-emitting device 20 and light-emitting device 22. Electron-emitting device 20 contains backplate 24 and overlying electron-emissive regions 26. Electrons emitted by regions 26 travel toward light-emitting device 22 under control of electron-focusing system 28. Item 30 represents an electron trajectory.

Light-emitting device 22 contains faceplate 32 coupled to backplate 24 of electron-emitting device 20 through an outer wall (not shown) to form a sealed enclosure maintained at a high vacuum. Light-emissive regions 34 overlie faceplate 32 respectively opposite electron-emissive regions 26. When electrons emitted by regions 26 strike light-emissive regions 34, the light emitted by regions 34 produces the display's image on the exterior surface (lower surface in FIG. 1) of light-emitting device 22. Contrast-enhancing black matrix 36 laterally surrounds light-emissive regions 34.

Light-emitting device 22 also contains light-reflective layer 38 situated over light-emissive regions 34 and black matrix 36. Regions 34 emit light in all directions when struck by electrons. Hence, some of the so-emitted light travels backward toward the interior of the display. Layer 38 reflects some of that rear-directed light forward to increase the intensity of the image. In addition, layer 38 functions as the display's anode for attracting electrons toward light-emitting device 22.

The electrons emitted by regions 26 pass through light-reflective layer 38 before striking light-emissive regions 34. In so doing, the electrons lose some energy. The image intensity increase resulting from the light-reflective nature of layer 38 at least partially compensates for any image intensity decrease caused by this electron energy loss. Nonetheless, it would be desirable to further improve the image intensity in a light-emitting device whose anode overlies the device's light-emitting regions.

Each light-emitting region in a light-emitting device such as that of FIG. 1 normally consists of light-emissive particles formed with phosphor material. The constituents of the phosphor particles commonly include elements such as sulfur or/and oxygen. When the light-emissive particles are struck by electrons, some of the sulfur or/and oxygen is commonly released in gaseous form into the interior of the display. The so-released gases can contaminate the display and cause it to degrade.

Petersen et al ("Peterson"), U.S. Pat. No. 5,844,361, addresses the problem of outgassing from phosphor particles in a light-emitting device of a flat-panel CRT display by chemically treating the outer particle surfaces in a way intended to reduce undesired outgassing. FIGS. 2 and 3 depict two examples of Petersen's approach in which light-emissive regions overlie transparent substrate 40. Each light-emissive region consists of a layer of phosphor particles 42.

A coating 44 fully surrounds each phosphor particle 42 in the example of FIG. 2. Coatings 44 can alter the surface chemistry of particles 42 in such a way that they are more thermodynamically resistant to outgassing. Alternatively, coatings 44 can simply be impervious encapsulants that substantially prevent any contaminant gases produced by particles 42 from entering the display's interior. In either case, coatings 44 are provided on particles 42 before they are deposited over substrate 40. The display's anode is formed with aluminum layer 46 provided above composite particles 42/44.

In the example of FIG. 3, coatings 48 of stable oxide are provided on particles 42 after they are deposited on substrate 40. Each coating 48 conformally covers an upper portion of the outer surface of one particle 42. Coatings 48, typically formed by chemical vapor deposition of silane, disiloxane, or tetra-ethyl-orthosilicate, are more thermodynamically resistant to outgassing than are particles 42. Petersen indicates that the display's anode in the example of FIG. 3 can be formed with a conductive layer analogous to aluminum layer 46.

Providing phosphor particles 42 with full coatings 44 before particles 42 are deposited on substrate 40 in the example of FIG. 2 raises concerns that coatings 44 may be damaged during the deposition of particles 42. Also, full coatings 44 may detrimentally affect the formation of the light-emissive regions by absorbing radiation typically utilized in defining the light-emissive regions. Petersen avoids this difficulty with the example of FIG. 3 where partial coatings 48 are deposited on particles 42 after they are deposited on substrate 40. However, Petersen only discloses that coatings 48 may consist of oxide. Petersen does not deal with improving the image intensity.

GENERAL DISCLOSURE OF THE INVENTION

The present invention furnishes a light-emitting device in which a light-emissive region formed with a plurality of light-emissive particles overlies light-transmissive material of a plate. The light-emitting device of the invention is suitable for use in a flat-panel display, especially a flat-panel CRT display in which an electron-emitting device is situated opposite the light-emitting device. The electron-emitting device emits electrons which strike the light-emissive region, causing it to emit light.

The light-emissive particles in light-emissive region of the present light-emitting device are provided with coatings that perform various functions. In some cases, the particle coatings enable the intensity of light that travels generally in the forward direction to be enhanced, especially when the light-emitting device contains a light-reflective layer situated over the coatings. Alternatively or additionally, the particle coatings may cause the optical contrast to be enhanced between two such light-emissive regions when one of the light-emissive regions is turned on (emitting light) and the other is turned off (not emitting light). The coatings may getter contaminant gases. The coatings also typically reduce damaging effects that occur as the result of electrons striking the light-emissive particles.

Depending on the function or functions to be performed by the particle-coating material, each light-emissive particle may have two or more of the present coatings. In any event, each coating covers only part of the outer surface of the underlying particle in such a way as to be spaced apart from where that particle is closest to the plate. By configuring the coatings in this way, the coatings can be provided over the particles after they are provided over the plate, thereby avoiding difficulties that arise when light-emissive particles are provided with coatings before the particles are provided over a plate.

The light-emissive particles normally emit light in substantially all directions. Part of the emitted light travels generally forward, including partially sideways, toward the plate and passes through it. Part of the emitted light travels generally backward, likewise including partially sideways, away from the plate.

In a first aspect of the invention, each light-emissive particle is covered with a light-reflective coating positioned in the manner indicated above to conformally cover part of the particle's outer surface. As a result, the particle coatings reflect forward some of the initially rear-directed light emitted by the particles. While the light-reflective layer normally situated over the particles above the light-reflective coatings performs generally the same function as the light-reflective particles, the combination of the light-reflective coatings and the light-reflective layer causes more light to be directed forward than would be achieved solely with the light-reflective layer. Hence, usage of the light-reflective coatings enables the light intensity to be increased in the forward direction.

The coatings are typically made light reflective by forming them from one or more of the metals beryllium, boron, magnesium, aluminum, chromium, manganese, iron, cobalt, nickel, copper, gallium, molybdenum, palladium, silver, indium, platinum, thallium, and lead, including alloys of one or more of these metals. Boron, aluminum, gallium, indium, and thallium, all of which fall into Group IIIB (13) of the Periodic Table, are attractive for the light-reflective coatings because none of these five metals is an electron donor. Silver and copper are attractive because they are substitutional species in metal sulfide phosphors suitable for implementing the light-emissive particles to respectively emit blue and green light.

In a second aspect of the invention, each light-emissive particle is partially covered in the preceding manner with a getter coating for sorbing (adsorbing or absorbing) contaminant gases. If the light-emissive particles produce contaminant gases as a result of being struck by electrons or/and other charged particles, the getter coatings can sorb the so-produced gases before they move away from the particles and cause damage elsewhere. When the light-reflective layer overlies the getter coatings, the light-reflective layer is normally perforated. Contaminant gases originating at locations away from the light-emissive region can thus pass through the light-reflective layer and be sorbed by the getter coatings.

The getter coatings are typically formed with one or more of the metals magnesium, chromium, manganese, iron, cobalt, nickel, copper, molybdenum, palladium, silver, platinum, and lead, including alloys of one or more of these metals. All twelve of these metals are particularly suitable for sorbing sulfur. Alternatively or additionally, the getter coatings can be formed with one or more of the metals titanium, vanadium, zirconium, niobium, barium, tantalum, tungsten, and thorium, including alloys of these additional eight metals. When the getter coatings are formed with one or more of the preceding twenty metals, the getter coatings may also be light-reflective for enhancing the light intensity in the forward direction as described above. Furthermore, the getter coatings can alternatively or additionally be formed with oxide of one or more of magnesium, chromium, manganese, cobalt, nickel, and lead, each of which is particularly suitable for sorbing sulfur.

In a third aspect of the invention, part of the outer surface of each light-emissive particle is conformally covered with multiple intensity-enhancement coatings. The number of intensity-enhancement coatings overlying each particle is, for convenience, designated here as plural integer m. The m coatings overlying each particle are similarly designated as the first coating through the mth coating, where the first coating is the nearest coating, i.e., the coating directly overlying the particle. Each ith coating overlies each (i−1)th coating where i is an integer varying from 2 to m. Hence, the mth coating is the furthest, i.e., most remote, coating. A light-reflective layer normally overlies the intensity-enhancement coatings.

Each first coating is of lower average refractive index than the underlying particle. Each ith coating, where i again varies from 2 to m, is of lower refractive index than the (i−1)th coating. In other words, the average refractive index decreases progressively in going from each particle to its nearest coating and then from its nearest coating to its furthest coating.

Light incident on an interface between a pair of light-transmissive media having different refractive indices is partially reflected at the interface and partially transmitted through the interface. With this in mind, the benefit of having the average refractive index decrease progressively in going from each particle to its nearest coating and then from its nearest coating to its furthest coating can be seen by considering the three-medium situation in which light travelling in a first medium is partially reflected and partially transmitted at an interface between the first medium and a second medium of lower refractive index, and the partially transmitted light travelling in the second medium is then partially reflected and partially transmitted at an interface between the second medium and a third medium of even lower refractive index.

The intensity of light reflection at an interface between two light-transmissive media varies with their refractive indices in such a way that, ignoring light absorption, the total fraction of light transmitted through both interfaces in the three-medium situation is greater than the fraction of light that would be transmitted through an interface between the two media having the highest and lowest refractive indices. In other words, placing a light-transmissive medium having an intermediate refractive index between two other light-transmissive media enables more light to be transmitted from the medium having the highest refractive index to the medium having the lowest refractive index than would occur if the media having the highest and lowest indices directly adjoined each other.

In view of the foregoing interface optics, arranging for the m coatings overlying each particle to have the above-described positional and refractive-index characteristics enables more light travelling backward and partially sideways to escape each particle and its coatings than would escape that particle in the absence of the coatings. Part of the light that escapes the particles travelling backward, including partially sideways, strikes the light-reflective layer in such a way as to be reflected generally forward to the sides of the particles. Accordingly, the intensity of emitted light is enhanced in the forward direction.

In a fourth aspect of the invention, part of the outer surface of each light-emissive particle is conformally covered with an intensity-enhancement coating of lower average refractive index than that particle. A contrast-enhancement layer, which appears dark as seen through the plate from opposite the light-emissive region, overlies the intensity enhancement coatings. The contrast-enhancement layer is typically divided into multiple contrast-enhancement coatings, each generally conformally overlying a corresponding one of the intensity-enhancement coatings. Once again, a light-reflective layer normally overlies the coatings.

The contrast-enhancement layer absorbs ambient light which impinges on the front of the light-emitting device and passes through the plate, the light-emissive particles, and the intensity-enhancement coatings. As a result, the contrast-enhancement layer improves the optical contrast between times when the light-emissive region is turned on and times when it is turned off. Hence, an improvement is achieved in the optical contrast between two such light-emissive regions during periods when one is turned on and the other is turned off.

The intensity-enhancement coatings in this aspect of the invention function generally the same as in the previous aspect of the invention to enable more backward-travelling light to escape the light-emissive particles and coatings than would escape the particles if the intensity-enhancement coatings were absent. Although the contrast-enhancement layer normally absorbs part of this backward-travelling light, the light-reflective layer reflects more backward-travelling light forward than would occur in the absence of intensity-enhancement coatings. The overall visibility of the image produced by multiple ones of the light-emissive regions is improved.

In a fifth aspect of the invention, each light-emissive particle is again partially covered with a conformal intensity-enhancement coating of lower average refractive index than that particle. A light-reflective coating similarly covers each intensity-enhancement coating. The intensity-enhancement coatings again enable more rear-directed light to escape the light-emissive particles and intensity-enhancement coatings than would escape the particles in the absence of the coatings. The light-reflective coatings reflect part of this increased amount of rear-directed light forward. When, as is typically the case, a light-reflective layer overlies the light-reflective coatings, the combination of the light-reflective coatings and the light-reflective layer enables more of the rear-directed light to be reflected forward than would be attained solely with the light-reflective layer. The light intensity in the forward direction is improved.

In a sixth aspect of the invention, part of the outer surface of each light-emissive particle is conformally covered with a contrast-enhancement coating without any intervening intensity-enhancement coating. The contrast-enhancement coatings appear dark as seen through the plate from opposite the light-emissive region. Each contrast-enhancement coating typically consists of multiple portions spaced apart from each other. Similar to the contrast-enhancement layer mentioned above, the contrast-enhancement coatings improve the optical contrast between times when the light-emissive region is turned on and when it is turned off. Consequently, the optical contrast is improved between two such light-emissive regions during periods when one is turned on and the other is turned off.

The particle coatings are located between the layer of light-emissive particles and the accompanying electron-emitting device in all six of the foregoing aspects of the invention. Although the coatings only partially cover the outer surfaces of the particles, the vast majority of the electrons emitted by the electron-emitting device strike the coatings before reaching the underlying light-emissive material of the particles. The particle coatings normally consist of material that does not become significantly volatile when struck by the electrons. Consequently, the particle coatings themselves normally do not pose significant contamination problems.

At the same time, the particle coatings reduce damaging effects, such as particle erosion and undesired outgassing, that arise when electrons strike the particles. Both performance and lifetime are improved. In fact, when the coatings contain one or more of the metals prescribed above for the light-reflective coatings in the first aspect of the invention, the preceding advantages can be achieved even though the coatings are insufficient, e.g., too thin, to provide significant light reflection.

Manufacture of a light-emitting device in accordance with the invention entails providing a layer of light-emissive particles over light-transmissive material of a plate to form a light-emissive region. The coatings are subsequently provided over the particles to provide one or more of the functions described above. When a light-reflective layer is to be included in the light-emitting device, the light-reflective layer is formed over the coatings.

In short, a light-emitting device configured and manufactured according to the invention has improved performance and increased lifetime. The present light-emitting device can readily be manufactured in a large scale production environment. By providing the particles with the present coatings after the particles have been provided over the plate, the invention avoids concerns, such as damaging the particle coatings, that can arise when pre-coated particles are deposited over a plate. Accordingly, the invention provides a substantial advance over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

General Considerations

Figure 1:
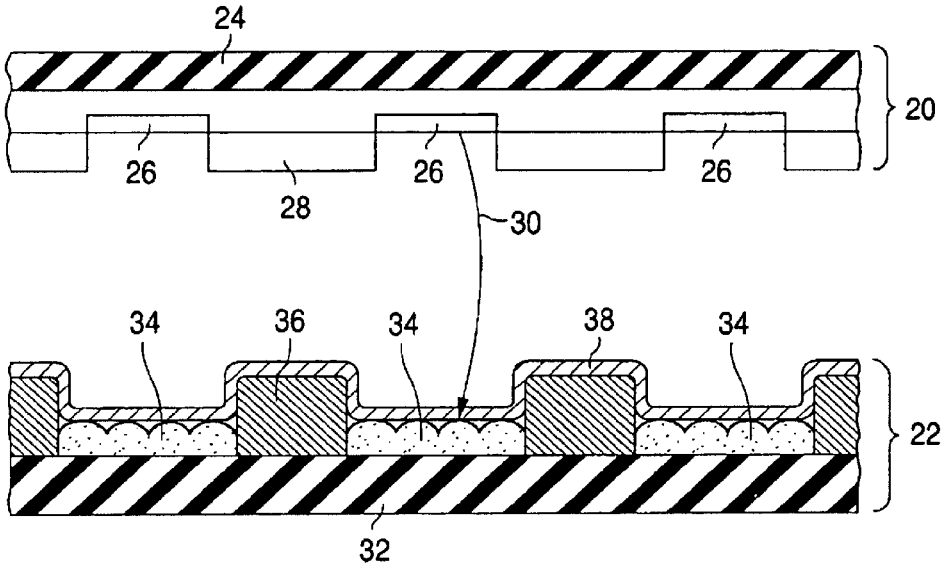
Fig. 1 PRIOR ART
FIG. 1 is a cross-sectional side view of part of the active region of a conventional flat-panel CRT display.
Figure 2:
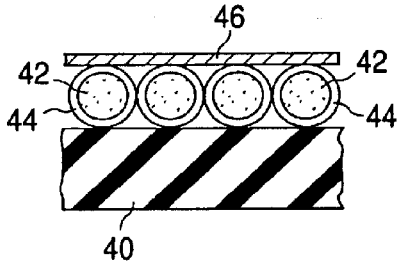
Fig. 2 PRIOR ART
FIGS. 2 and 3 are cross-sectional side views of parts of the active portions of two embodiments of a light-emitting device of a conventional flat-panel CRT display.
Figure 3:
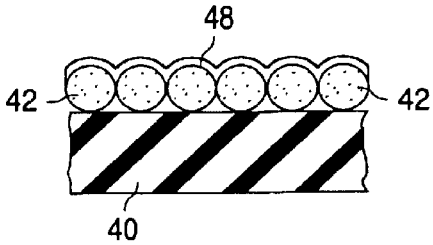
Fig. 3 PRIOR ART

Various configurations are described below for flat-panel CRT displays having light-emitting devices configured according to the invention. Each flat-panel CRT display is typically suitable for a flat-panel television or a flat-panel video monitor for a personal computer, a laptop computer, a workstation, or a hand-held device such as a personal digital assistant.

Each of the present flat-panel CRT displays is typically a color display but can be a monochrome, e.g., black-and-green or black-and-white, display. Each light-emissive region and the corresponding oppositely positioned electron-emissive region form a pixel in a monochrome display, and a sub-pixel in a color display. A color pixel typically consists of three sub-pixels, one for red, another for green, and the third for blue.

In the following description, the term "electrically insulating" or "dielectric" generally applies to materials having a resistivity greater than $10^{10}$ ohm-cm. The term "electrically non-insulating" thus refers to materials having a resistivity of no more than $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 10 volts/$\mu$m.

Electrophoretic deposition and dielectrophoretic deposition are sometimes grouped together as "electrophoretic deposition". The term "electrophoretic/dielectrophoretic deposition" is utilized here to emphasize that such deposition occurs by one or both of electrophoresis and dielectrophoresis.

A light-emissive phosphor particle whose outer surface is partially conformally covered with one of the present coatings is sometimes referred to here as a "coated" phosphor particle or simply a "coated" particle. In a light-emissive region having such coated phosphor particles, any light-emissive phosphor particle whose outer surface is nowhere conformally covered with one or more of the present coatings is sometimes referred to here as an "uncoated" phosphor particle or simply an "uncoated" particle.

As described below, each light-emissive region in the light-emitting devices of the invention contains multiple light-emissive phosphor particles. A particle coating conformally covers part of the outer surface of each of certain of the phosphor particles in each light-emissive region. One or more other particle coatings may be situated over the first-mentioned particle coating on each coated particle. The particle coatings which overlie phosphor particles in each light-emissive region and which have largely the same vertical relationships to any other particle coatings overlying phosphor particles in that light-emissive region form a group of particle coatings for that light-emissive region.

The particle coatings in such a group of particle coatings for each light-emissive region may variously interconnect to one another depending on factors such as the spatial relationship of the light-emissive particles to one another in that light-emissive region and on how those particle coatings are formed. In other words, one or more particles coatings in a group of particle coatings for each light-emissive region may contact one or more other particles coatings in that particle coating group. The particle coatings in a group of particle coatings for each light-emissive region then form a particle coating layer which may be a continuous, i.e., single, piece of the particle coating material or may consist of multiple spaced-apart portions of the particle coating material. In either case, gaps are normally present in the particle coating layer above spaces between the phosphor particles and may be present at other locations depending on the spatial relationship of the phosphor particles to one another in each light-emissive region.

Each particle coating in a group of particle coatings for each light-emissive region can, in some cases, be spaced apart from each other particle coating in that group of particle coatings. In any event, each particle coating in a group of particle coatings for each light-emissive region in one of the present light-emitting devices is normally spaced apart from each particle coating in a corresponding group of particle coatings for each other light-emissive region in that light-emitting device.

Light-Reflective or/and Getter Coatings

Figure 4:
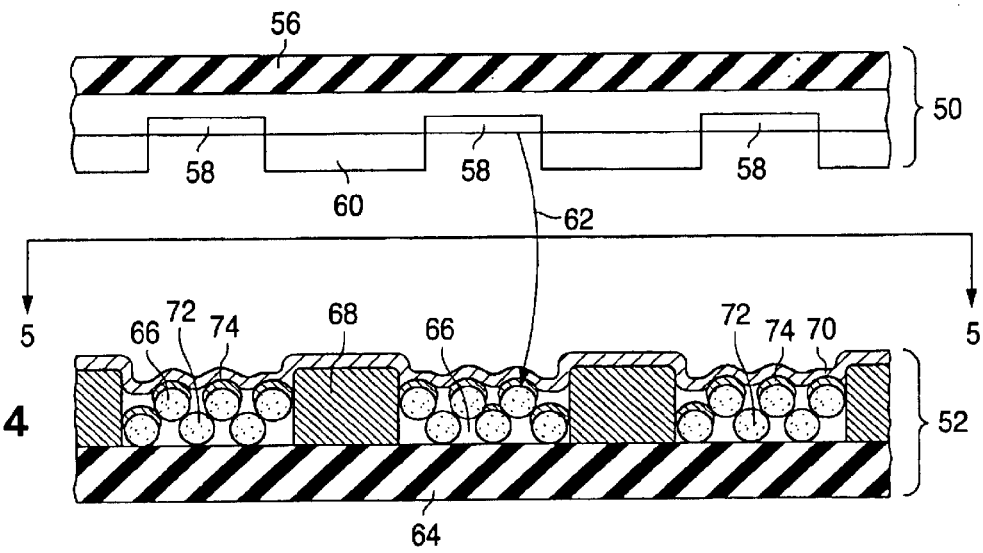
FIG. 4 is a cross-sectional side view of part of the active region of a flat-panel CRT display having a light-emitting device configured according to the invention.
Figure 5:
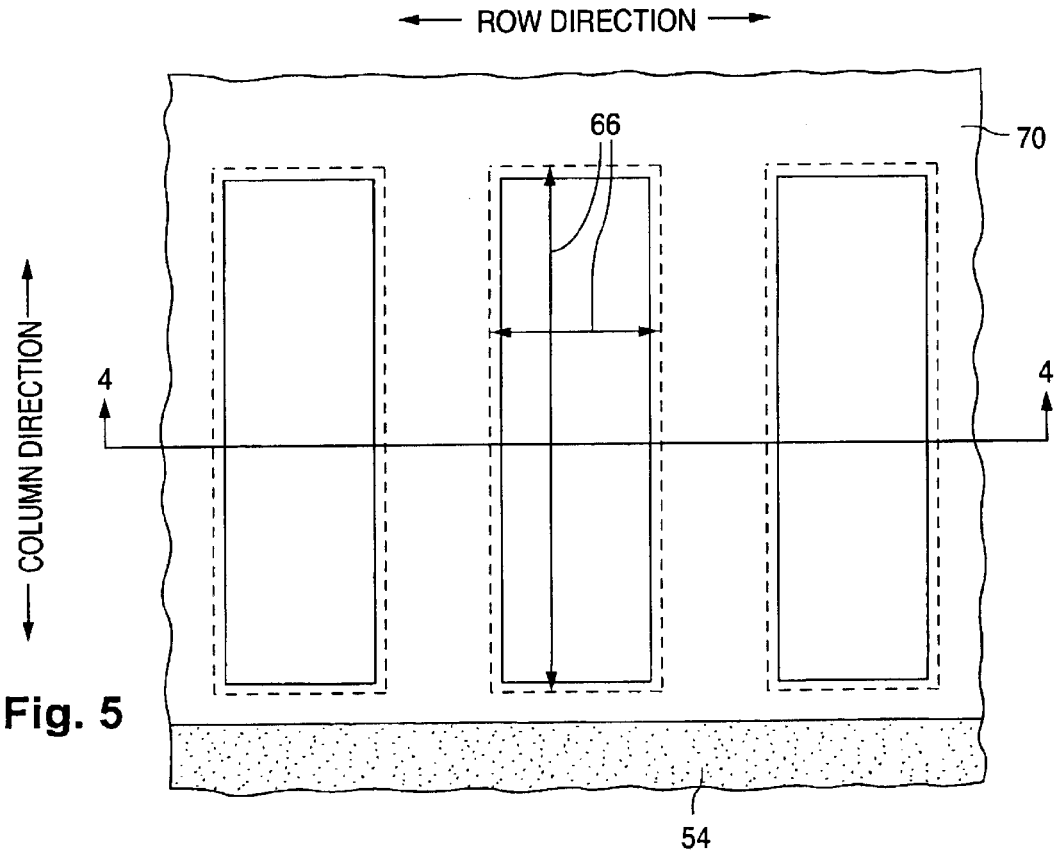
FIG. 5 is a cross-sectional plan view of part of the active region of the flat-panel CRT display, specifically the light-emitting device, of FIG. 4. The cross section of FIG. 4 is taken along plane 4—4 in FIG. 5. The cross section of FIG. 5 is taken along plane 5—5 in FIG. 4.

FIGS. 4 and 5 respectively illustrate side and plan-view cross sections of part of the active region of a flat-panel CRT display having an electron-emitting device 50 and an oppositely situated light-emitting device 52 configured according to the invention for enhancing image intensity. Devices 50 and 52 are connected together through an outer wall (not shown) to form a sealed enclosure maintained at a high vacuum, typically an internal pressure of no more than $10^{-6}$ torr. The plan-view cross section of FIG. 5 is taken in the direction of light-emitting device 52 along a plane extending laterally through the sealed enclosure. Hence, FIG. 5 largely presents a plan view of part of the active portion of device 52.

In addition to devices 50 and 52, the flat-panel display of FIGS. 4 and 5 normally includes a group of internal supports, referred to as spacers, which prevent external forces, such as the typical external-to-internal pressure differential of approximately 1 atm, from collapsing the display. The spacers also maintain a uniform spacing between devices 50 and 52. The spacers are typically shaped generally like flat walls, but can have other shapes such as posts. Item 54 in FIG. 5 indicates the location for a typical spacer wall.

Electron-emitting device, or backplate structure, 50 is formed with a generally flat electrically insulating backplate 56 and a group of layers and regions situated over the interior surface of backplate 56. These layers/regions include a two-dimensional array of rows and columns of laterally separated electron-emissive regions 58. Each electron-emissive region 58 consists of one or more electron-emissive elements (not separately shown) which emit electrons that are directed toward light-emitting device 52. The layers/regions also include an electron-focusing system 60 which extends vertically beyond electron-emissive regions and focuses electrons emitted by regions 56 on corresponding target areas of light-emitting device 52. Item 62 represents the trajectory of one of these electrons.

Electron-emitting device 50 typically operates according to field emission. In that case, each electron-emissive region 58 emits electrons in response to a suitable electrical potential. Examples of field-emission electron-emitting structures suitable for implementing device 50 are described in U.S. Pat. No. 6,049,165. Device 50 may, nonetheless, emit electrons according to another technique such as thermal emission.

Light-emitting device, or faceplate structure, 52 is formed with a generally flat electrically insulating faceplate 64 and a group of layers and regions situated over the interior surface of faceplate 64. Faceplate 64 is transparent, i.e., generally transmissive of visible light, at least where visible light is intended to pass through faceplate 64 to produce an image on the exterior surface (lower surface in FIG. 4) of faceplate 64 at the front of the display. Faceplate 64 typically consists of glass. The layers/regions overlying faceplate 64 include a two-dimensional array of rows and columns of light-emissive regions 66, a patterned light-blocking region 68, and a light-reflective layer 70.

Light-emissive regions 66 and light-blocking region 68 lie directly on faceplate 64. Light-emissive regions 66 are situated in openings extending through light-blocking region 68 at locations respectively opposite electron-emissive regions 58. Faceplate 64 is transmissive of visible light at least below light-emissive regions 66. In a color implementation of the display, three consecutive regions 66 in a row emit light of three different colors, normally red, blue, and green, when struck by electrons emitted from regions 58. Light-reflective layer 70 lies over light-emissive regions 66 and light-blocking region 68.

Light-blocking region 68 is generally non-transmissive of visible light. More particularly, region 68 largely absorbs visible light which impinges on the exterior surface of faceplate 64 at the front of the display, passes through faceplate 64, and then impinges on region 68. As viewed from the front of the display through faceplate 64, region 68 is dark, largely black. For this reason, region 68 often referred to here as a "black matrix". Also, black matrix 68 is largely non-emissive of light when struck by electrons emitted from electron-emissive regions 58. The preceding characteristics enable matrix 68 to enhance the image contrast.

Black matrix 68 consists of one or more layers or regions, each of which may be electrically insulating, electrically resistive, or electrically conductive. Only part of the thickness of matrix 68 may consist of dark material that absorbs visible light. The dark portion of the thickness of matrix 68 can adjoin, or be vertically separated from, faceplate 64.

In the exemplary display of FIGS. 4 and 5, black matrix 68 is thicker (or taller) than light-emissive regions 66 and preferably includes electrically insulating material that contacts light-reflective layer 70. As described further below, electrons emitted by electron-emissive regions 58 in electron-emitting device 50 pass through layer 70 and strike light-emissive regions 66, causing them to emit light in all directions. Some of the electrons which strike regions 66 are scattered backward off regions 66 rather than causing regions 66 to emit light. Black matrix 68 collects some of these backscattered electrons and thereby prevents the so-collected electrons from striking non-intended ones of regions 66 and causing image degradation. By having matrix 68 extend vertically beyond regions 66, the ability of matrix 68 to collect backscattered electrons is enhanced.

Alternatively, black matrix 68 can be thinner (shorter) than light-emissive regions 66. In that case, black matrix 68 preferably includes electrically conductive material that contacts light-reflective layer 70.

Alternatively, black matrix 68 can be thinner (shorter) than light-emissive region 66. In that case, black matrix 68 preferably includes electrically conductive material that contacts light-reflective layer 70.

Light-reflective layer 70, by itself or in combination with black matrix 68 when matrix 68 consists of electrically conductive material, normally serves as the anode for the flat-panel display. As such, layer 70 contains electrically non-insulating material, normally electrically conductive material. A selected anode electrical potential, typically in the vicinity of 500–10,000 volts is applied to the electrically non-insulating material of layer 70 from a suitable voltage source (not shown) during display operation. As discussed further below, layer 70 enhances the light intensity of the display's image by reflecting forward some of the rear-directed light emitted by regions 66. Although layer 70 is illustrated as a blanket layer in FIG. 4, layer 70 is typically perforated by microscopic pores situated at substantially random locations. Layer 70 typically consists of aluminum, or an aluminum alloy, having a thickness of 30–150 nm, typically 70 nm.

Returning to light-emissive regions 66, each region 66 consists of multiple light-emissive phosphor particles 72 distributed generally randomly over the nortion of faceplate 64 below that region 66. The average thickness of light-emissive regions 66 is typically greater than a monolayer (a one-particle-thick layer of particles packed as closely together as possible), e.g., 1.5 monolayers, and up to 3 monolayers or more, but can be less than a monolayer. Phosphor particles 72 are roughly spherical in shape and vary somewhat in diameter from one to another. As used here, the diameter of a particle 72 is the diameter of a perfect sphere which occupies the same volume as that particle 72. The mean diameter of particles 72 is 1–15 $\mu$m, typically 5 $\mu$m. At the typical mean diameter of 5 $\mu$m, the coefficient of quartile deviation in the mean particle diameter is typically 0.2–0.3.

Phosphor particles 72 can be constituted in various ways. Preferably, particles 72 are metal sulfide phosphors, including metal oxysulfide phosphors. In a color implementation of the flat-panel display of FIGS. 4 and 5, each particle 72 which emits red light is typically a $Y_2O_2S$:Eu phosphor in which yttrium in an yttrium oxysulfide host crystal is substituted at some locations with europium. Each particle 72 which emits blue light is typically a ZnS:Ag,Al phosphor in which zinc in a zinc sulfide host crystal is substituted at some locations with silver and aluminum. Each particle 72 which emits green light is typically a ZnS:Cu,Al phosphor in which zinc in a zinc sulfide host crystal is substituted at some locations with copper and aluminum. Alternatively, particles 72 can be metal oxide phosphors or strontium thiogallate phosphors.

Part of the outer surface of each of certain phosphor particles 72 is, in accordance with the invention, conformally covered with a light-reflective coating 74 spaced apart from where that particle 72 is closest to faceplate 64. Coated particles 72 consist at least of those particles 72 located along the top of each light-emissive region 66. Whether there are any uncoated particles 72 in a region 66 having coated particles 72 depends on factors such as the thickness of regions 66 in monolayers and how coatings 74 are formed. Any uncoated particles 72 in a region 66 having coated particles 72 are most likely to be located along the bottom of that region 66. In cases where the thickness of each region 66 is close to, or less than, a monolayer, substantially all of particles 72 normally have coatings 74.

Light-reflective coatings 74 can partially conformally cover various portions of the outer surfaces of coated phosphor particles 72. Depending on how coatings 74 are formed, each coating 74 typically conformally covers at least part of the upper half (back half relative to the exterior surface of faceplate 64 at the front of the display) of underlying particle 72. In the example of FIG. 4, coatings 74 largely conformally cover the upper halves of particles 72 located along the tops of light-emissive regions 66 but do not extend significantly over the lower halves of particles 72 located anywhere in regions 66. Nonetheless, coatings 74 can extend conformally somewhat over the lower halves of certain of particles 72, e.g., particles 72 located along the tops of regions 66, provided that coatings 74 do not extend so far downward over any of particles 72 as to reach the bottoms of regions 66. That is, coatings 74 do not extend so far downward over particles 72 as to contact faceplate 64 in the example of FIG. 4. Coatings 74 can also cover less than the upper halves of particles 72 located along the tops of regions 66 provided that these coatings 74 cover more of the upper halves of particles 72 located along the tops of regions 66 than would be contacted by light-reflective layer 70 if coatings 74 were absent.

Coatings 74 are, for convenience, illustrated as continuous and non-perforated. Depending on their thicknesses, coatings 74 may be perforated. Also, coatings 74 may be discontinuous, i.e., divided into multiple segments spaced apart from one another.

Light-reflective layer 70 overlies light-reflective coatings 74 and typically contacts some or all of coatings 74. At the locations where layer 70 contacts coatings 74, layer 70 normally conforms to their outer surfaces. However, coatings 74 normally extend sufficiently far down coated particles 72 toward faceplate 64 that layer 70 conforms, on the average, to only part of the outer surface of each coating 74. More particularly, each coating 74 normally contacts more of the outer surface of underlying coated particle 72 than layer 70 would contact if that coating 74 were absent. In view of this, layer 70 is generally flat, i.e., approximately (or roughly) flat to nearly perfectly flat, above each light-emissive region 66.

Depending on how light-reflective coatings 74 are formed, a layer (not shown) of the material that forms coatings 74 may be situated on top of black matrix 68 below light-reflective layer 70. This additional light-reflective layer is typically not disadvantageous and can sometimes be advantageous. For example, the additional light-reflective layer typically consists of metal that adjoins layer 70. Hence, the additional light-reflective layer can cooperate with layer 70 in serving as the display's anode. Even if the additional light-reflective layer does not contact layer 70, the additional light-reflective layer may still be employed in removing charge from phosphor particles 72 when they are struck by electrons during display operation.

Pieces (not shown) of the light-reflective particle coating material may sometimes be situated on the upper surface of faceplate 64 in the spaces between phosphor particles 72 of each light-emissive region 66. The presence of such pieces of the light-reflective coating material on the interior faceplate surface is generally not beneficial and can be disadvantageous. As discussed further below, the formation of coatings 74 is thus typically conducted in such a manner as to largely avoid forming pieces of the light-reflective coating material on the interior faceplate surface in the spaces between particles 72 of each region 66.

Phosphor particles 72 emit light in all directions. Part of the emitted light is emitted with some velocity in the forward direction (the downward direction in FIG. 4) and passes through faceplate 64. Part of the remainder of the phosphor-emitted light travels rearward, i.e., with some velocity in the backward direction (the upward direction in FIG. 4), so as to be reflected off light-reflective coatings 74. Particles 72 are generally transparent, i.e., generally transmissive of visible light. Part of the phosphor-emitted light reflected off coatings 74 passes through particles 72 and then through faceplate 64, thereby increasing the light intensity in the forward direction. Accordingly, light-reflective coatings 74 produce an increase in the intensity of the image presented on the display's viewing surface.

Light-reflective layer 70 functions in a similar manner to light-reflective coatings 74. That is, layer 70 reflects forward some of the rear-directed light emitted by phosphor particles 72. Because coatings 74 are in front of layer 70, much of the initially rear-directed light emitted by particles 72 is reflected forward by coatings 74 and thus does not reach layer 70. However, some of the phosphor-emitted light passes by or through coatings 74 and impinges on layer 70 directly or after one or more intermediate reflections. Layer 70 then reflects that light forward so that part of it passes through faceplate 64. Accordingly, layer 70 increases the light intensity in the forward direction so as to further increase the image intensity. The combination of layer 70 and coatings 74 provides more increase in the forward light intensity than would occur solely with coatings 74 or solely with layer 70.

Light-reflective coatings 74 normally consist of metal. Candidate metals for coatings 74 are beryllium, boron, magnesium, aluminum, chromium, manganese, iron, cobalt, nickel, copper, gallium, molybdenum, palladium, silver, indium, platinum, thallium, and lead. Coatings 74 may contain two or more of these metals or may consist of an alloy of one or more of these metals with one or more other materials. Boron, aluminum, gallium, indium, and thallium, which all fall into Group IIIB (13) of the Periodic Table, are attractive for coatings 74 because none of these five metals is an electron donor. Consequently, each of them is highly unlikely to cause phosphor particles 72 to emit light of the wrong color should atoms of any of these five metals migrate into particles 72.

The choice of metals or other materials to implement light-reflective coatings 74 typically depends on the constituency of phosphor particles 72 and thus on the type of light emitted by particles 72. Specifically, coatings 74 which (partially) cover particles 72 that emit light of one type may consist of different material than coatings 74 which (partially) cover particles 72 that emit light of another type.

For instance, in a color implementation of the present flat-panel display, silver and the Group IIIB metals boron, aluminum, gallium, indium, and thallium are particularly suitable for those coatings 74 which cover particles 72 that emit blue light, especially when the blue-emitting particles 72 consist of ZnS:Ag,Al phosphors. Copper and these five Group IIIB metals are particularly suitable for those coatings 74 which cover particles 72 that emit green light, especially when the green-emitting particles 72 consist of ZnS:Cu,Al phosphors. Silver and copper are advantageous materials for coatings 74 in implementations where coatings 74 respectively cover blue-emitting ZnS:Ag,Al particles 72 and green-emitting ZnS:Cu,Al particles 72 because silver and copper respectively are substitutional species in these blue-emitting and green-emitting particles 72. Accordingly, any silver and copper atoms that respectively migrate into ZnS:Ag,Al particles 72 and ZnS:Cu,Al particles 72 are highly unlikely to cause these blue-emitting and green-emitting particles 72 to emit light of the wrong color.

The thickness of light-reflective coatings 74 depends on various factors. Electrons emitted by regions 58 of electron-emitting device 50 pass through both light-reflective layer 70 and coatings 74 before striking phosphor particles 72 to cause light emission. The electron passage through layer 70 and coatings 74 leads to a loss in electron energy and a consequent loss in intensity of the light emitted by particles 72. Increasing the thickness of coatings 74 generally increases the amount of electron energy loss and the consequent loss in the light intensity. On the other hand, coatings 74 do not provide adequate light-reflection capability if they are too thin. The average thickness of coatings 74 is normally 50–200 nm, typically 100 nm, when coatings 74 consist of aluminum.

Phosphor particles 72 may produce contaminant gases when struck by high energy charged particles, especially electrons emitted by electron-emissive regions 58. For example, particles 72 may outgas sulfur when part or all of them are metal sulfide phosphors, or oxygen when part or all of them are metal oxide phosphors. When part or all of particles 72 are metal oxysulfide phosphors, they may outgas both sulfur and oxygen. Outgassed sulfur can be in the form of atomic/molecular sulfur or/and in the form of sulfur-containing compounds. Sulfur, although a solid at standard temperature (0° C.) and pressure (1 atm.), is gaseous at the high vacuum, typically a pressure of $10^{-6}$ torr or less, present in the interior of the display of FIGS. 4 and 5. Unless these contaminant gases are prevented from leaving the immediate vicinity of particles 72, the contaminant gases can enter the interior of the display and cause damage.

As discussed further below, light-reflective coatings 74 provide protective shields that reduce the severity of certain damaging effects, such as outgassing and erosion, that occur to phosphor particles 72 when they are struck by high-energy electrons or/and other high-energy charged particles. These advantages can be partially or largely fully achieved even through coatings 74 may be so thin as to not provide adequate light reflection. Additional reliance is then placed on light-reflective layer 70 for reflecting the phosphor-emitted, rear-directed light forward.

Coatings 74 may, in accordance with the invention, consist of one or more of the following metals provided over particles 72 to a thickness below that needed for adequate light reflection: beryllium, boron, magnesium, aluminum, titanium, vanadium, chromium, manganese, iron, cobalt, nickel, copper, gallium, zirconium, niobium, molybdenum, palladium, silver, indium, barium, tantalum, tungsten, platinum, thallium, lead, and thorium, including alloys of one or more of these twenty-six metals. Alternatively or additionally, coatings 74 may consist of oxide one or more of magnesium, chromium, manganese, cobalt, nickel, and lead. When coatings 74 are implemented with one or more of these six metal oxides, coatings 74 normally provide the protective shielding function even though they may not furnish adequate light reflection.

Light-reflective coatings 74 function as getter coatings when they consist of certain of the preceding thirty-two metals and metal oxides. Getter candidates for this purpose include the metals magnesium, titanium, vanadium, chromium, manganese, iron, cobalt, nickel, copper, zirconium, niobium, molybdenum, palladium, silver, barium, tantalum, tungsten, platinum, lead, and thorium, including alloys of one or more of these twenty metals. Coatings 74 can then sorb contaminant gases, including gases released by phosphor particles 72 upon being struck by electrons as well as gases otherwise present in the interior of the flat-panel display. Magnesium, chromium, manganese, iron, cobalt, nickel, copper, molybdenum, palladium, silver, platinum, and lead, are particularly suitable for sorbing sulfur, especially sulfur released by particles 72 when they are metal sulfide phosphors (again including metal oxysulfide phosphors). In one embodiment, coatings 74 consist largely of palladium or/and chromium.

Alternatively or additionally, coatings 74 can be implemented with oxide of one or more of magnesium, chromium, manganese, cobalt, nickel, and lead to provide a gettering function. Each of these six metal oxides is particularly suitable for sorbing sulfur. Coatings 74 consist largely of magnesium oxide in one embodiment.

When coatings 74 contain two or more of preceding twenty-six metals and metal oxides for sorbing contaminant gases, the two or more getter materials are normally mixed together to form an alloy in which all the getter materials are distributed across each coating 74, normally in a relatively uniform manner. In a multi-material alloy implementation, the alloy preferably consists of oxide of two or more of magnesium, chromium, manganese, cobalt, nickel, and lead. Implementing coatings 74 with an alloy of two or more of these six metal oxides can, for certain combinations, provide better gettering, especially sulfur gettering, than is typically individually achievable with each of the corresponding component metal oxides. Alternatively, the alloy in these multi-material implementations of coatings 74 consists of two or more of the metals magnesium, chromium, manganese, cobalt, copper, palladium, nickel, silver, and lead for achieving better gettering then what is typically achievable individually with each of the corresponding component metals.

The ability of light-reflective coatings 74 to sorb contaminant gases, e.g., sulfur or/and oxygen, released by phosphor particles 72, is particularly advantageous because the gettering action typically occurs in close proximity to where the outgassing occurs. As a consequence, a substantial fraction of the contaminant gases that might otherwise escape the immediate vicinity of particles 72 is sorbed by coatings 74 and thereby prevented from causing damage elsewhere in the flat-panel display. The gettering capability of coatings 74 in this implementation supplements the outgas shielding effect that coatings 74 impose on particles 72 to reduce display degradation.

As mentioned above, light-reflective layer 70 is typically perforated. The perforations in layer 70 allow gases originating in the display's interior to pass through layer 70 and be sorbed by light-reflective coatings 74.

Coatings 74 need not be light reflective when they perform the gettering function. Depending on the getter material utilized to form coatings 74, the average thickness of coatings 74 must typically be at least some minimum value for coatings 74 to provide adequate gettering. Nonetheless, coatings 74 may sometimes be thick enough to sorb contaminant gases adequately but too thin to provide adequate light reflection.

Importantly, coatings 74 are situated in the active portion of light-emitting device 52 in FIGS. 4 and 5. A high gettering surface area can thereby be achieved without significantly increasing the overall lateral device area. In addition, the getter material is distributed in a highly uniform manner across the active device portion. Difficulties such as undesired active-portion pressure gradients, which can arise from non-uniform gettering in the active portion of a light-emitting device, are avoided in device 52.

The getter material of coatings 74 is normally porous. Contaminant gases gather along or near the surfaces of coatings 74, causing their gettering capability to decrease as time passes. By appropriately treating the getter material according to an "activation" process, the gases accumulated along or near the surfaces of coatings 74 are driven into their interiors. This enables the getter material to regain much of its gettering capability up to the point at which the internal gas-holding capability of the getter material is reached. The getter material can typically be activated a large number of times.

Coatings 74 are normally created before hermetically sealing the light-emitting device 52 and electron-emitting device 50 together to assemble the flat-panel CRT display. In a typical fabrication sequence, completed light-emitting device 52 is exposed to air prior to the display sealing operation. Because light-reflective layer 70 is porous, coatings 74 are exposed to air prior to display sealing. Contaminant gases thereby accumulate along part of the effective gettering surface of coatings 74. Accordingly, the getter material of coatings 74 typically needs to be activated during or subsequent to the display sealing operation while the enclosure between devices 50 and 52 is at a high vacuum.

Activation of the getter material of coatings 74 can be done in various ways. The getter material can be activated by raising its temperature to a sufficiently high value, typically 300–900° C., for a sufficiently long period of time. In general, the amount of time needed to activate the getter material decreases with increasing activation temperature. By sealing the display of FIGS. 4 and 5 at a temperature in excess of 300° C., typically 350° C., in a highly evacuated environment, the activation can be automatically accomplished during the sealing operation. When a component adjoining coatings 74 contains electrically resistive material, a voltage can sometimes be applied to the resistive material to raise its temperature high enough to activate the getter material.

Depending on the configuration of the overall flat-panel display, electromagnetic wave energy can be directed locally toward coatings 74 to activate the getter material. For example, the getter material can sometimes be activated with a beam of directed energy such as a laser beam. In some cases, the activation can be accomplished by directing radio-frequency energy, such as microwave energy, toward the getter material. Electrons emitted by electron-emissive regions 58 in electron-emitting device 50 pass through, and thereby strike, coatings 74. These electrons are of relatively high energy and, in certain cases, can activate the getter material.

Figure 6A:
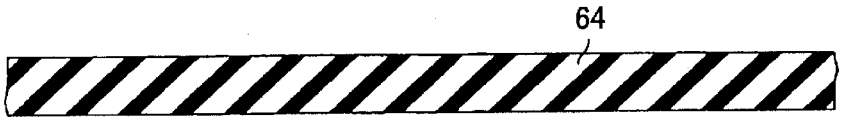
FIGS. 6*a*–6*e* are cross-sectional side views representing steps in fabricating the light-emitting device of FIGS. 4 and 5 according to the invention.

Various processes may be employed to fabricate light-emitting device 52 of FIGS. 4 and 5. FIGS. 6*a*–6*e* (collectively "FIG. 6") illustrate a general process for manufacturing device 52 in accordance with the invention. Referring to FIG. 6*a*, the starting point for the process of FIG. 6 is faceplate 64.

Figure 6B:
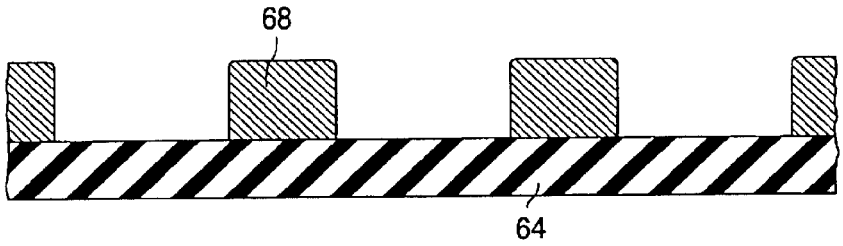
Figure 6C:
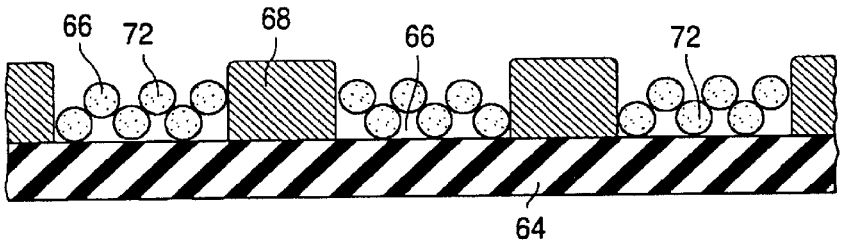
Figure 6D:
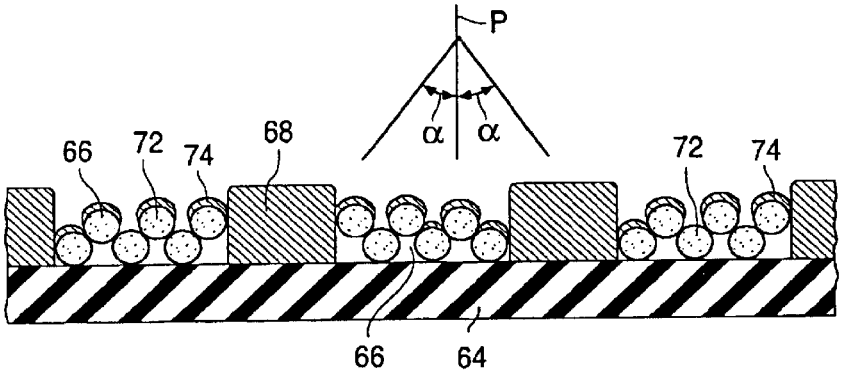

Black matrix 68 is formed on faceplate 64 as indicated in FIG. 6*b*. Matrix 68 can be formed according to various techniques. When matrix 68 is a single layer, a blanket layer of the black matrix material can be deposited on faceplate 64. Techniques such as evaporation, sputtering, thermal spraying, chemical vapor deposition ("CVD"), and electrophoretic/dielectrophoretic deposition can be utilized to deposit the blanket layer. A coating of a liquid formulation or slurry containing the black matrix material can be deposited on faceplate 64 and dried. Sintering or baking can be performed as needed. Using a suitable mask such as a photoresist mask, matrix 68 is created by removing portions of the blanket layer at the locations for light-emissive regions 66.

If black matrix 68 contains polymeric material, a layer of actinically polymerizable material can be deposited over faceplate 64. Portions of the layer are cured by exposing them to suitable actinic radiation, e.g., ultraviolet ("UV") light, to induce polymerization. The uncured polymerizable material is removed. If the polymeric material is to provide layer 68 with its black characteristic, a pyrolysis step is performed to blacken the cured material.

Alternatively, black matrix 68 can be formed by a deposition/lift-off technique. As a further alternative, the black matrix material can be deposited through a shadow mask. When matrix 68 consists of two or more layers, repetitions or/and combinations of the preceding techniques can be employed to create matrix 68. Matrix 68 can also be preformed and then mounted on faceplate 64 using a suitable adhesive.

Light-emissive regions 66 consisting of layers of phosphor particles 72 are now provided in the openings through black matrix 68. The formation of regions 66 can be done in various ways.

For a color display, a slurry of actinic binder and phosphor particles capable of emitting light of only one of the three colors red, blue, and green can be introduced into the openings in black matrix 68. The actinic binder is typically of the actinically crosslinkable polymeric type. One of every three of the black-matrix openings is exposed to actinic radiation, such as UV light, to cure the so-exposed binder. To minimize misalignment of light-emissive regions 66 to black matrix 68, the exposure step is typically performed through the exterior surface (lower surface in FIG. 6*c*) of faceplate 64 using a mask to cover the openings whose binder material is not intended to be actinically exposed. Any unexposed slurry material is removed with a suitable developer. This procedure is repeated twice with slurries of actinic binder and phosphor particles capable of emitting light of the other two colors.

Next, the binder material is largely removed by appropriately heating the structure. The binder material volatizes to produce the structure of FIG. 6*c*. The removal of the binder material is typically done in air according to a thermal profile that reaches a maximum temperature of 300–480° C., typically 380–390° C. By using the foregoing process to introduce phosphor particles 72 into the openings in black matrix 68, particles 72 adhere well to faceplate 64.

Alternatively, particles 72 can be selectively deposited into the openings in matrix 68. When the display is a color display, the deposition of phosphor particles which emit light of each different color can be done with an appropriate mask placed above the structure. Three such masks are used for the colors red, blue, and green. Each mask prevents phosphor particles which emit light of a given color from accumulating in the black-matrix openings intended for phosphor particles which emit light of the other two colors.

Light-reflective coatings 74 are now formed by providing the desired light-reflective coating material on phosphor particles 72. See FIG. 6*d*. The formation of coatings 74 is normally performed in a high-vacuum environment by a physical deposition technique such as sputtering or evaporation. Thermal spraying under high-vacuum conditions can also be used to create coatings 74. In thermal spraying, a heat source converts the particle coating material into a spray of molten or semi-molten particles that are deposited on particles 72. Thermal spray techniques include plasma spray and wire-arc spray, both of which utilize electrical heat sources, and flame spray, high-velocity-oxygen-fuel spray, and detonation-gun spray, all of which utilize chemical heat sources. After the thermal spray operation is complete, sintering or baking may be performed to convert the deposited particles of coating material into unitary structures.

The sputtering, evaporation, or thermal spraying is preferably done in an angled manner to avoid depositing pieces of the light-reflective particle coating material on faceplate 64 in the spaces between phosphor particles 72 of each light-emissive region 66. In particular, the sputtering, evaporation, or thermal spraying is performed at a non-zero tilt angle $\alpha$ to a line extending generally perpendicular to faceplate 64. Item P in FIG. 6*d* indicates such a line.

Particles, each consisting of one or more atoms of the coating material, impinge on the partially fabricated light-emitting device along paths which, on the average, instantaneously extend roughly parallel to a principal impingement axis which is at tilt angle $\alpha$ to line P. The value of angle $\alpha$ is chosen to be sufficiently large that, depending on the thickness of light-emissive regions 66, particles 72 serve as shields to substantially prevent the coating material from accumulating on the upper (interior) surface of faceplate 64. Angle $\alpha$ is normally 5–45°, typically 15–20°.

The light-reflective particle coating material is supplied from a deposition source situated in a high-vacuum environment. The partially fabricated light-emitting device is, of course, also situated in the high-vacuum environment. The deposition source and partially fabricated device may be translated relative to each other.

When angled sputtering, evaporation, or thermal spraying is employed to create light-reflective coatings 74, the partially fabricated light-emitting device and the deposition source are typically rotated relative to each other about a line (or axis), such as line P, extending generally perpendicular to faceplate 64 in order to achieve a coating thickness which is relatively uniform about that line. The rotation can be done at approximately constant rotational speed or at variable speed. In any event, the rotation is normally performed for at least one full rotation. Alternatively, the angled deposition can be done for a group of significant time periods during each of which the light-emitting device and deposition source are at a largely fixed rotational position relative to each other.

The sputtering, evaporation, or thermal spraying can be performed generally perpendicular to faceplate 64. Light-reflective coatings 74 can also be created by techniques such as electrophoretic/dielectrophoretic deposition and CVD. During each of these deposition procedures, any of a number of measures is employed to prevent pieces of the light-reflective particle coating material from accumulating on the upper surface of faceplate 64. Subsequent to the deposition of phosphor particles 72, but prior to the deposition of coatings 74, a layer of lift-off material can be deposited into the black-matrix openings and onto the exposed portions of faceplate 64 to a fraction, e.g., one half, of the average thickness of light-emissive regions 66. Rather than being deposited after the introduction of particles 72 into the black-matrix openings, the lift-off layer may simply be part of the binder material utilized in depositing particles 72. In any event, pieces of the coating material accumulate on the lift-off layer during the formation of coatings 74 rather than directly on faceplate 64. The lift-off layer is subsequently removed to remove (lift off) these pieces of the coating material.

During all the preceding techniques for creating light-reflective coatings 74, a layer (not shown) of the light-reflective particle coating material normally forms on the upper surface of black matrix 68 and, at least in the case of angled deposition such as angled sputtering, angled evaporation, or angled thermal spraying, on the sidewalls of matrix 68. Various techniques can, if desired, be employed to avoid forming such a light-reflective layer on matrix 68. For example, a lift-off layer can be deposited on matrix 68 prior to forming coatings 74. The lift-off layer can be deposited by an angled technique, such as angled evaporation, angled sputtering, or angled thermal spraying, so as to accumulate on the upper surface of matrix 68 and partly down its sidewalls without significantly accumulating on phosphor particles 72. During the formation of coatings 74, a layer of light-reflective coating material accumulates on the lift-off layer but not on matrix 68. The lift-off layer is subsequently removed to remove the overlying light-reflective layer. Alternatively, coatings 74 can be deposited on particles 72 through openings in a mask, e.g., a shadow mask, having blocking material that covers matrix 68.

Light-reflective coatings 74 may, as mentioned above, sometimes also function as getters for sorbing contaminant gases, especially sulfur. As likewise indicated above, coatings 74 may sometimes function as getters even though they are insufficient, e.g., too thin, to provide adequate light reflection. Coatings 74 may, as further mentioned above, sometimes be thick enough to provide phosphor particles 72 with particle shields but not thick enough to provide adequate light reflection. In all of these variations of coatings 74, the above-described techniques can be employed to form coatings 74.

Figure 6E:
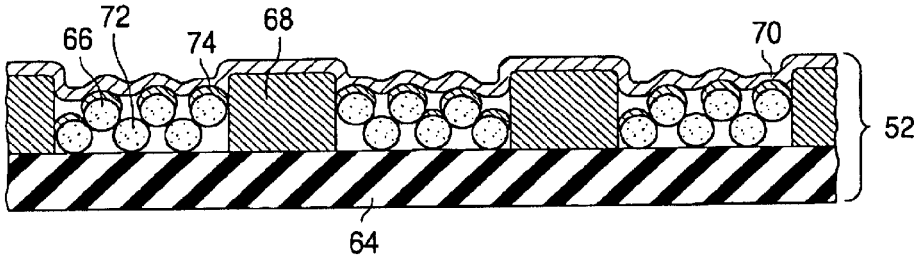

Light-reflective layer 70 is formed over black matrix 68 and coatings 74, typically light reflective, as indicated in FIG. 6*e*. In forming layer 70, an intermediate layer (not shown) of generally solid material which can readily be converted to gas is formed in each black-matrix opening so as to just cover, or nearly cover, light-reflective coatings 74 and phosphor particles 72 in that opening. The intermediate layers in the black-matrix openings may be created by depositing lacquer into those openings and drying the lacquer. For convenience, the solid material that forms the intermediate layers is generally referred to below as "dried lacquer" or simply "lacquer" even though material other than lacquer can be employed to form the intermediate layers.

The lacquer deposition can be done in a blanket manner so that the intermediate lacquer layers in the black-matrix openings are interconnected by dried lacquer (not shown) overlying black matrix 68, i.e., situated directly on matrix 68 or/and on any material, such as the above-mentioned layer of light-reflective coating material, situated on top of matrix 68. Alternatively, various measures can be utilized to prevent lacquer from accumulating on top of matrix 68 or on any material, such as the layer of light-reflective coating material, situated on top of matrix 68. For instance, the lacquer can be deposited through openings in a mask, such as a shadow mask having a blocking region located above matrix 68, including above any material situated on top of matrix 68. As another example, a layer of actinic lacquer can be provided along the upper surface of the structure of FIG. 6*d*, including along any material lying on top of matrix 68. The actinic lacquer layer is then selectively exposed to suitable actinic radiation, e.g., UV light, using an appropriate mask. The actinic radiation can, in some cases, impinge on faceplate 64 from below its lower surface using matrix 68 as the mask. In any event, depending on whether the actinic material is of negative or positive tone, either the exposed or unexposed actinic lacquer is removed to produce the intermediate layers in the black-matrix openings.

After the intermediate lacquer layers are formed in the openings through black matrix 68, light-reflective material, typically aluminum or an aluminum alloy, is deposited on top of the structure to form light-reflective layer 70. The intermediate lacquer layers are then converted to gas by appropriately heating the structure. The gas escapes through the perforations in layer 70 to produce the structure of FIG. 6*e*. Similar to the binder removal heating operation, the lacquer removal is typically done in air according to a thermal profile that reaches a maximum temperature of 300–480° C., typically 380–390° C. The structure of FIG. 6*e* is light-emitting device 52 of FIGS. 4 and 5.

Intensity-Enhancement Coatings

Figure 7:
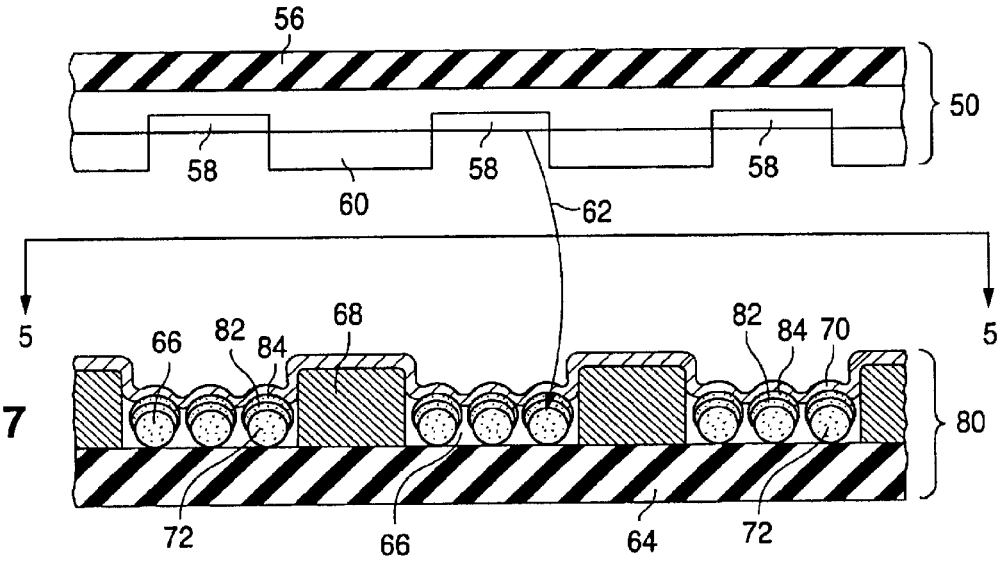
FIG. 7 is a cross-sectional side view of part of the active region of another flat-panel CRT display having a light-emitting device configured according to the invention.

FIG. 7 depicts a side cross section of part of the active region of a flat-panel CRT display having electron-emitting device 50, configured as described above, and an oppositely situated light-emitting device 80 configured according to the invention for enhancing the image intensity. Electron-emitting device 50 and light-emitting device 80 are connected together through an outer wall (not shown) to form a sealed enclosure maintained at a high vacuum, again typically an internal pressure of no more than $10^{-6}$ torr. As seen along a plane extending laterally through the sealed enclosure, the active portion of light-emitting device 80 has a plan view largely identical to that of FIG. 5. Similar to the display of FIGS. 4 and 5, the display of FIG. 7 typically includes spacers, as represented by exemplary spacer wall 54 in FIG. 5, situated between devices 50 and 80. The display of FIG. 7 may also have getter material located at various places in the display.

Light-emitting device 80 contains faceplate 64, light-emissive regions 66, black matrix 68, and light-reflective layer 70. Subject to the comments below about regions 66, components 64, 66, 68, and 70 are configured and constituted the same, and function the same, as in light-emitting device 52 of FIGS. 4 and 5. Black matrix 68 is illustrated as being thicker than light-emissive regions 66 in device 80 but can be thinner than regions 66.

As in light-emitting device 52, each light-emissive region 66 of light-emitting device 80 consists of multiple light-emissive phosphor particles 72 distributed generally randomly over the portion of faceplate 64 below that region 66. The average thicknessof regions 66 in device 80 is illustrated as being significantly less than a monolayer. That is, adjacent particles 72 in each region 66 of device 80 in FIG. 7 often do not touch one another. Consequently, particles 72 in each region 66 are not packed as closely together as possible. This less-than-maximum density packing would arise even if particles 72 were perfect spheres of the same diameter.

If phosphor particles 72 were shaped as perfect spheres of the same diameter packed in a hexagonal arrangement as closely as possible to a thickness of exactly one monolayer, particles 72 in each light-emissive region 66 would, as viewed perpendicular to (the upper surface of) faceplate 64 cover approximately 90% ($(\pi/2\sqrt{3})\times100\%$) of the lateral area occupied by that region 66. In implementations where the thickness of regions 66 is less than a monolayer, particles 72 in each region 66 may cover 50% or less of that region's lateral area as viewed perpendicular to faceplate 64. This amounts to less than 60% of the maximum lateral area that particles 72 could cover in each region 66 if they were shaped as perfect spheres of the same diameter. Although the thickness of regions 66 in light-emitting device 80 is illustrated as being significantly less than a monolayer in FIG. 7, the thickness of regions 66 and device 80 may be greater than a monolayer, e.g., 1.5 monolayers, up to 3 monolayers or more.

Part of the outer surface of each of certain phosphor particles 72 in light-emitting device 80 is, in accordance with the invention, covered with a first intensity-enhancement coating 82 and a second intensity-enhancement 84. In particular, each first intensity-enhancement coating 82 conformally overlies part of the outer surface of underlying particle 72 so as to be spaced apart from where that particle 72 is closest to faceplate 64. Each second intensity-enhancement coating 84 conformally overlies associated first coating 82 so as to overlie part of the outer surface of underlying particle 72 and likewise be spaced apart from where that particle 72 is closest to faceplate 64.

As explained further below, the intensity of light that leaves light-emissive regions 66 in the forward direction, and the consequent image intensity of the display, are enhanced as a result of the positioning and characteristics of intensity-enhancement coatings 82 and 84. However, coatings 82 and 84 do not directly enhance the light intensity themselves. Accordingly, the term "intensity-enhancement" when used here as an adjective for coatings 82 and 84, and also for other such "intensity-enhancement" coatings, is intended to indicate the function achieved with such coatings but is not intended to mean that such coatings actually enhance light intensity.

FIG. 7 illustrates the situation in which, because the thickness of light-emissive regions 66 is depicted as being less than a monolayer, each phosphor particle 72 is a coated particle. In cases where the thickness of regions 66 is greater than a monolayer, some of particles 72 may be uncoated.

Similar to what was said above about any of particles 72 being uncoated in light-emitting device 52, whether there are any uncoated particles 72 in light-emitting device 80 depends on factors such as the thickness of regions 66 in monolayers and how intensity-enhancement coatings 82 and 84 are formed.

First intensity-enhancement coatings 82 can partially conformal cover various portions of the outer surfaces of coated phosphor particles 72 depending on how coatings 82 are formed. In the example of FIG. 7, coatings 82 largely cover the upper halves of particles 72 but do not extend significantly over their lower halves. Coatings 82 can, however, extend somewhat over the lower halves of particles 72 provided that coatings 82 do not extend so far down as to contact faceplate 64 in this example. Coatings 82 can also cover less than the upper halves of particles 72.

Each second intensity-enhancement coating 84 covers largely all of associated first intensity-enhancement coating 82 in the example of FIG. 7. Alternatively, each second coating 84 can cover part of associated first coating 82. Second coatings 84 typically do not extend laterally beyond first coatings 82 so as to contact phosphor particles 72. In any event, second coatings 84 do not extend so far down as to contact faceplate 64.

Light-reflective layer 70 overlies intensity-enhancement coatings 82 and 84 and typically conformally contacts some or all of second coatings 84. Similar to how layer 70 conforms, on the average, to only part of each light-reflective coating 74 in light-emitting device 52 of FIGS. 4 and 5 coatings 82 and 84 in light-emitting device 80 of FIG. 7 normally extend sufficiently far down phosphor particles 72 toward faceplate 64 that layer 70 conforms, on the average, to only part of the upper surface of each coating 84.

Depending on how intensity-enhancement coatings 82 and 84 are formed, pieces (not shown) of the material that forms first coatings 82 or/and the material that forms second coatings 84 may be situated on faceplate 64 in the spaces between phosphor particles 72 of each light-emissive region 66. When present, these pieces of intensity-enhancement material are typically not significantly harmful because the forward-directed light can readily pass through them without a significant change in the small amount of light reflected along the interior surface of faceplate 64.

A layer (not shown) of the material that forms first intensity-enhancement coatings 82 may be situated on black matrix 68. A layer (not shown) of the material that forms second intensity-enhancement coatings 84 may similarly be situated over matrix 68, either directly on matrix 68 or on the layer of first intensity-enhancement material when it is present on matrix 68. The presence of either or both of these layers of intensity-enhancement material is typically not harmful and can sometimes be beneficial. When matrix 68 contains material, e.g., polymeric material such as polyimide, which emits contaminant gases when struck by electrons, the intensity-enhancement material overlying matrix 68 can be utilized as a shield to reduce the amount of these gases that enter the interior of the display. Also, this intensity-enhancement material is substantially transparent and thus does not significantly affect the light-absorption function performed by matrix 68.

Each pair of associated intensity-enhancement coatings 82 and 84 transmits a substantial fraction of normally (perpendicularly) incident visible light emitted by underlying phosphor particle 72. In a color implementation of light-emitting device 80 where the frequency bands at which particles 72 emit light differ from one light-emissive region 66 to another dependent on whether red, blue, or green light is to be produced, each pair of associated coatings 82 and 84 can strongly absorb light in certain frequency bands as long as that pair of coatings 82 and 84 strongly transmits light in the frequency band across which underlying particle 72 emits light. For manufacturing convenience, first coatings 82 preferably consist of the same material regardless of whether underlying particles 72 emit red, blue, or green light. The same applies to second coatings 84 except that the second-coating material differs from the first-coating material. Hence, coatings 82 and 84 normally transmit a substantial fraction of normally incident visible light across largely the entire visible light frequency spectrum, and thus are transparent.

The refractive index n for a medium is the ratio of the speed at which light travels in a vacuum (approximately $3\times10^8$ m/sec.) to the speed at which light travels in the medium. The interior (sealed enclosure) of the flat-panel display of FIG. 7 is approximately a vacuum. Consequently, the refractive index n, for the display's interior is approximately 1. Inasmuch as light travels slower in any non-vacuum medium than in a vacuum, the refractive index n for a non-vacuum medium is greater than 1. The speed of light in a perfect reflector is essentially zero because a perfect reflector reflects all incident light. Light-reflective layer 70, which approximates a perfect reflector, thus has a very high refractive index, effectively infinity.

The average refractive index np for phosphor particles 72 is normally 2.0–3.0, typically 2.3–2.4. The average refractive index $n_1$ for first intensity-enhancement coatings 82 is less than $n_p$ (but greater than 1). For instance, refractive index $n_1$ can be 1.5–2.2, typically 1.7–1.8, subject to being less than $n_p$. The average refractive index $n_2$ for second intensity-enhancement coatings 84 is less than $n_1$ (but likewise greater than 1). For example, refractive index $n_2$ can be 1.2–1.5, typically 1.3–1.4, subject to being less than $n_1$.

The outer surface of light-reflective layer 70 forms the interior surface of light-emitting device 80 and thus is subjected to the high vacuum in the interior of the flat-panel display. As mentioned above, layer 70 is normally perforated. Due to the perforation of layer 70 or/and the way in which device 80 is fabricated, at least part of the outer surface of each second coating 84 is subjected to the high vacuum in the display's interior where refractive index $n_1$ is approximately 1. Each phosphor particle 72 and overlying intensity-enhancement coatings 82 and 84 therefore provide a structure in which the average refractive index starts at $n_p$, typically greater than 2, for that particle 72 and then drops progressively in going through overlying coatings 82 and 84 down to approximately 1 in the substantial vacuum along at least part of the outer surface of overlying second coating 84.

By arranging for the average refractive index to decrease progressively in going from phosphor particles 72 through intensity-enhancement coatings 82 and 84 to the high vacuum at the outer surfaces of second coatings 84, more rear-directed light emitted by particles 72 escapes particles 72 and coatings 82 and 84 travelling backward, including partially sideways, than would escape particles 72 travelling backward, again including partially sideways, if coatings 82 and 84 were absent. Accordingly, an increased amount of rear-directed light, including light travelling partially sideways, in light-emitting device 80 reaches light-reflective layer 70 in such a manner as to be reflected forward and pass through light-emissive regions 66. The light intensity is enhanced generally in the forward direction, thereby enhancing the display's image intensity.

More particularly, light incident on an interface between two light-transmissive media having different refractive indices is partially reflected at the interface and partially transmitted across the interface in a refractive manner. The intensity $I_R$ of light reflection at the interface generally decreases as the difference Δn between the refractive indices of the two media is reduced. The variation of reflection intensity $I_R$ with refractive index difference Δn is non-linear in that intensity $I_R$ drops more gradually than difference Δn as difference Δn is reduced. Specifically, reflection intensity $I_R$ at the interface normally roughly follows a proportionality relationship of the form:

$$I_R \propto \left(\frac{\Delta n}{n_A + n_B}\right)^2 \quad (1)$$

where $n_A$ and $n_B$ respectively represent the refractive indices of the two media and where difference Δn is $|n_A - n_B|$.

Alternatively stated, intensity $I_R$ normally roughly follows the proportionality relationship:

$$I_R \propto \left(\frac{\Delta n}{2n_B + \Delta n}\right)^2 \quad (2)$$

for the case in which refractive index $n_B$ is less than refractive index $n_A$. As difference An drops from infinity to zero, intensity $I_R$ drops from one to zero.

Consider the hypothetical optical situation of three light-transmissive media, referred to as the first, second, and third media, in which the refractive index progressively decreases in going from the first medium through the second medium to the third medium and in which the second medium is situated between, and adjoins, the other two media. Light travelling in the first medium is partially reflected and partially transmitted at the interface between the first and second media. Ignoring any light absorption in the second medium, the partially transmitted light travelling in the second medium is partially reflected and partially transmitted at the interface between the second and third media. The first, second, and third media in this hypothetical situation are respectively analogous to each phosphor particle 72, overlying first coating 82, and associated second coating 84.

Compare this three-medium situation to a hypothetical two-medium optical situation in which the first and third media mentioned above, i.e., the media having the highest and lowest refractive indices, directly adjoin each other. Hence, the second medium is absent in the two-medium situation. Also assume that the same amount of light in the first medium travels toward the third medium in both situations. Due to the way in which the intensity of light reflection at an interface between two light-transmissive media varies with their refractive in dices as exemplified by relationship 1 or 2, the total fraction of light transmitted through both interfaces in the three-medium situation is greater than the fraction of light transmitted through the single interface (between the first and third media) in the two-medium situation. Hence, insertion of a light-transmissive medium of intermediate refractive index between two other media enables more light to be transmitted from the medium having the highest refractive index to the medium having the lowest refractive index.

With the foregoing in mind, phosphor particles 72 emit light which, directly or after one or more intermediate reflections, passes through intensity-enhancement coatings 82 and 84 moving backward, including partially sideways. Each particle 72, overlying intensity-enhancement coatings 82 and 84, and the high vacuum along the portion of that second coating 84 spaced apart from light-reflective layer 70 form a four-medium optical situation in which that particle 72 is a first medium, overlying first coating 82 is a second medium of lower refractive index, associated second coating 84 is a third medium of yet lower refractive index, and the high vacuum along the portion of that second coating 84 spaced apart from layer 70 is a fourth medium of even lower refractive index. By extrapolating the analysis of the three-medium situation to this four-medium situation, more light escapes particles 72 and coatings 82 and 84 travelling backward, including partially sideways, at locations spaced apart from where coatings 84 contact layer 70 than, in the absence of coatings 82 and 84, would escape particles 72 moving backward, again including partially sideways, at locations spaced apart from where layer 70 would then contact particles 72.

Part of the phosphor-emitted light that escapes phosphor particles 72 and intensity-enhancement coatings 82 and 84 travelling generally backward, including partially sideways, impinges on light-reflective layer 70 in such a manner, i.e., at such locations in at such directions, as to be reflected forward by layer 70 to the sides of particles 72. Since more of this rear-directed light impinges on layer 70 at locations spaced apart from where coatings 84 contact layer 70 than would impinge on layer 70 at locations spaced apart from where particles 72 would contact layer 70 in the absence of coatings 82 and 84, an increased fraction of the rear-directed light is reflected forward to the sides of particles 72 in light-emitting device 80. A large portion of the so-reflected forward-travelling light passes through faceplate 64 directly or after one or more intermediate reflections, including reflections off particles 72, to increase the overall light intensity in the forward direction. By configuring intensity-enhancement coatings 82 and 84 in the foregoing way and arranging for them to have the indicated light-transmission and refractive-index characteristics, coatings 82 and 84 enable the image intensity to be enhanced.

When, as illustrated in the example of FIG. 7, the thickness of light-emissive regions 66 is less than a monolayer so that phosphor particles 72 are not packed together as closely as possible, more space is available for phosphor-emitted rear-directed light to be reflected forward off light-reflective layer 70 and then pass through regions 66 to the sides of particles 72. The efficiency of having rear-directed light emitted by a single particle 72 be reflected forward and then pass through its region 66 without re-entering any particle(s) 72 in that region 66 is increased. Although arranging for the particle packing density to be less than the maximum particle packing density results in fewer particles 72 being present in each region 66 and thus less rear-directed light being emitted from particles 72 in each region 66, the overall amount of phosphor-emitted light that reaches faceplate 64 may sometimes be increased, especially if any of particles 72 are implemented with phosphors that absorb significant amounts of light across the frequency band(s) where those phosphors emit light.

It is typically desirable that refractive indices $n_1$ and $n_2$ of intensity-enhancement coatings 82 and 84 be chosen to largely maximize the amount of rear-directed light that escapes phosphor particles 72 and coatings 82 and 84. In this regard, let $r_p$ represent the ratio $n_p/n_1$ of refractive index $n_p$ of particles 72 to refractive index $n_1$ of first coatings 82, let $r_1$ represent the ratio $n_1/n_2$ of refractive index $n_1$ to refractive index $n_2$ of second coatings 84, and let $r_2$ represent the ratio $n_2/n_I$ of refractive index $n_2$ to refractive index $n_I$ in the high vacuum along at least part of the outer surface of each particle 84.

Utilizing relationship 1 or 2 presented above to describe reflection intensity $I_R$ at an interface between two light-transmissive media of different refractive indices, ignoring any light absorption in intensity-enhancement coatings 82 and 84, and ignoring secondary reflections in coatings 82 and 84, the maximum amount of rear-directed light escapes particles 72 and coatings 82 and 84 when each of ratios $r_p$, $r_1$, and $r_2$ is of value $r_{OPT}$ given as:

$$r_{OPT} = \left(\frac{n_P}{n_I}\right)^{1/3} \tag{3}$$

For the conditions prescribed by Eq. 3, the optimum values $n_{1OPT}$ and $n_{2OPT}$ of respective refractive indices $n_1$ and $n_2$ are:

$$n_{1OPT}=(n_p^2 n_I)^{1/3} \approx n_p^{2/3} \tag{4}$$

$$n_{2OPT}=(n_p n_I^2)^{1/3} \approx n_p^{1/3} \tag{5}$$

where the approximations utilize the fact that high-vacuum refractive index $n_I$ is approximately 1. Subject to various factors including material availability limitations, refractive indices $n_1$ and $n_2$ are preferably chosen to approach their optimum values, such as those prescribed by Eqs. 4 and 5, as closely as feasible.

Furthermore, let $\Delta n_p$ represent the difference $n_p - n_1$ between refractive index $n_p$ of phosphor particles 72 and refractive index $n_1$ of first coatings 82, let $\Delta n_1$ represent the difference $n_1 - n_2$ between refractive index $n_1$ and refractive $n_2$ of second coatings 84, and let $\Delta n_2$ represent the difference $n_2 - n_I$ between refractive index $n_2$ and refractive index $n_I$ of the high vacuum along at least part of the outer surface of each coating 84. When ratios $r_p$, $r_1$, and $r_2$ are at their optimum values given by Eq. 3, refractive-index differences $\Delta n_p$, $\Delta n_1$, and $\Delta n_2$ progressively decrease. That is, when refractive indices $n_1$ and $n_2$ of coatings 82 and 84 are chosen to largely maximize the amount of rear-directed light that escapes particle 72 and coatings 82 and 84, difference $\Delta n_p$ across the interface between each particle 72 and overlying first coating 82 is the largest of differences $\Delta n_p$, $\Delta n_1$, and $\Delta n_2$, whereas difference $\Delta n_2$ across the interface between each second coating 84 and the high vacuum along at least part of that coating 84 is the smallest of differences $\Delta n_p$, $\Delta n_1$, and $\Delta n_2$.

Intensity-enhancement coatings 82 and 84 may consist of various electrically insulating, electrically resistive, or/and electrically conductive materials which are transparent at the thicknesses of coatings 82 and 84. Suitable transparent materials for coatings 82 and 84 include the electrical insulators aluminum oxide, silicon nitride, silicon oxide, magnesium oxide, and yttrium oxide. Two or more of these electrical insulators may be employed in coatings 82 and 84 to respectively achieve desired values of refractive indices $n_1$ and $n_2$. In a typical implementation, first coatings 82 consist of yttrium oxide for which refractive index $n_1$ is 1.8–1.9. Second coatings 84 in this implementation consist of silicon oxide for which refractive index $n_2$ is 1.4–1.5.

The presence of intensity-enhancement coatings 82 and 84 causes a small loss in the energy of the impinging electrons emitted by regions 58 in electron-emitting device 50. Accordingly, coatings 82 and 84 are typically made as thin as feasible. The average thickness of first coatings 82 is normally 1–50 nm, typically 5 nm, when coatings 82 consist of yttrium oxide. The average thickness of second coatings 84 is normally 1–100 nm, typically 10 nm, when coatings 84 consist of silicon oxide.

Light-emitting device 80 can be modified in various ways. Each phosphor particle 72 can be partially covered with more than two intensity-enhancement coatings having average refractive indices which are less than that particle's average refractive index and which progressively decrease in moving away from that particle 72. In general, part of the outer surface of each particle 72 can, in accordance with the invention, be covered with m intensity-enhancement coatings where m is a plural integer. FIG. 7 then implements the case in which m is 2.

The m intensity-enhancement coatings which cover each phosphor particle 72 are, for convenience, referred to here as the first intensity-enhancement coating through the mth intensity-enhancement coating. Each first coating, corresponding to one of coatings 82 in the example of FIG. 7, is the nearest coating and thus lies directly on underlying particle 72. Each first coating conformally overlies part of the outer surface of underlying particle 72 so as to be spaced apart from where that particle 72 is closest to faceplate 64. Each mth coating, corresponding to the associated one of coatings 84 in the example of FIG. 7, is the furthest coating, i.e., the intensity-enhancement coating most remote from underlying particle 72. Letting i be an integer varying from 2 to m, each ith coating conformally overlies the associated (i−1)th coating so as to overlie part of the outer surface of underlying particle 72 and be spaced apart from where that particle 72 is closest to faceplate 64. Light-reflective layer 70 overlies the mth coatings in the manner described above for second coatings 84.

The m intensity-enhancement coatings covering each phosphor particle 72 have the basic light-transmission characteristics prescribed above for intensity-enhancement coatings 82 and 84. Each first coating in this extension of light-emitting device 80 is of lower average refractive index than underlying particle 72. Each ith coating is of lower average refractive index than the associated (i−1)th coating. The high vacuum along at least part of the outer surface of each mth coating is of lower average refractive index than that mth coating. Accordingly, the average refractive index progressively decreases in going from each particle 72 through the overlying m coatings to the high vacuum along at least part of the outer surface of that particle's mth coating.

Rear-directed light emitted by phosphor particles 72 passes through the m coatings overlying each particle 72 and is reflected off light-reflective layer 70. By an extrapolation of the reasons presented above in connection with the example of FIG. 7, more of the rear-directed phosphor-emitted light reaches layer 70 at locations spaced apart from where layer 70 contacts the mth coatings than would reach layer 70 at locations spaced apart from where layer 70 would contact particles 72 if the m coatings overlying each particle 72 were absent or, if only part of the m coatings overlying each particle 72 were absent, at locations spaced apart from where layer 70 would contact the most remote ones of those less-than-m coatings overlying each particle 72. Part of this increased amount of rear-directed light is then reflected forward off layer 72 in such a manner as to pass to the sides of particles 72 and through faceplate 64. The forward light intensity and the consequent image intensity are enhanced.

For the purpose of determining the conditions which result in approximately the maximum amount of rear-directed light escaping phosphor particles 72 and the m coatings overlying each particle 72, let $r_p$ again represent ratio $n_p/n_1$. Let $r_i$ represent the ratio $n_i/n_{i+1}$ where i is an integer varying from 1 to m−1, $n_i$ is the average refractive index of the ith coating, and $n_{i+1}$ is the average refractive index of the (i+1)th coating. Furthermore, let $r_m$ represent the ratio $n_m/n_1$ where $n_m$ is the average refractive index of the mth coating. Utilizing relationship 1 or 2 given above, ignoring any light absorption in the m coatings overlying each particle 72, and ignoring secondary reflections in those m coatings, the maximum amount of rear-directed light escapes particles 72 and the m coatings overlying each particle 72 when each of ratios $r_p$, $r_1$, $r_2$, . . . $r_m$ is of value $r_{OPT}$ given as:

$$r_{OPT} = \left(\frac{n_P}{n_I}\right)^{1/(m+1)} \tag{6}$$

Eq. 6 reduces to Eq. 3 for the specific example of FIG. 7 in which m is 2.

For the condition prescribed by Eq. 6, the optimum value $n_{iOPT}$ of refractive index $n_i$ is:

$$n_{iopt} = n_p^{(m+1-i)/(m+1)} n_1^{i/(m+1)} \approx n_p^{(M+1-i)/(m+1)} \tag{7}$$

where i here varies from 1 to m and where the approximation utilizes the fact that high-vacuum refractive index $n_1$ is approximately 1. Eq. 7 reduces to Eqs. 4 and 5 when m is 2. Refractive indices $n_1$–$n_m$ are preferably chosen to approach their optimum values, such as those prescribed by Eq. 7, as closely as possible.

In addition, let $\Delta n_p$ again represent refractive-index difference $n_p$–$n_1$. Let $\Delta n_i$ represent the refractive-index difference $n_i$–$n_{i+1}$ for i varying from 1 to m−1. Let $\Delta n_m$ represent the refractive-index difference $n_m$–$n_I$. When ratios $r_p$ and $r_1$–$r_m$ are at their optimum values given by Eq. 7, refractive-index differences $\Delta n_p$ and $\Delta n_1$–$\Delta n_m$ progressively decrease so that difference $\Delta n_p$ is the largest and difference $\Delta n_m$ is the smallest.

Figure 8:
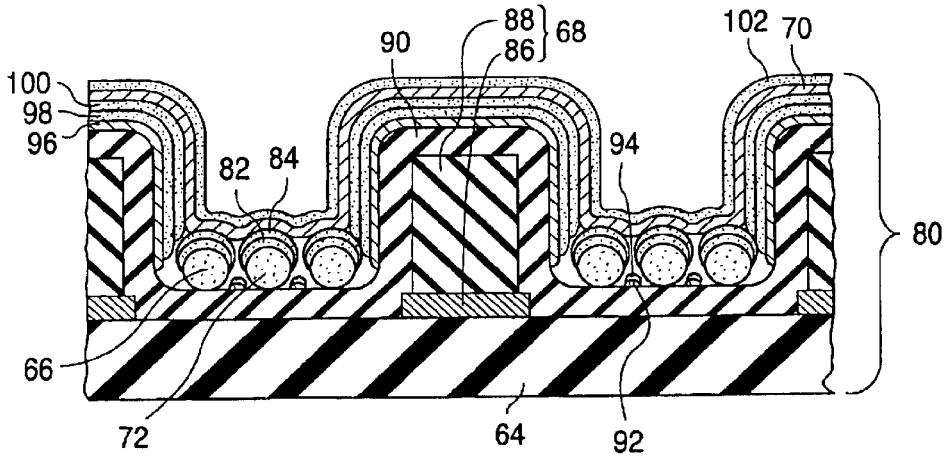
FIG. 8 is a cross-sectional side view of part of the active portion of an implementation of the light-emitting device of FIG. 7.

FIG. 8 depicts a side cross section of part of the active portion of an implementation of light-emitting device 80 in accordance with the invention. Except as described below, device 80 in the implementation of FIG. 8 contains components 64, 66, 68, 70, 72, 82, and 84 configured, constituted, and functioning the same as in device 80 of FIG. 7. The thickness of regions 66 is thus illustrated as being less than a monolayer in device 80 of FIG. 8 but can, as in device 80 of FIG. 7, be greater than a monolayer. In the implementation of FIG. 8, faceplate 64 typically consists of a glass plate (not separately shown) and a thin transparent dielectric layer (likewise not separately shown), typically silicon oxide or silicon nitride, situated on the plate's upper surface for reducing oxygen outgassing from faceplate 64 due to electron bombardment.

Black matrix 68 in FIG. 8 consists of a patterned lower black layer 86 and a patterned upper layer 88. Lower layer 86, which lies directly on faceplate 64, provides matrix 68 with its black characteristic as seen through faceplate 64. For this purpose, layer 86 is formed with hard black material, such as a composite of black chromium oxide and chromium, having a thickness of 100–500 nm, typically 300 nm. Layer 86 can be replaced with a layer of black polymeric material, such as blackened polyamide, and an overlying adhesion layer consisting of hard material such as chromium or/and chromium oxide which need not be black.

Upper layer 88, which lies on lower layer 86, provides black matrix 68 with the vast majority of its height. Spacers, represented by spacer wall 54 in FIG. 5, contact material overlying layer 88. The thickness of layer 88 is 30–50 nm, typically 40 nm. Layer 88 typically consists of polymeric material, such as polyamide, which is typically not blackened but can be blackened.

An optional protective (or isolation) layer 90 is situated on black matrix 68 and extends substantially all the way down its sidewalls. The combination of faceplate 64 and protective layer 90 encapsulates matrix 68. When electrons emitted by regions 58 strike light-emitting device 80, the polymeric material which typically forms upper layer 88 of matrix 68 can emit contaminant gases. Protective layer 90 slows the entry of these gases into the interior of the display. Further details on protective layers such as layer 90 are presented in Haven et al, U.S. patent application Ser. No. 09/087,785, filed 29 May 1998, now U.S. Pat. No. 6,215,241, and in Curtin et al, U.S. patent application Ser. No. 09/698,696, filed 27 Oct. 2000.

FIG. 8 illustrates an example in which protective layer 90 extends over faceplate 64 at the bottoms of the black-matrix openings that contain light-emissive regions 66. Layer 90 then consists of material transmissive of visible light. This material is typically an electrical insulator such as silicon oxide, silicon nitride, or/and aluminum oxide. Alternatively, layer 90 can block, i.e., absorb or/and reflect, visible light. In that case, portions of layer 90 are removed at the bottoms of the black-matrix openings.

Pieces 92 of the material that forms first intensity-enhancement coatings 82 are depicted as being situated on protective layer 90 at the bottoms of the black-matrix openings at locations below the spaces between phosphor particles 72 of each light-emissive region 66 in the example of FIG. 8. Pieces 94 of the material that forms second intensity-enhancement coatings 84 are similarly illustrated as being situated on pieces 92. Depending on how coatings 82 and 84 are created, pieces 92 of the first intensity-enhancement material and/or pieces 94 of the second intensity-enhancement material may not be present in light-emitting device 80.

An optional electrically non-insulating charge-removal layer 96 is situated on protective layer 90 above black matrix 68 and extends partway down layer 90 into the black-matrix openings so as to be in very close proximity to phosphor particles 72 of each light-emissive region 66. In the example of FIG. 8, charge-removal layer 96 extends at least partway down the average height of particles 72. During display operation, excess negative charge that accumulates on particles 72 as a result of being struck by electrons is removed by layer 96. Layer 96 normally consists of electrically conductive material, such as aluminum, having a thickness of 0.1–2.0 $\mu$m, typically 0.8 $\mu$m.

A layer 98 of the first intensity-enhancement material lies on non-insulating layer 96. A layer 100 of the second intensity-enhancement material lies on layer 98 of the first intensity-enhancement material. Light-reflective layer 70 is situated on layer 100 of the second intensity-enhancement material and extends over second intensity-enhancement coatings 84 in the manner described above.

An additional layer 102 lies on light-reflective layer 70 and extends fully across the active portion of light-emitting device 80 in the example of FIG. 8. When layer 70 consists of aluminum, additional layer 102 overlies the thin native layer (not separately indicated) of aluminum oxide which forms along the upper surface of layer 70 when device 80 is exposed to air. Additional layer 102 can also replace the native aluminum oxide layer. Compared to the native aluminum oxide layer, additional layer 102 provides one or more, preferably all, of (a) reduced chemical reactivity, (b) reduced secondary electron emission per unit area, and (c) reduced electron backscattering per unit area. Layer 102 typically consists of chromium oxide or/and chromium having a thickness of 1–50 nm, typically 10 nm.

In conjunction with having reduced chemical reactivity compared to the native aluminum oxide layer, layer 102 has a lower gas-sticking coefficient than the native oxide layer.

Consequently, the likelihood of contaminant gases adhering to the interior surface of the active portion of light-emitting device 80 is reduced compared to what would occur if the interior surface of the active portion were formed with the native aluminum oxide layer. Further details on layers such as additional layer 102 are presented in Cummings et al, co-filed U.S. patent application Ser. No. 09/823,872. now U.S. Pat. No. 6,630,786 B2.

Light-emitting device 80 in the implementation of FIG. 8 normally also includes a thin peripheral electrode (not shown) situated outside the active portion of device 80. The peripheral electrode consists of electrically non-insulating material, specifically electrically conductive material such as aluminum or an aluminum alloy. The peripheral electrode contacts both light-reflective layer 70 and charge-removal layer 96 so as to provide them with the display's anode potential and to provide access to layers 70 and 96 for removing charge.

The implementation of FIG. 8 can be modified to have more than two intensity-enhancement coatings situated above part of the outer surface of each phosphor particle 72 in the manner described above in connection with FIG. 7.

Figure 9A:
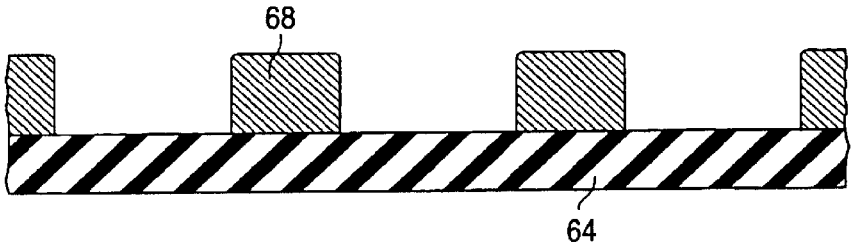
FIGS. 9*a*–9*e* are cross-sectional side views representing steps in fabricating the general light-emitting device of FIG. 7 according to the invention starting from the stage of FIG. 6*b*.
Figure 9B:
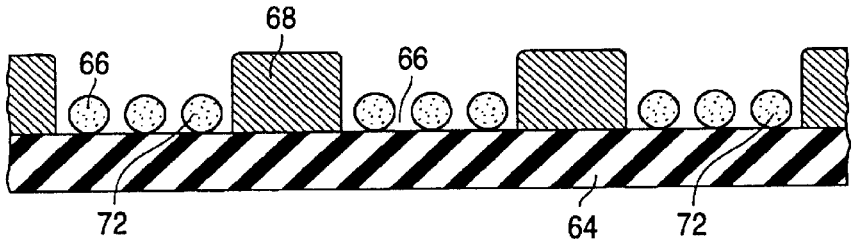
Figure 9C:
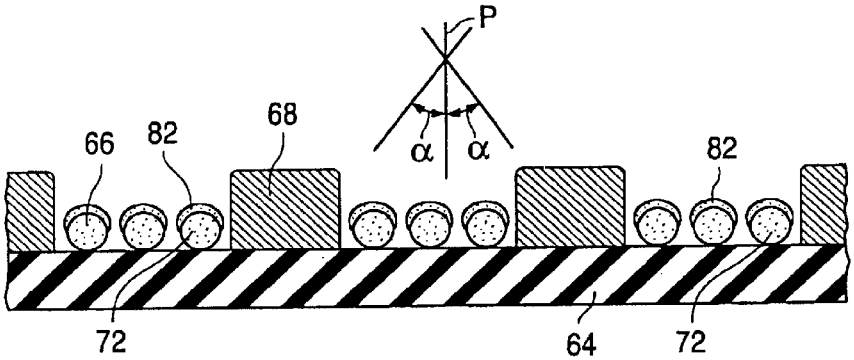

FIGS. 9*a*–9*e* (collectively "FIG. 9") illustrate a general process for manufacturing light-emissive device 80 of FIG. 7 in accordance with the invention starting from the stage of FIG. 6*b* in the process of FIG. 6. See FIG. 9*a* which repeats FIG. 6*b*. Phosphor particles 72 are introduced into the openings in black matrix 68 to form light-emissive regions 66 as shown in FIG. 9*b*. The introduction of particles 72 into the black matrix openings is performed in the same way as in the process of FIG. 6 except that, in the example of FIG. 9*b*, the thickness of regions 66 is illustrated as being less than a monolayer.

Figure 9D:
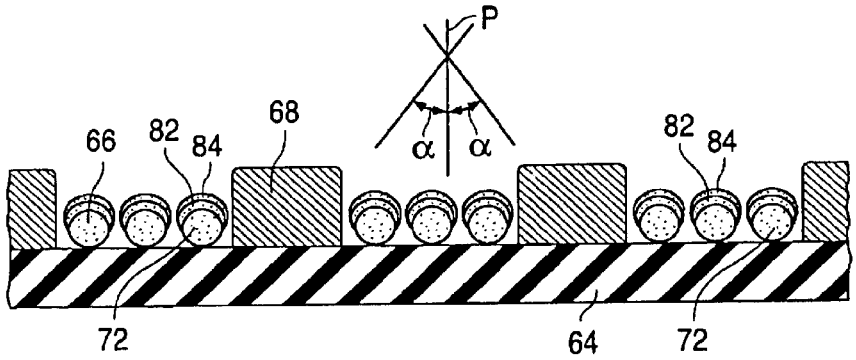

First intensity-enhancement coatings 82 are formed by providing the desired first intensity-enhancement material on parts of the outer surfaces of phosphor particles 72 at locations spaced apart from where particles 72 are closest to faceplate 64. See FIG. 9*c*. Second intensity-enhancement coatings 84 are subsequently formed by providing the desired second intensity-enhancement material on first coatings 82 above parts of the outer surfaces of particles 72 in such a way that second coatings 84 are spaced apart from where particles 72 are closest to faceplate 64 as indicated in FIG. 9*d*.

Subject to any differences that may arise because the material of light-reflective coatings 74 in light-emissive device 52 fabricated according to the process of FIG. 6 differs from the first intensity-enhancement material, first intensity-enhancement coatings 82 are typically formed in a high-vacuum environment according to any of the techniques utilized for creating coatings 74 in the process of FIG. 6. These techniques include sputtering, evaporation, thermal spraying, and electrophoretic/dielectrophoretic deposition. The same applies to deposition of the second intensity-enhancement material for creating second coatings 84. Coatings 82 and 84 can also be formed by CVD or sol gel deposition.

Depending on the thickness of light-emissive regions 66 and on how intensity-enhancement coatings 82 and 84 are formed, pieces (not shown) of the first or/and second intensity-enhancement material may accumulate over faceplate 64 in the spaces between phosphor particles 72 of each light-emissive region 66 during the deposition of the first or/and second intensity-enhancement material. Any of the measures used to prevent pieces of the light-reflective material from accumulating on faceplate 64 in the spaces between particles 72 of each region 66 during the formation of light-reflective coatings 74 in the process of FIG. 6 can, if desired, be employed here to prevent pieces of the first or/and second intensity-enhancement material from similarly accumulating on faceplate 64 or to prevent pieces of the second intensity-enhancement material from accumulating on pieces of the first intensity-enhancement material in the spaces between particles 72 of each region 66.

In cases where sputtering, evaporation, or thermal spraying is utilized to form first coatings 82 or/and second coatings 84, deposition of the first or/and second intensity-enhancement material can be in performed in an angled manner at non-zero tilt angle $\alpha$ to a line extending generally perpendicular to faceplate 64. Item P in FIGS. 9*c* and 9*d* indicates such a line. The value of tilt angle $\alpha$, usually 5–45°, typically 15–20°, is normally sufficiently large that phosphor particles 72 and any overlying material, e.g., first coatings 82 during the formation of second coatings 84, serve as shields to substantially prevent any of the first or/and second intensity-enhancement material from accumulating over faceplate 64 in the spaces between particles 72 of each light-emissive region 66.

During the formation of first coatings 82, a layer (not shown) of the first intensity-enhancement material normally forms on top of black matrix 68 and, at least in the case of angled deposition such as angled sputtering, evaporation, or thermal spraying, on the sidewalls of matrix 68. During the formation of second coatings 84, a layer (likewise not shown) of the second intensity-enhancement material similarly normally forms on the parts of the layer of first intensity-enhancement material overlying the top of matrix 68 and, at least in the case of angled deposition, on the parts of the layer of first intensity-enhancement material covering the sidewalls of matrix 68. If desired, any of the techniques used for preventing a layer of light-reflective material from forming on matrix 68 during the formation of light-reflective coatings 74 in the process of FIG. 6 can generally be employed here to prevent a layer of either intensity-enhancement material from forming on matrix 68 or to prevent a layer of the second intensity-enhancement material from forming on a layer of the first intensity-enhancement material formed on matrix 68.

Light-reflective layer 70 is subsequently formed over black matrix 68 and second coatings 84 in generally the same way that layer 70 is formed over matrix 68 and light-reflective coatings 74 in the process of FIG. 6. See FIG. 9*e*. Specifically, intermediate layers (not shown) of generally solid material which can readily be converted to gas are formed in the black-matrix openings so as to just cover, or nearly cover, intensity-enhancement coatings 84 and 82 and phosphor particles 72 in those openings. The intermediate layers can again be created by depositing lacquer into the black-matrix openings and drying the lacquer. Any of the techniques utilized in the process of FIG. 6 to prevent lacquer from accumulating on top of matrix 68, or on any material situated on top of matrix 68, can be utilized for the same purpose here.

Figure 9E:
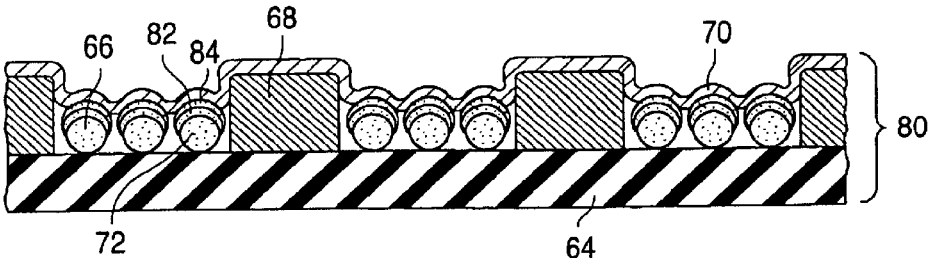

With the lacquer deposition complete, light-reflective layer 70 is created by depositing the desired light-reflective material on the intermediate lacquer layers. The structure is heated to convert the intermediate layers into gas which escapes through the perforations in layer 70, thereby removing the intermediate layers. The structure of FIG. 9*e* is light-emitting device 80 of FIG. 7.

For the general situation in which part of the outer surface of each phosphor particle 72 is covered with m intensity-enhancement coatings of progressively decreasing refractive index configured so that each coating is spaced apart from where that particle 72 is closest to faceplate 64, the process description of FIG. 9 covers the case in which m is 2. In cases where m is greater than 2, each ith intensity-enhancement coating, where integer i varies from 3 to m, is formed on the associated (i–1)th intensity-enhancement coating by depositing a suitable ith intensity-enhancement material in any of the ways described above for depositing the second intensity-enhancement material to form each second intensity-enhancement coating 84 on associated first intensity-enhancement coating 82 in the process of FIG. 9. Depending on how the deposition of the ith intensity-enhancement material is performed, pieces of the ith intensity-enhancement material may, or may not, accumulate on faceplate 64 in the spaces between particles 72 of each light-emissive region 66 or on other intensity-enhancement material situated on the upper surface of faceplate 64.

With i still varying from 3 to m, a layer of the ith intensity-enhancement material normally forms on part of the layer of the (i–1)th intensity-enhancement material overlying the top of black matrix 68 and, at least in the case of angled deposition, on part of the layer of (i–1)th intensity-enhancement material covering the sidewalls of matrix 68. The layer of ith intensity-enhancement material overlying matrix 68 may be beneficial for the same reasons that the layer of second intensity-enhancement material overlying matrix 68 is typically beneficial. The formation of the layer of ith intensity-enhancement material on matrix 68, or on earlier-deposited intensity-enhancement material deposited on matrix 68, can be avoided in any of the ways prescribed above for preventing a layer of the light-reflective material from forming on matrix 68 during the formation of light-reflective coatings 74 in the process of FIG. 6. In any event, light-reflective layer 70 is formed over matrix 68, including over any intensity-enhancement material overlying matrix 68, and over the mth intensity-enhancement coatings in the same manner that layer 70 is formed over matrix 68, including over any overlying intensity-enhancement material, and over second intensity-enhancement coatings 84 in the process of FIG. 9.

FIGS. 10*a*–10*j* (collectively "FIG. 10") depict a process in accordance with the invention for manufacturing the implementation of light-emitting device 80 in FIG. 8. The starting point for the process of FIG. 10 is faceplate 64. See FIG. 10*a*. Faceplate 64 is typically created by furnishing the upper surface of a glass plate (not separately shown) with a thin transparent layer (likewise not separately shown) of dielectric material.

Figure 10A:
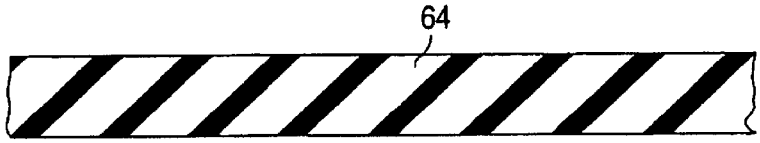
FIGS. 10*a*–10*j* are cross-sectional side views representing steps in fabricating the implementation of FIG. 8 according to the invention.
Figure 10B:
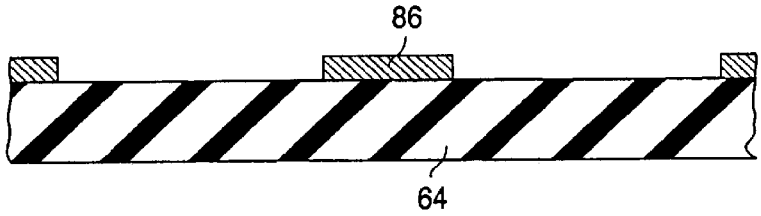
Figure 10C:
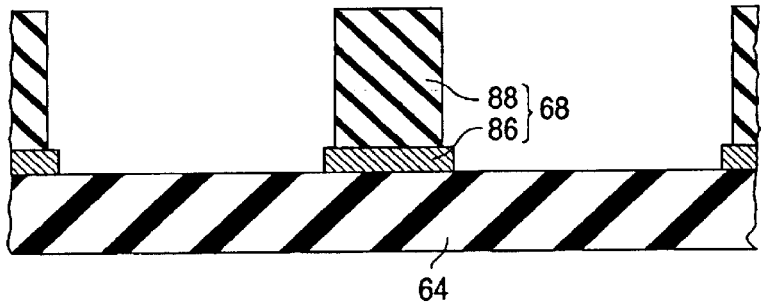

Black layer 86 of black matrix 68 is formed on faceplate 64 as shown in FIG. 10*b*. The formation of layer 86 is performed by first providing, on faceplate 64, a blanket layer of the desired hard black material of layer 86. Depending on the composition of the blanket hard black layer, it can, for example, be formed by a deposition procedure or by a deposition/oxidation procedure. Using a suitable photoresist mask (not shown), portions of the blanket hard black layer are selectively removed to produce layer 86.

The above-mentioned peripheral electrode (not shown) is now formed outside the region intended to be the active portion of light-emitting device 80. The peripheral electrode can be screen printed or deposited through a shadow mask. Alternatively, a blanket layer of the peripheral electrode material can be deposited over the structure after which the peripheral electrode material is removed from the active device portion using a suitable mask, such as a photoresist mask.

Upper layer 88 of black matrix 68 is formed on lower layer 86 to complete the black-matrix formation. See FIG. 10*c*. The formation of upper layer 88 is conducted by first providing a blanket layer of a suitable actinic polymeric material along the upper surface of the structure. This typically entails depositing the actinic polymeric material and appropriately baking it. The polymeric material is selectively exposed to suitable actinic radiation, e.g., UV light, after which the exposed or unexposed polymeric material is removed depending on whether the polymeric material is positive or negative tone. The remaining polymeric material is baked and cured to produce layer 88.

Figure 10D:
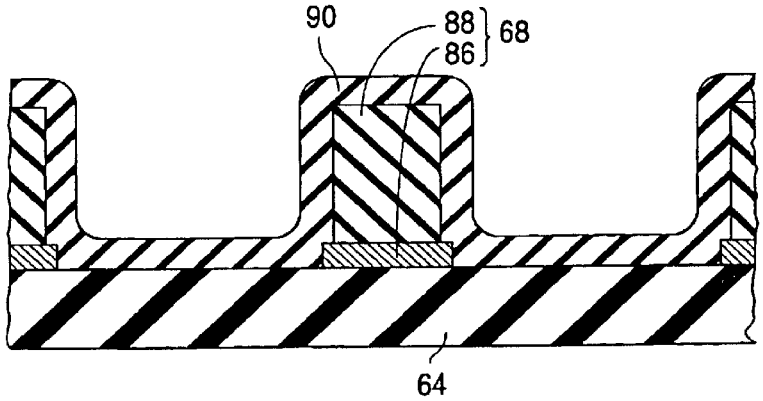
Figure 10E:
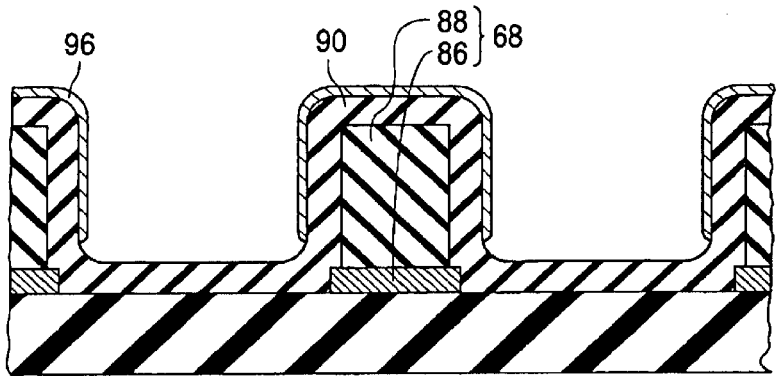

Protective layer 90, when present, is deposited on black matrix 68 and into the black-matrix openings as indicated in FIG. 10*d*. A shadow mask is utilized in the peripheral device area to prevent the material of layer 90 from accumulating on the peripheral electrode.

Non-insulating charge-removal layer 96, when present, is deposited on top of the structure, i.e., on protective layer 90 when it is present, using an angled deposition technique, typically angled evaporation. See FIG. 10*e*. Angled sputtering or angled thermal spraying can also be utilized to form charge-removal layer 96. The angled deposition is performed at a suitable tilt angle to a line extending approximately perpendicular to faceplate 64. The tilt angle is sufficiently great that layer 96 is formed on top of protective layer 90 and extends partway down into the black-matrix openings. A shadow mask is employed to prevent the charge-removal material of layer 96 from accumulating in the peripheral area of the partially fabricated light-emitting device.

Figure 10F:
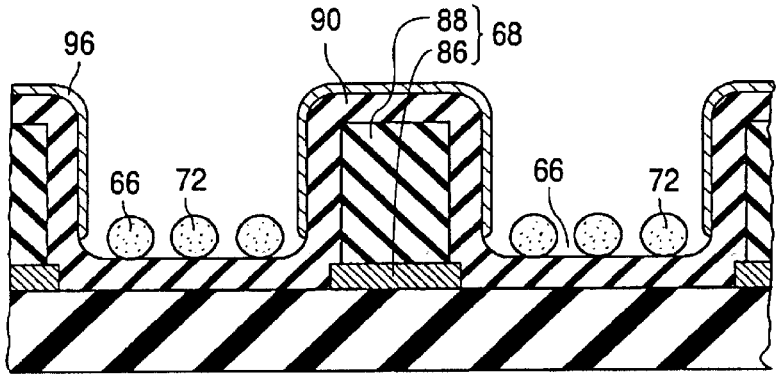
Figure 10G:
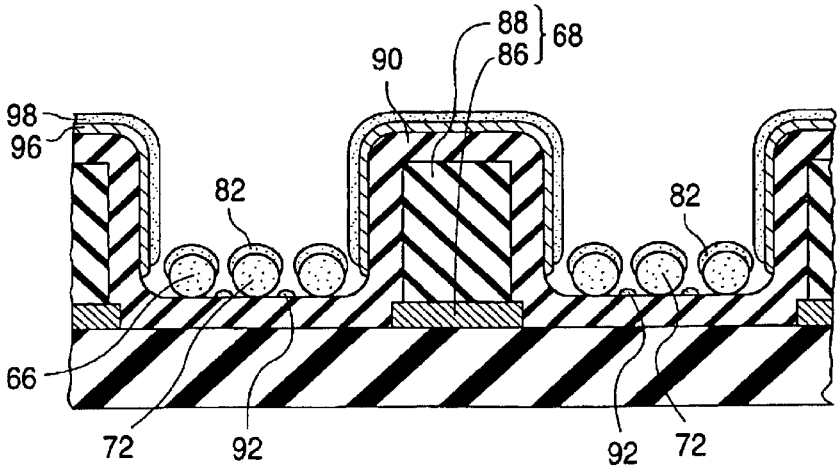
Figure 10H:
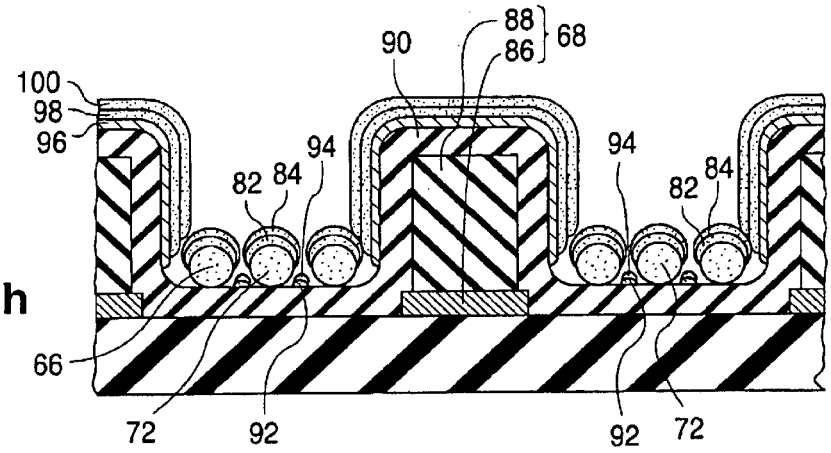
Figure 10I:
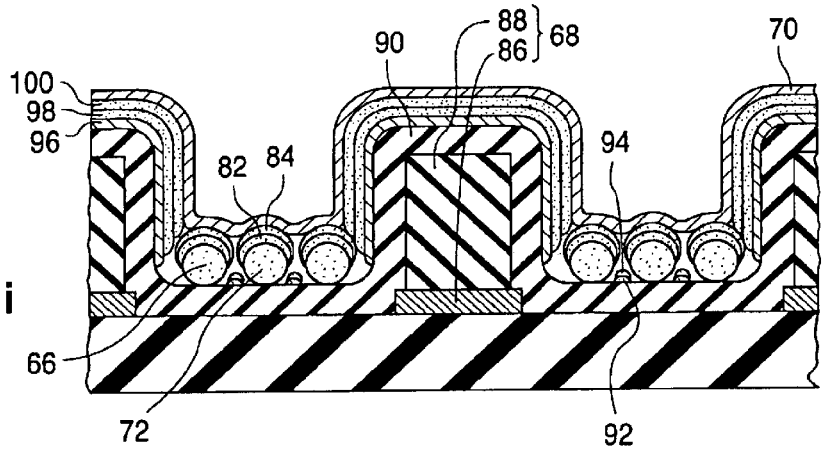

Next, phosphor particles 72 are provided in the black-matrix openings, as covered with protective layer 90, to form light-emissive regions 66 as shown in FIG. 10*f*. The formation of regions 66 is conducted as described above for the process of FIG. 9. The removal of the cured binder material in the black-matrix openings is preferably done by (a) subjecting the binder material to a plasma, typically an oxygen-containing plasma, at low temperature, typically 150°, and low pressure, typically less than 1 torr, (b) heating the structure in a high vacuum, typically for 2 hrs. at 400–450° C., and (c) repeating the plasma step. Organic residues in particles 72 are converted to gas during the binder removal and thereby removed from particles 72.

First intensity-enhancement coatings 82 are deposited on phosphor particles 72 in the manner described above for the process of FIG. 9. See FIG. 10*g*. During the formation of coatings 82, layer 98 of the first intensity-enhancement material forms on charge-removal layer 96 above black matrix 68. Pieces 92 of the first intensity-enhancement material may simultaneously accumulate on protective layer 90 above faceplate 64 in the spaces between particles 72 of each light-emissive region 66. The accumulation of pieces 92 of the first intensity-enhancement material on protective layer 90 in the spaces between particles 72 of each region 66 can be avoided as described above.

Second intensity-enhancement coatings 84 are deposited on first intensity-enhancement coatings 82 in the manner described above for the process of FIG. 9. See FIG. 10*h*. During the formation of coatings 84, layer 100 of the second intensity-enhancement material is formed on layer 98 of the first intensity-enhancement material. Pieces 94 of the second intensity-enhancement material may simultaneously accumulate on pieces 92 of the first intensity-enhancement material or on protective layer 90 above faceplate 64 in the spaces between phosphor particles 72 of each light-emissive region 66. The accumulation of pieces 94 of the second intensity-enhancement material of such locations can be avoided as described above.

Figure 10J:
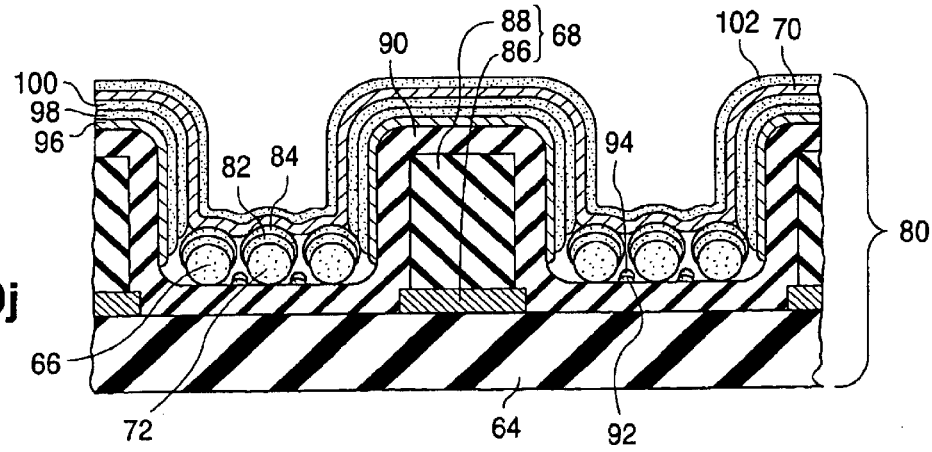

Light-reflective layer 70 is formed over second intensity-enhancement coatings 84 and over layer 100 of the second intensity-enhancement material in the manner described above for creating layer 70 over coatings 84 and black matrix 68 in the process of FIG. 9. See FIG. 10*i*. Finally, additional layer 102 is deposited on light-reflective layer 70 as indicated in FIG. 10*j*. The deposition of additional layer 102 is typically done by sputtering but can be done by evaporation or thermal spraying. The structure of FIG. 10*j* is the implementation of light-emitting device 80 in FIG. 8.

Intensity-enhancement and Contrast-enhancement Coatings

Figure 11:
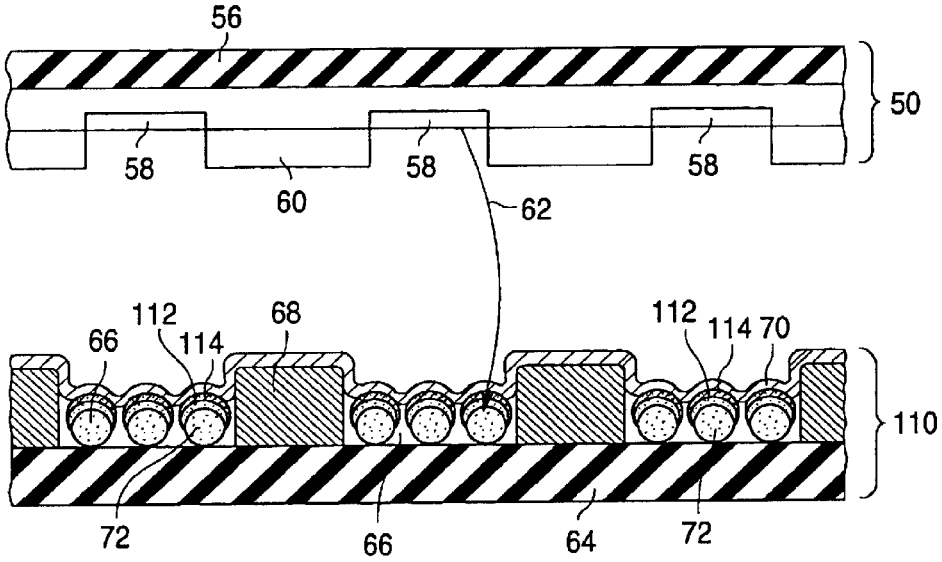
FIG. 11 is a cross-sectional side view of part of the active region of a further flat-panel CRT display having a light-emitting device configured according to the invention.

FIG. 11 illustrates a side cross section of part of the active region of a flat-panel CRT display having electron-emitting device 50, again configured as described above, and an oppositely situated light-emitting device 110 configured according to the invention for enhancing the image intensity and the optical contrast of the display. Devices 50 and 110 connected together through an outer wall (not shown) to form a sealed enclosure maintained at a high vacuum, once again typically an internal pressure of no more than 10–6 torr. As viewed along a plane extending laterally through the sealed enclosure, the active portion of light-emitting device 110 has a plan view largely identical to that of FIG. 5. The display of FIG. 11 typically includes spacers, again represented by exemplary spacer wall 54 in FIG. 5, situated between devices 50 and 110, and may have getter material located at various places in the display.

Light-emitting device 110 contains components 64, 66, 68, and 70 configured, constituted, and functioning the same as in light-emitting device 80 of FIG. 7. Each light-emissive region 66 is thereby formed with generally randomly located light-emissive phosphor particles 72. Although the thickness of regions 66 is, for example, illustrated as being less than a monolayer in device 110 of FIG. 11, the thickness of regions 66 can as well be greater than a monolayer, again typically 1.5 monolayers and up to 3 monolayers or more. Black matrix 68 is again depicted as being thicker than regions 66 but can be thinner than regions 66.

Part of the outer surface of each of certain phosphor particles 72 in light-emitting device 110 is, in accordance with the invention, covered with an intensity-enhancement coating 112 and a contrast-enhancement coating 114. Specifically, each intensity-enhancement coating 112 conformally covers part of the outer surface of underlying particle 72 so as to be spaced apart from where that particle 72 is closest to faceplate 64. Each contrast-enhancement coating 114 conformally overlies associated intensity-enhancement coating 112 so as to overlie part of the outer surface of underlying particle 72 and likewise be spaced apart from where that particle 72 is closest to faceplate 64. Contrast-enhancement coatings 114 of each light-emissive region 66 form a discontinuous contrast-enhancement layer for that region 66.

FIG. 11 illustrates the situation in which, because the thickness of light-emissive regions 66 is illustrated as being less than a monolayer, each phosphor particle 72 is a coated particle. As was said above about light-emitting device 80 in the example of FIG. 7, some of particles 72 in light-emitting device 110 of FIG. 11 may be uncoated when the thickness of regions 66 is greater than a monolayer. Likewise, whether there are any uncoated particles 72 in device 110 depends on factors such as the thickness of regions 66 in monolayers and how intensity-enhancement coatings 112 and contrast-enhancement coatings 114 are formed.

As explained further below, the optical contrast of the image presented on the display's viewing area at the exterior surface of faceplate 64 is enhanced as a result of the positioning and characteristics of contrast-enhancement coatings 114. However, coatings 114 do not themselves directly enhance the optical contrast. Hence, the term "contrast-enhancement" when used here as an adjective for coatings 114, and for any other such "contrast-enhancement" coatings, is intended to indicate the function attained with such coatings but is not intended to mean that such coatings actually enhance the optical contrast.

Intensity-enhancement coatings 112 are positioned similarly to first intensity-enhancement coatings 82 of light-emitting device 80 and, as described further below, provide an intensity-enhancement function very similar to that furnished by coatings 82 and 84 of device 80. Coatings 112 can partially conformally cover various portions of the outer surfaces of coated particles 72 depending on how coatings 112 are formed. Although intensity-enhancement coatings 112 in light-emitting device 110 are shown as largely covering the upper halves of phosphor particles 72 in FIG. 11, coatings 112 can extend over the lower halves of particles 72 provided that coatings 112 do not contact faceplate 64. As with coatings 82, coatings 112, can also cover less than the upper halves of particles 72.

Contrast-enhancement coatings 114 are positioned in a similar manner to second intensity-enhancement coatings 84 of light-emitting device 80 but provide a materially different function. In the example of FIG. 11, each contrast-enhancement coating 114 covers largely all of associated intensity-enhancement coating 112. Alternatively, each contrast-enhancement coating 114 can cover only part of associated intensity-enhancement coating 112. Contrast-enhancement coatings 114 can even extend beyond intensity-enhancement coatings 112 so as to contact phosphor particles 72 provided that contrast-enhancement coatings 114 do not contact faceplate 64.

FIG. 11 illustrates each contrast-enhancement coating 114 as being continuous and non-perforated. However, each coating 114 normally consists of multiple contrast-enhancement portions spaced apart from one another. Hence, each coating 114 normally covers only part of associated intensity-enhancement coating 112.

Light-reflective layer 70 overlies intensity-enhancement coatings 112 and contrast-enhancement coatings 114. Layer 70 typically contacts some or all of contrast-enhancement coatings 114. Because each coating 114 normally covers only part of associated intensity-enhancement coating 112, layer 70 also typically contacts some or all of coatings 112. Coatings 112 and 114 normally extend sufficiently far down phosphor particles 72 toward faceplate 64 that layer 70 conforms, on the average, to only part of the composite outer surface of each intensity-enhancement coating 112 and associated contrast-enhancement coating 114. Due to the perforations normally present in layer 70 or/and how light-emitting device 110 is manufactured, at least part of the outer surface of each coating 112 or 114 is subjected to the high vacuum in the interior of the display.

Depending on how intensity-enhancement coatings 112 are formed, pieces (not shown) of the intensity-enhancement material may be situated on faceplate 64 in the spaces between phosphor particles 72 of each light-emissive region 66. When present, these pieces of the intensity-enhancement material are typically not significantly harmful for the reasons presented above in connection with the similar pieces of intensity-enhancement material that may be present on faceplate 64 in the spaces between particles 72 of each region 66 in light-emitting device 80.

Pieces (not shown) of the contrast-enhancement material may sometimes be situated on the upper surface of faceplate 64 in the spaces between phosphor particles 72 of each light-emissive region 66, or on pieces of the intensity-enhancement material situated on the upper surface of faceplate 64. The presence of such pieces of the contrast-enhancement material at these locations may, or may not, be beneficial. If the presence of pieces of the contrast-enhancement material at these locations would be disadvantageous, the formation of contrast-enhancement coatings 114 can, as discussed further below, be performed in such a way as to avoid forming pieces of the contrast-enhancement material at the preceding locations.

A layer (now shown) of the intensity-enhancement material may be situated on black matrix 68. A layer (not shown) of the contrast-enhancement material may similarly be situated over matrix 68, either directly on matrix 68 or on the layer of intensity-enhancement material when it is present. The presence of the layer of intensity-enhancement material or/and the layer of contrast-enhancement material is typically not harmful and can sometimes be beneficial. When matrix 68 contains material that emits contaminant gases upon being struck by electrons, either or both these layers can serve as a shield to reduce the amount of these gases that enter the display's interior. The layer of contrast-enhancement material can also enhance the light-absorption function of underlying matrix 68.

The average refractive index $n_E$ for intensity-enhancement coatings 112 is less than np but greater than 1 where $n_p$ is again the average refractive index for phosphor particles 72. With refractive index $n_P$ again being 2.0–3.0, typically 2.3–2.4, refractive index $n_E$ is normally 1.4–1.8, typically 1.5–1.6, subject to being less than $n_p$. Inasmuch as one or more parts of each coating 112 are normally subjected to the high vacuum in the interior of the flat-panel display, each particle 72 and overlying coating 112 normally form a structure in which the average refractive index drops progressively from $n_P$, typically greater than 2, for that particle 72 down to $n_P$ for overlying coating 112 and then down to approximately 1 in the high vacuum along part(s) of the outer surface of overlying coating 112.

For the reasons presented above in connection with intensity-enhancement coatings 82 and 84 of light-emitting device 80 of FIG. 7, more rear-directed light emitted by phosphor particles 72 normally escapes particles 72 and intensity-enhancement coatings 112 traveling backward, including partially sideways, at locations spaced apart from where coatings 112 come closest to light-reflective layer 70 than, in the absence of coatings 112 (but with contrast-enhancement coatings 114 still present and thereby lying directly on particles 72), would escape particles 72 moving backward, again including partially sideways, at locations spaced apart from where layer 70 would then come closest to particles 72. Part of the increased amount of phosphor-emitted rear-directed light that escapes particles 72 and coatings 112 impinges on layer 70 in such a way as to be reflected forward by layer 70 to the sides of particles 72. A large portion of the so-reflected forward-traveling light passes through faceplate 64 directly or after one or more intermediate reflections, including reflections off particles 72. Compared to what would happen if coatings 112 were absent (but with contrast-enhancement coatings 114 still present), the forward light intensity and consequent image intensity are normally enhanced.

Contrast-enhancement coatings 114 are quite dark, preferably largely black, as seen through faceplate 64 from the front of the display, i.e., from opposite light-emissive regions 66. As such, coatings 114 strongly absorb ambient light which impinges on the front of the display at the exterior surface of faceplate 64, passes through faceplate 64, and then passes through phosphor particles 72 and intensity-enhancement coatings 112 to reach contrast-enhancement coatings 114. By strongly absorbing ambient light, coatings 114 improve the optical contrast for each light-emissive region 66. That is, the optical contrast is improved between times when each region 66 is turned on (emitting light) and times when that region 66 is turned off (not emitting light). Accordingly, coatings 114 improve the optical contrast between two such regions 66, especially two adjacent regions 66, during time periods in which one is turned on and the other is turned off.

Contrast-enhancement coatings 114 also absorb some of the phosphor-emitted rear-directed light which escapes phosphor particles 72 and intensity-enhancement coatings 112 and which might otherwise be reflected forward to the sides of particles 72 for improving the forward light intensity. Hence, the forward light intensity is not as high as it would be in the absence of contrast-enhancement coatings 114. Since coatings 114 enable the optical contrast of the display's image to be improved, the combination of coatings 112 and 114 allows the overall visibility of the image to be enhanced as determined by a composite of image contrast and image intensity.

Intensity-enhancement coatings 112 may consist of various electrically insulating, electrically resistive, or/and electrically conductive materials which are transparent at the thickness of coatings 112. As with intensity-enhancement coatings 82 and 84, suitable transparent materials for coatings 112 include the electrical insulators aluminum oxide, silicon nitride, silicon oxide, magnesium oxide, and yttrium oxide. Two or more of these electrical insulators may be employed in coatings 112 to achieve a desired value of refractive index $n_E$. In a typical implementation, coatings 112 consist of silicon oxide for which refractive index $n_E$ is 1.4–1.5.

Contrast-enhancement coatings 114 may consist of various electrically insulating, electrically resistive, or/and electrically conductive materials which are opaque and very dark, preferably black, at the thickness of coatings 114. Dark opaque metal oxides and metal nitrides are suitable for coatings 114. Suitable dark opaque metal oxides include chromium oxide and titanium oxide. Taking note of the fact that cermet consists of ceramic with embedded metal particles, dark opaque cermet is also suitable for coatings 114.

The presence of intensity-enhancement coatings 112 and contrast-enhancement coatings 114 causes a small loss in the energy of electrons which are emitted by regions 58 in electron-emitting device 50 and impinge on phosphor particles 72. Accordingly, coatings 112 and 114 are typically made as thin as feasible. The average thickness of intensity-enhancement coatings 112 is 1–150 nm, typically 15 nm. The average thickness of contrast-enhancement coatings 114 is 1–50 nm, typically 5 nm.

Light-emitting device 110 can be modified in various ways. Contrast-enhancement coatings 114 overlying phosphor particles 72 in each light-emissive region 66 can be converted into a continuous contrast-enhancement layer for that region 66. This continuous contrast-enhancement layer may, or may not, be perforated, e.g., at locations above the spaces between particles 72 of each region 66. The continuous contrast-enhancement layer may contact intensity-enhancement coatings 112 and particles 72 over less surface area than do separate coatings 114.

Figure 12:
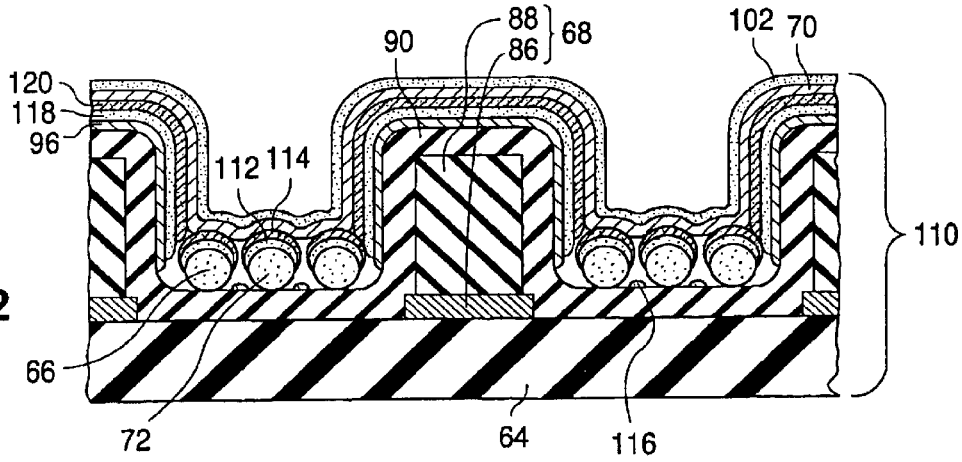
FIG. 12 is a cross-sectional side view of part of the active portion of an implementation of the light-emitting device of FIG. 11.

FIG. 12 depicts a side cross section of part of the active portion of an implementation of light-emitting device 110 in accordance with the invention. Except as described below, device 110 of FIG. 12 contains components 64, 66, 68, 70, 72, 112, and 114 configured, constituted, and functioning the same as in device 110 of FIG. 11. Hence, the thickness of light-emissive regions 66 in device 110 of FIG. 12 is illustrated as being less than a monolayer but can be greater than a monolayer. Except as described below, device 110 of FIG. 12 also contains components 86, 88, 90, 96, and 102 configured, constituted, and functioning the same as in the implementation of light-emitting device 80 of FIG. 8. In this regard, black matrix 68 in device 110 of FIG. 12 consists of lower black layer 86 and upper layer 88.

Pieces 116 of the material that forms intensity-enhancement coatings 112 are shown as being situated on protective layer 90 at the bottoms of the black-matrix openings below the spaces between phosphor particles 72 of each light-emissive region 66 in the example of FIG. 12. Depending on how intensity-enhancement coatings 112 are created, pieces 116 of the intensity-enhancement material may not be present in the implementation of light-emitting device 110 in FIG. 12.

A layer 118 of the intensity-enhancement material lies on charge-removal layer 96. A layer 120 of the contrast-enhancement material lies on layer 118 of the intensity-enhancement material. Similar to contrast-enhancement coatings 114, layer 120 of the contrast-enhancement material typically consists of multiple portions spaced apart from one another. Light-reflective layer 70 extends over contrast-enhancement coatings 114 and intensity-enhancement coatings 112 as described above and over layer 120 of the contrast-enhancement material. Inasmuch as layer 120 of the contrast-enhancement material does not fully cover layer 118 of the intensity-enhancement material, layer 70 typically contacts part(s) of layer 118 of the intensity-enhancement material.

Figure 13A:
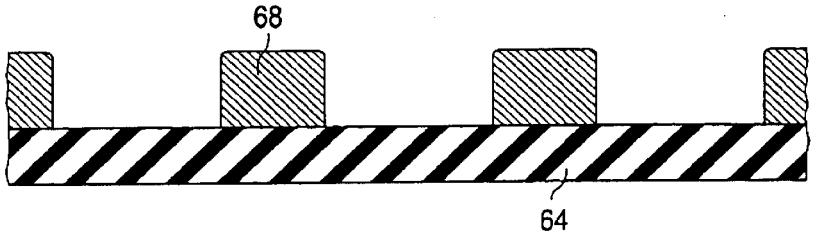
FIGS. 13*a*–13*e* are cross-sectional side views representing steps in fabricating the general light-emitting device of FIG. 11 according to the invention starting from the stage of FIG. 6*b*.
Figure 13B:
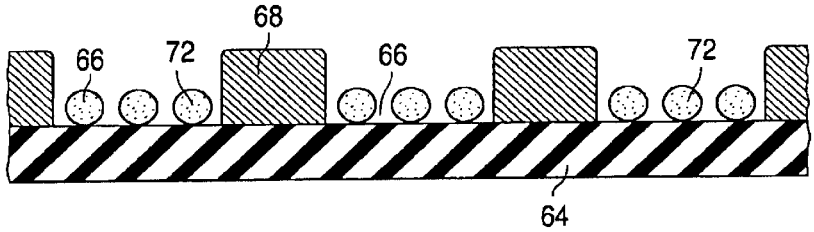
Figure 13C:
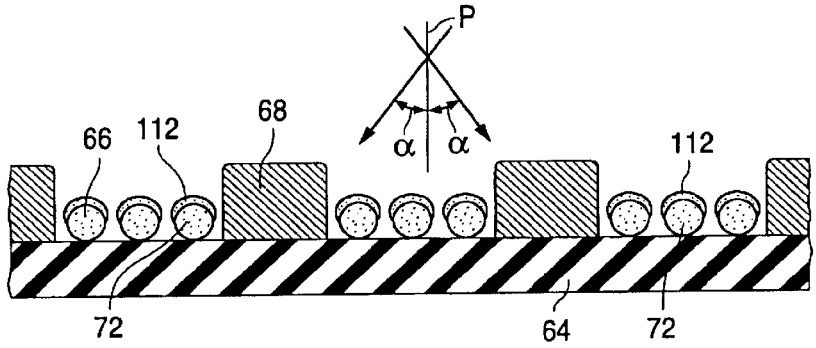
Figure 13D:
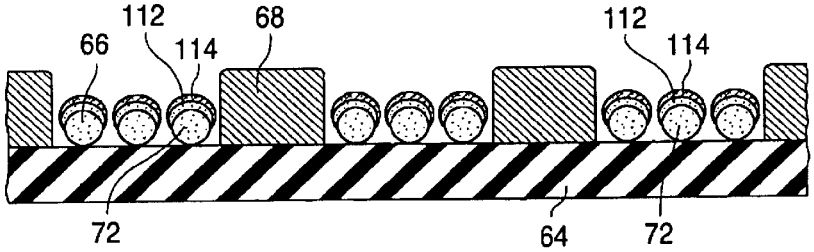

FIGS. 13*a*–13*e* (collectively "FIG. 13") depict a general process for manufacturing light-emitting device 110 of FIG. 11 in accordance with the invention starting from the stage of FIG. 6*b*. See FIG. 13*a* which repeats FIG. 6*b* and thus also FIG. 9*b*. Phosphor particles 72 are introduced into the black-matrix openings to form light-emissive regions 66 as depicted in FIG. 13*b*. The formation of regions 66 is performed in the way described above for the process of FIG. 6 except that, as in the process of FIG. 9, the thickness of regions 66 is illustrated as being less than a monolayer in the example of FIG. 13*b*.

Intensity-enhancement coatings 112 are formed by providing the desired intensity-enhancement material on parts of the outer surfaces of phosphor particles 72 at locations spaced apart from where particles 72 are closest to faceplate 64. See FIG. 13*c*. The formation of coatings 112 is performed according to any of the techniques utilized for creating first intensity-enhancement coatings 82 in the process of FIG. 9.

Pieces (not shown) of the intensity-enhancement material may accumulate on faceplate 64 in the spaces between phosphor particles 72 of each light-emissive region 66 during the formation of intensity-enhancement coatings 112. Any of the measures utilized for preventing pieces of the light-reflective material from accumulating on faceplate 64 in the spaces between particles 72 of each region 66 in the process of FIG. 6 can, if desired, be employed here to prevent pieces of the intensity-enhancement material from similarly accumulating on faceplate 64. When angled deposition, normally angled evaporation but alternatively angled sputtering or angled thermal spraying, is employed to form coatings 112, tilt angle $\alpha$, usually 5–45°, typically 15–20°, is sufficiently large that particles 72 act as shields to substantially prevent any of the intensity-enhancement material from accumulating on faceplate 64 in the spaces between particles 72 of each region 66.

During the formation of intensity-enhancement coatings 112, a layer (not shown) of the intensity-enhancement material normally forms on top of black matrix 68 and, at least in the case of angled deposition, on the sidewalls of matrix 68. If desired, any of the techniques utilized for preventing a layer of the light-reflective material from accumulating on matrix 68 during the formation of light-reflecting coatings 74 in the process of FIG. 6 can generally be employed here to prevent a layer of the intensity-enhancement material from forming on matrix 68.

Contrast-enhancement coatings 114 are subsequently formed by providing the desired contrast-enhancement material on intensity-enhancement coatings 112 so that contrast-enhancement coatings 114 are spaced apart from where phosphor particles 72 are closest to faceplate 64. See FIG. 13*d*. Subject to any differences that may arise because the material of light-reflective coatings 74 in light-emitting device 52 differs from the contrast-enhancement material, coatings 114 are typically formed in a high-vacuum environment according to any of the techniques utilized for creating coatings 74 in the process of FIG. 6.

Contrast-enhancement coatings 114 may, if desired, be created in such a way that substantially none of the contrast-enhancement material accumulates on faceplate 64 in the spaces between phosphor particles 72 of each light-emissive region 66 or on pieces of the intensity-enhancement material situated on the upper surface of faceplate 64. Any of the measures utilized for preventing the light-reflective material of coatings 74 from accumulating on the upper surface of faceplate 64 in the process of FIG. 6 can be utilized here to prevent pieces of the contrast-enhancement material from accumulating over faceplate 64 in the spaces between particles 72 of each region 66.

Angled deposition, normally angled sputtering but alternatively angled evaporation or angled thermal spraying, can be utilized to create contrast-enhancement coatings 114. The angle deposition is performed at tilt angle $\alpha$ to a line, represented by line P in FIG. 13*d*, extending generally perpendicular to faceplate 64. Tilt angle $\alpha$, normally 5–45°, typically 15–20°, is sufficiently large that phosphor particles 72 and any overlying material serve as shields to substantially prevent any of the contrast-enhancement material from accumulating on the upper surface of faceplate 64 or on pieces of the intensity-enhancement material formed on faceplate 64.

During the formation of contrast-enhancement coatings 114, a layer (not shown) of the contrast-enhancement material normally forms on the layer of intensity-enhancement material overlying black-matrix 68. The layer of contrast-enhancement material forms on the portions of the layer of intensity-enhancement material situated on top of matrix 68 and, at least in the case of angled deposition, on the portions of the layer of contrast-enhancement material covering the sidewalls of matrix 68. Any of the techniques employed for preventing a layer of the light-reflective material from accumulating on matrix 68 during the formation of light-reflective coatings 74 in the process of FIG. 6 can, if desired, be employed here to prevent a layer of the contrast-enhancement material from forming on matrix 68 or on a layer of the intensity-enhancement material formed on matrix 68.

Figure 13E:
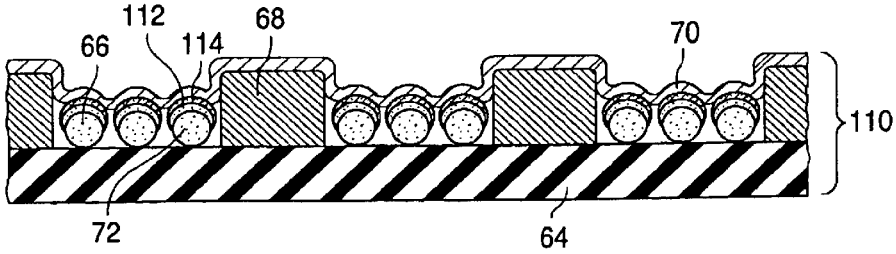

Light-reflective layer 70 is formed over black matrix 68 and contrast-enhancement coatings 114 in generally the same way that layer 70 is formed over matrix 68 and light-reflective coatings 74 in the process of FIG. 6. See FIG. 13*e*. In particular, intermediate layers (not shown) of generally solid material, typically dried lacquer, which can readily be converted to gas are formed in the black-matrix openings so as to just cover, or nearly cover, coatings 114 and 112 and phosphor particles 72 in those openings. Any of the techniques used in the process of FIG. 6 to prevent lacquer from accumulating on top of matrix 68, or on any material on top of matrix 68, can be utilized for the same purpose here. After depositing layer 70, the structure is heating to remove the intermediate layers by converting them to gases which escape through the perforations in layer 70. The structure of FIG. 13*e* is light-emitting device 110 of FIG. 11.

FIGS. 14*a*–14*e* (collectively "FIG. 14") illustrate a process in accordance with the invention for manufacturing an implementation of light-emitting device 110 of FIG. 12 starting from the stage of FIG. 10*f*. See FIG. 14*a* which repeats FIG. 10*f*.

Intensity-enhancement coatings 112 are deposited on phosphor particles 72 in the manner described above for the process of FIG. 13. See FIG. 14*b*. During the formation of coatings 112, layer 118 of the intensity-enhancement material forms on charge-removal layer 96 above matrix 68. Pieces 116 of the intensity-enhancement material simultaneously accumulate on protective layer 90 above faceplate 64 in the spaces between particles 72 of each light-emissive region 66. The accumulation of pieces 116 of the intensity-enhancement material on protective layer 90 at the preceding locations can be avoided in the manner described above.

Contrast-enhancement coatings 114 are deposited on intensity-enhancement coatings 112 in the manner described above for the process of FIG. 13. See FIG. 14*c*. During the formation of contrast-enhancement coatings 114, layer 120 of the contrast-enhancement material forms on layer 118 of the intensity-enhancement material. Pieces (not shown) of the contrast-enhancement material may simultaneously accumulate on pieces 116 of the intensity-enhancement material or, if pieces 116 are absent, on protective layer 90 above faceplate 64 in the spaces between phosphor particles 72 of each light-emissive region 66. The accumulation of pieces of the contrast-enhancement material at these locations can be avoided in the manner described above.

Figure 14A:
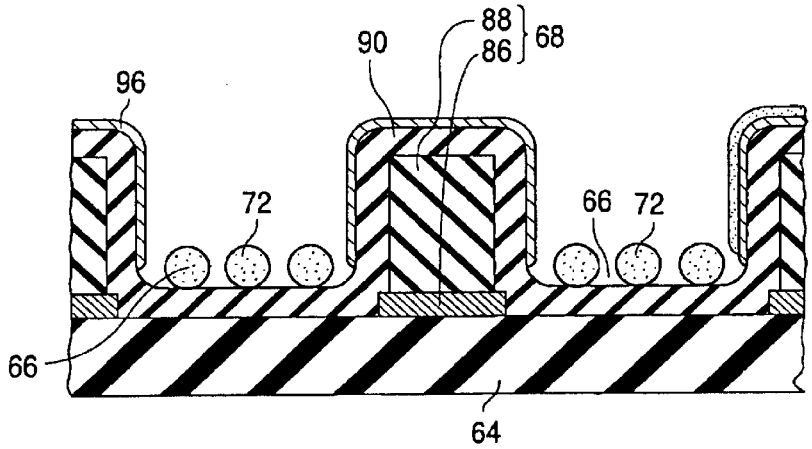
FIGS. 14*a*–14*e* are cross-sectional side views representing steps in fabricating the implementation of FIG. 12 according to the invention starting from the stage of FIG. 10*f*.
Figure 14B:
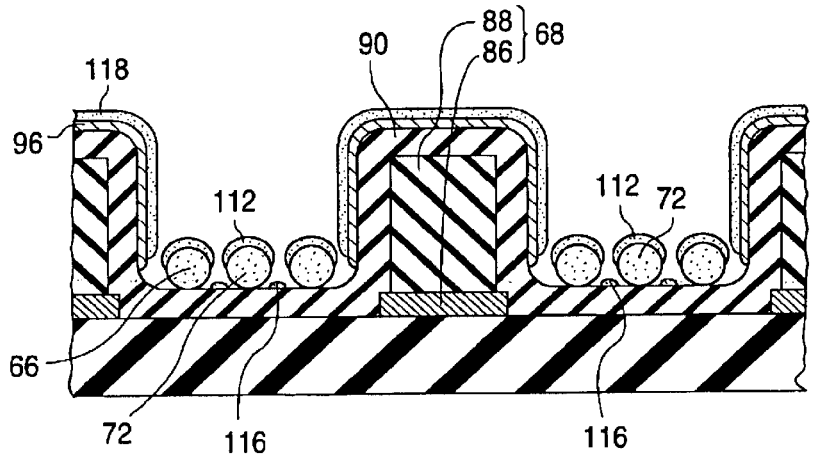
Figure 14C:
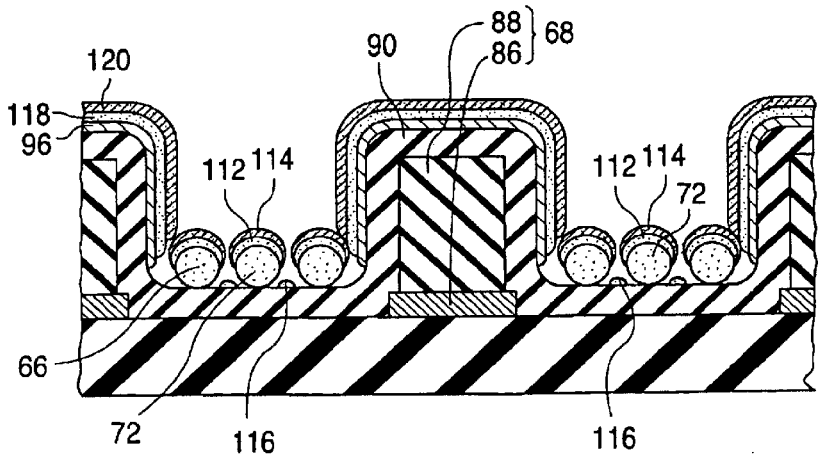
Figure 14D:
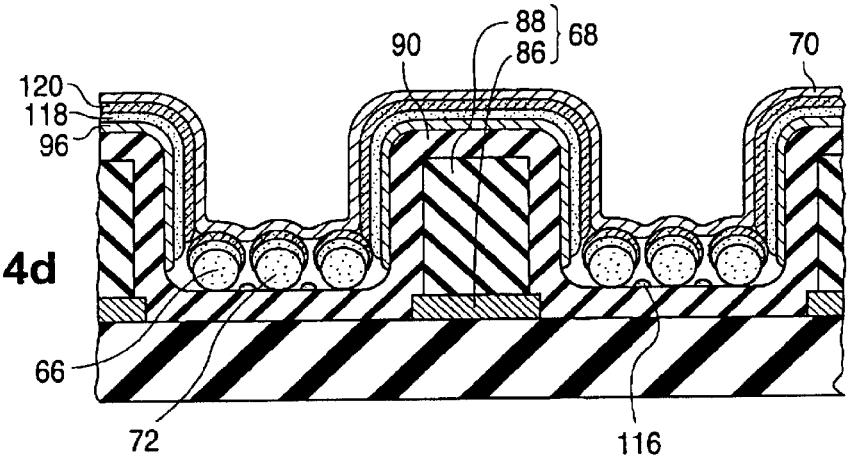
Figure 14E:
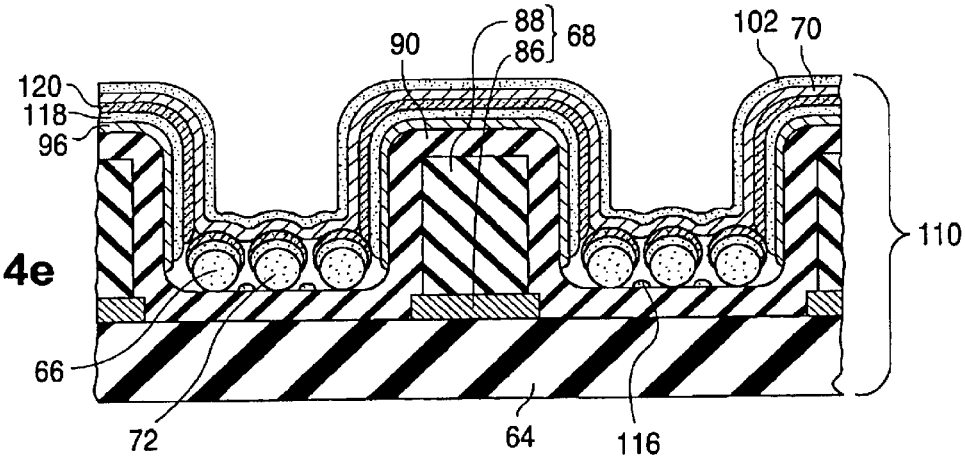

Light-reflective layer 70 is formed over contrast-enhancement coatings 114 and layer 120 of the contrast-enhancement material in the way described above for creating layer 70 over coatings 114 and black matrix 68 in the process of FIG. 13. See FIG. 14*d*. Finally, additional layer 102 is deposited on light-reflective layer 70 in the same way as in the process of FIG. 10. The resultant structure of FIG. 14*e* is the implementation of light-emitting device 110 in FIG. 12.

Figure 15:
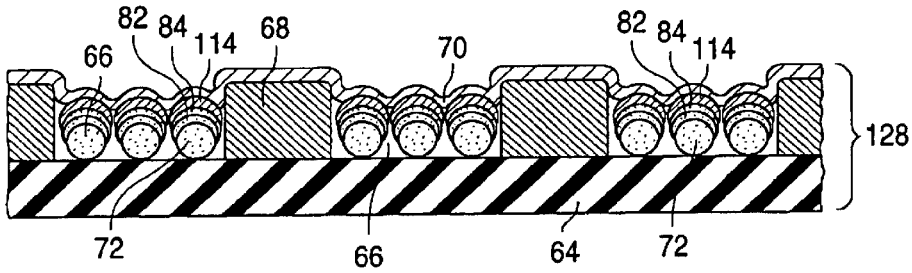
FIG. 15 is a cross-sectional side view of the active portion of a light-emitting device configured according to the invention and substitutable for the light-emitting device of FIG. 11.

FIG. 15 illustrates a side cross section of part of the active portion of a light-emitting device 128 configured according to the invention for enhancing image intensity and optical contrast. Light-emitting device 128 is basically an extension of light-emitting device 110 of FIG. 11 and thus is substitutable for device 110 in the flat-panel CRT display of FIG. 11. Except as described below, device 128 contains components 64, 66, 68, 70, 72, and 114 constituted, configured, and functioning the same as in device 110 of FIG. 11. Accordingly, each contrast-enhancement coating 114 normally consists of multiple portions spaced apart from each other.

In place of intensity-enhancement coatings 112, light-emitting device 128 contains first intensity-enhancement coatings 82 and second intensity-enhancement coatings 84 configured and constituted the same as in light-emitting device 80 of FIG. 7. Hence, each pair of associated intensity-enhancement coatings 82 and 84 covers part of the outer surface of one phosphor particle 72. Contrast-enhancement coatings 114 are respectively situated on second intensity-enhancement coatings 84 here in the same way that coatings 114 are situated on intensity-enhancement coatings 112 in light-emitting device 110 of FIG. 11. Accordingly, each contrast-enhancement coating 114 covers only part of associated second intensity-enhancement coating 84. The average refractive index thereby progressively decreases in going from each particle 72 through overlying intensity-enhancement coatings 82 and 84 to the high vacuum along part(s) of the outer surface of that second intensity-enhancement coating 84.

For the reasons presented above in connection with intensity-enhancement coatings 82 and 84 of light-emitting device 80 of FIG. 7, more rear-directed light emitted by phosphor particles 72 normally escapes particles 72 and coatings 82 and 84 travelling backward, including partially sideways, at locations spaced apart from where second coatings 84 come closest to light-reflective layer 70 than, in the absence of coatings 82 and 84 (but with contrast-enhancement coatings 114 still present and thereby lying directly on particles 72), would escape particles 72 moving backward, again including partially sideways, at locations spaced apart from where particles 72 would then come closest to layer 70. Part of the increased amount of phosphor-emitted light that escapes particles 72 and coatings 82 and 84 impinges on layer 70 in such a way as to be reflected forward to the sides of particles 72 in light-emitting device 128. Accordingly, the forward light intensity and image intensity are enhanced in device 128. The enhancement can be greater in device 128 than in device 110 in FIG. 11 because more intensity-enhancement coatings overlie each particle 72 in device 128 than in device 110 of FIG. 11.

Similar to what occurs in light-emitting device 110 of FIG. 11, contrast-enhancement coatings 114 in device 128 absorb some of the phosphor-emitted rear-directed light which escapes phosphor particles 72 and intensity-enhancement coatings 82 and 84 and which might otherwise be reflected forward to improve the forward light intensity. The forward light intensity is again not as high as it would be if contrast-enhancement coatings 114 were absent. Nonetheless, the overall visibility of the image is enhanced because coatings 114 enable the optical contrast to be improved.

Light-emitting device 128 can be modified in various ways. As in light-emitting device 110, contrast-enhancement coatings 114 overlying phosphor particles 72 in each light-emissive region 66 can be converted into a continuous contrast-enhancement layer which may, or may not, be perforated at locations above the spaces between particles 72 of each region 66. Each particle 72 can be partially covered with more than two intensity-enhancement coatings such that the average refractive index progressively decreases in moving away from that particle 72. In general, part of the outer surface of each particle 72 can be covered with m intensity-enhancement coatings having the properties, including progressively decreasing average refractive index, described above for the corresponding modification of light-emitting device 80 in FIG. 7. With the example of FIG. 15 representing the case in which m is 2, the situation of more than two intensity-enhancement coatings is implemented when m is greater than 2.

Figure 16:
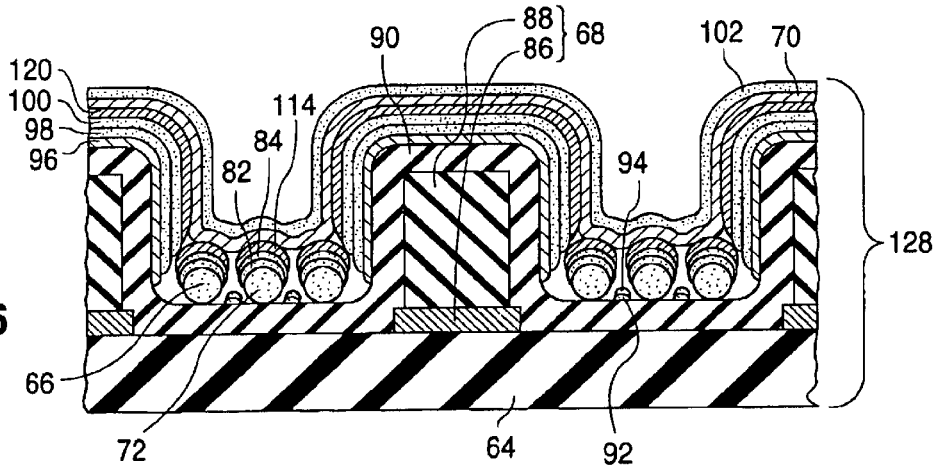
FIG. 16 is a cross-sectional side view of the active portion of a light-emitting device configured according to the invention and substitutable for the implementation of FIG. 12.

FIG. 16 illustrates a side cross section of part of the active portion of an implementation of light-emitting device 128 in accordance with the invention. Except as described below, device 128 of FIG. 16 contains components 64, 66, 68, 70, 72, 82, 84, and 114 configured, constituted, and functioning the same as in device 128 in FIG. 15. Except as described below, device 128 of FIG. 16 also contains components 86, 88, 90, 92, 94, 96, 98, 100, and 102 configured, constituted, and functioning the same as in light-emitting device 80 of FIG. 8. Depending on how intensity-enhancement coatings 82 and 84 are created, pieces 92 of the first intensity-enhancement material and pieces 94 of the second intensity-enhancement material may not be present in device 128 of FIG. 16.

Light-emitting device 128 of FIG. 16 differs from light-emitting device 110 of FIG. 12 in the same way that device 128 of FIG. 15 differs from device 110 of FIG. 11, namely that intensity-enhancement coatings 82 and 84 in device 128 of FIG. 16 replace intensity-enhancement coatings 112 in device 110 of FIG. 12. Accordingly, layer 118 of the intensity-enhancement material in device 110 of FIG. 12 is replaced in device 128 of FIG. 16 with layer 98 of the first intensity-enhancement material and overlying layer 100 of the second intensity-enhancement material. With layer 98 of the first intensity-enhancement material again lying on charge-removal layer 96, layer 120 of the contrast-enhancement material lies on layer 100 of the second intensity-enhancement material.

Light-emitting device 128 of FIG. 15 is manufactured, in accordance with the invention, according to the general process of FIG. 13 except that intensity-enhancement coatings 82 and 84 replace intensity-enhancement coatings 112. Coatings 82 and 84 of device 128 are formed according to the process of FIG. 9. Device 128 of FIG. 16 is similarly manufactured, in accordance with the invention, according to the process of FIG. 14, except that intensity-enhancement coatings 82 and 84 replace intensity-enhancement coatings 112, layers 98 and 100 of the first and second intensity-enhancement materials replace layer 118 of the intensity-enhancement material, and pieces 92 and 94 of the first and second intensity-enhancement materials replace pieces 116 of the intensity-enhancement material. Layers 98 and 100 of the intensity-enhancement materials and, when present, pieces 92 and 94 of the intensity-enhancement materials are formed according to the process of FIG. 10 during the formation of coatings 82 and 84.

Intensity-enhancement and Light-reflective Coatings

Figure 17:
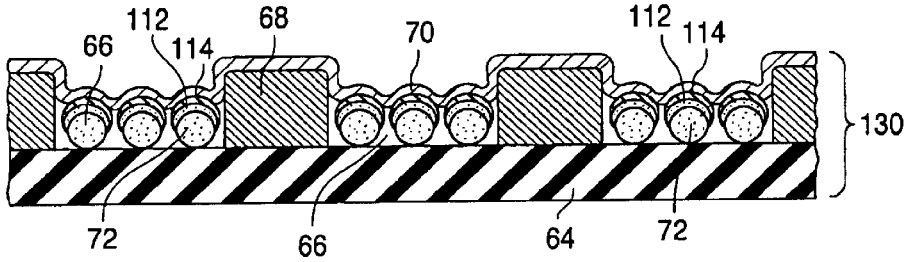
FIG. 17 is a cross-sectional side view of the active portion of yet another light-emitting device configured according to the invention.

FIG. 17 depicts a side cross section of part of the active portion of a light-emitting device 130 configured according to the invention for providing enhanced image intensity. Device 130 is part of a flat-panel CRT display that includes an oppositely situated electron-emitting device, typically electron-emitting device 50, connected to light-emitting device 130 through an outer wall (not shown) to form a sealed enclosure maintained at a high vacuum, once again typically an internal pressure of no more than $10^{-6}$ torr. Spacers, as exemplified by spacer wall 54 in FIG. 5, are typically situated between devices 50 and 130. The active portion of device 130 has a plan view largely identical to that of FIG. 5.

Light-emitting device 130 contains components 64, 66, 68, and 70 configured, constituted, and functioning the same as in light-emitting device 110 of FIG. 11. The thickness of light-emissive regions 66 is, for simplicity, again illustrated as being less than a monolayer in device 110 of FIG. 17. Nonetheless, as in light-emitting device 52 of FIGS. 4 and 5, the thickness of regions 66 can be greater than a monolayer in device 130 of FIG. 17. Black matrix 68, although depicted as being thicker than regions 66, can be thinner than regions 66.

Part of the outer surface of each of certain phosphor particles 72 in light-emitting device 130 is, in accordance with the invention, covered with an intensity-enhancement coating 112 and a light-reflective coating 74. Intensity-enhancement coatings 112 are positioned over particles 72 in device 130 in the same way as in light-emitting device 110 of FIG. 11. Accordingly, each coating 112 here conformally covers part of the outer surface of underlying particle 72 in such a way as to be spaced apart from where that particle 72 is closest to faceplate 64. Each light-reflective coating 74 conformally overlies associated intensity-enhancement coating 112 so as to overlie part of the outer surface of underlying particle 72 and likewise be spaced apart from where that particle 72 is closest to faceplate 64.

Depending on how intensity-enhancement coatings 112 are formed in light-emitting device 130, pieces (not shown) of the intensity-enhancement material may be situated on faceplate 64 in the spaces between phosphor particles 72 of each light-emissive region 66. When present in device 130, these pieces of the intensity-enhancement material are typically not significantly harmful, and may be beneficial, for the reasons presented above in connection with the similar pieces of intensity-enhancement material that may be present on the upper surface of faceplate 64 in light-emitting device 80.

A layer (not shown) of the intensity-enhancement material may be situated on black matrix 68 in light-emitting device 130. A layer (not shown) of the light-reflective material that forms coatings 74 may similarly be situated over matrix 68, either directly on matrix 68 or on the layer of intensity-enhancement material when it is present. The presence of the layer of intensity-enhancement material or/and this additional layer of light-reflective material is typically not harmful and can be beneficial. Should matrix 68 emit contaminant gases upon being struck by electrons, either or both of these layers can act as a shield to reduce the amount of these gases that enter that display's interior. If the additional light-reflective layer consists of metal, the additional light-reflective layer can assist in removing electronic charge from phosphor particles 72 when they are struck by electrons. The additional light-reflective layer may also cooperate with light-reflective layer 70 in functioning as the display's anode.

Light-reflective layer 70 overlies light-reflective coatings 74 and intensity-enhancement coatings 112. As in light-emitting device 52 of FIGS. 4 and 5, layer 70 typically contacts some or all of light-reflective coatings 74 here. Coatings 74 normally extend sufficiently far down phosphor particles 72 toward faceplate 64 that layer 70 conforms, on the average, to only part of the outer surface of each coating 74. Due to the perforations normally present in layer 70 or/and how light-emitting device 130 is manufactured, at least part of the outer surface of each coating 74 is subjected to the high vacuum in the interior of the display.

Aside from conformally contacting intensity-enhancement coatings 112 instead of phosphor particles 72, light-reflective coatings 74 have the same basic properties here as in light-emitting device 52 of FIGS. 4 and 5. Although shown as continuous and non-perforated in FIG. 17, coatings 74 are normally perforated. Each coating 74 may be divided into multiple portions spaced apart from one another. In short, each coating 74 normally covers only part of associated intensity-enhancement coating 112. Hence, part of the outer surface of each intensity-enhancement coating 112 is normally subjected to the high vacuum in the display's interior.

Intensity-enhancement coatings 112 have the same characteristics, including light-refractive properties here as in light-emitting device 80 of FIG. 7. Since one or more parts of the outer surface of each coating 112 are normally subjected to the high vacuum in the display's interior, each phosphor particle 72 and overlying coating 112 normally form a structure in which the average refractive index progressively decreases in going from that particle 72 through overlying coating 112 to the high vacuum along at least part of that coating 112.

Similar to what occurs in light-emitting device 110 of FIG. 11, more rear-directed light emitted by phosphor particles 72 in light-emitting device 130 normally escapes particles 72 and intensity-enhancement coatings 112 traveling backward, including partially sideways, at locations spaced apart from where coatings 112 come closest to light-reflective layer 70 than, in the absence of coatings 112 (but with light-reflective coatings 74 still present and thereby lying directly on particles 72) would escape particles 72 moving backward, again including partially sideways, at locations spaced apart from where particles 72 would then come closest to layer 70. Part of the increased amount of phosphor-emitted rear-directed light escaping particles 72 and coatings 112 impinges on layer 70 in such a way as to be reflected forward to the side of particles 72. The forward light intensity can thus be enhanced.

Part of the phosphor-emitted rear directed light passes through intensity enhancement coatings 112, is reflected off light-reflective coatings 74, passes through phosphor particles 72, and then passes through faceplate 64. This can further increases the light intensity in the forward direction. Coatings 74 and 112 can thereby produce an increase in the display's image intensity. Accordingly, the combination of coatings 74 and 112 and layer 70 can provide greater forward light intensity and image intensity than would occur solely with layer 70 or solely with coatings 74 and 112.

As in light-emitting device 52, light-reflective coatings 74 function as getters when they consist of one or more of the metals magnesium, titanium, vanadium, chromium, manganese, iron, cobalt, nickel, copper, zirconium, niobium, molybdenum, palladium, silver, barium, tantalum, tungsten, platinum, lead, and thorium, or an alloy of one or more of these metals. Likewise, coatings 74 in light-emitting device 130 may alternatively or additionally be formed with oxide of one or more of the metals magnesium, chromium, manganese, cobalt, nickel, and lead. Coatings 74 can then sorb contaminant gases, especially sulfur-containing gases, released by phosphor particles 72 before those gases escape the immediate vicinity of particles 72 and cause damage elsewhere. Since light-reflective layer 70 is perforated, coatings 74 can also sorb contaminant gases that originate in the display's interior and pass through layer 70. In one embodiment of device 130, coatings 74 consist substantially of palladium or/and chromium.

Light-emitting device 130 can be modified in various ways. Each intensity-enhancement coating 112 can be replaced with two or more intensity-enhancement coatings of progressively decreasing average refractive index in moving away from underlying phosphor particle 72. In general, part of the outer surface of each particle 72 can be covered with m intensity-enhancement coatings having the properties, including progressively decreasing average refractive index, described above for the modifications of light-emitting devices 80 and 110. Light-reflective coatings 74 are situated on the mth intensity-enhancement coatings.

Figure 18:
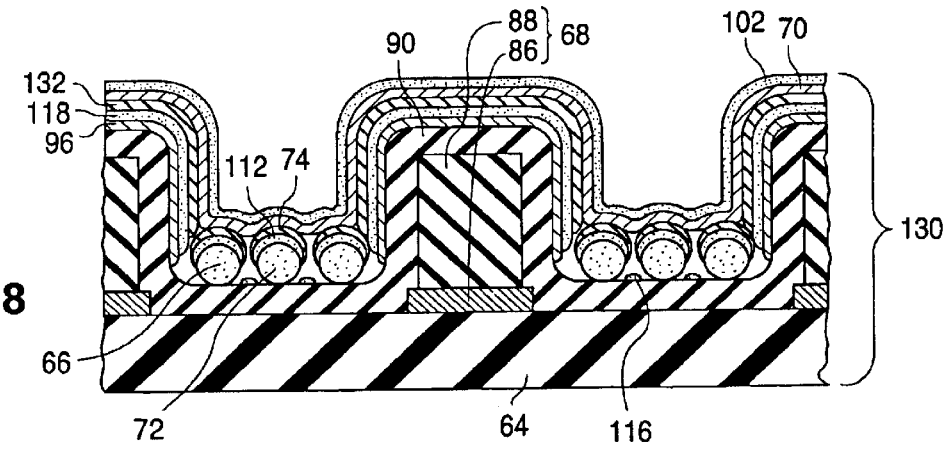
FIG. 18 is a cross-sectional side view of the active portion of an implementation of the light-emitting device of FIG. 17.

FIG. 18 depicts a side cross section of part of the active portion of an implementation of light-emitting device 130 in accordance with the invention. Except as described below, light-emitting device 130 of FIG. 18 contains components 64, 66, 68, 70, 72, 74, and 112 configured, constituted, and functioning the same as in device 130 of FIG. 17. Except as described below, device 130 of FIG. 18 also contains components 86, 88, 90, 96, 102, 116, and 118 configured, constituted, and functioning the same as in light-emitting device 110 of FIG. 12. Depending on how intensity-enhancement coatings 112 are created, pieces 116 of the intensity-enhancement material may not be present in device 130 of FIG. 18.

In light-emitting device 130 of FIG. 18, a layer 132 of the light-reflective material that forms light-reflective coatings 74 lies on layer 118 of the intensity-enhancement material. Light-reflective layer 70, which extends over coatings 74, also extends over layer 132 of light-reflective material.

Light-emitting device 130 of FIG. 17 is manufactured, in accordance with the invention, according to the general process of FIG. 13 except that light-reflective coatings 74 replace contrast-enhancement coatings 114. Light-reflective coatings 74 in device 130 of FIG. 17 are formed according to the process of FIG. 6. Device 130 of FIG. 18 is manufactured, in accordance with the invention, according to the process of FIG. 14 except that light-reflective coatings 74 replace contrast-enhancement coatings 114, and layer 132 of light-reflective material replaces layer 120 of the contrast-enhancement material. Layer 132 of light-reflective material is formed on layer 118 of the intensity-enhancement material during the deposition of the light-reflective material of coatings 74.

Global Considerations and Further Variations

Coatings 74, 82, 84, 112, and 114 which variously overlie phosphor particles 72 in the flat-panel CRT displays containing light-emitting devices 52, 80, 110, 128, and 130 are located between electron emitting device 50 and particles 72 of each light-emitting device 52, 80, 110, 128, or 130. The vast majority of the electrons emitted by regions 58 of device 50 strike coatings 74, 82, 84, 112, and 114 in these displays before reaching particles 72. Coatings 74, 82, 84, 112, and 114 do not become significantly volatile (gaseous) when struck by electrons emitted by device 50. Consequently, little contamination of the displays occurs due to electrons directly striking coatings 74, 82, 84, 112, and 114.

As electrons emitted by regions 58 of electron-emitting device 50 move toward phosphor particles 72, particle coatings 74, 82, 84, 112, or/and 114 serve as shields for particles 72. These shields reduce the amount of erosion that particles 72 would undergo in the absence of coatings 74, 82, 84, 112, and 114. Also, the shields partially encapsulate particles 72. Importantly, the partial encapsulation furnished by coatings 74, 82, 84, 112, or/and 114 occurs at locations where particles 72 are most likely to produce gases when struck by electrons emitted by device 50. Consequently, the coating shields significantly inhibit gases produced by particles 72, especially gases produced when high-energy electrons strike particles 72, from leaving the immediate vicinities of particles 72. As mentioned above, coatings 74 may function as getters for sorbing contaminant gases, especially sulfur-containing contaminant gases. Accordingly, coatings 74, 82, 84, 112, and 114 substantially reduce the amount of damage caused by contaminant gases produced by particles 72. The net result is a substantial improvement in display performance and lifetime.

Subject to fabricating light-emitting devices 52, 80, 110, 128, and 130 in the manner described above, each of the flat-panel CRT displays of the invention is manufactured generally in the following way. Electron-emitting device 50 is fabricated separately from light-emitting device 52, 80, 110, 128, or 130. Internal supports, such as spacer walls, are mounted on electron-emitting device 50 or on light-emitting device 52, 80, 110, 128, or 130. Electron-emitting device 50 is subsequently sealed to light-emitting device 52, 80, 110, 128, or 130 through the above-mentioned outer wall in such a way that the assembled, sealed display is at a very low internal pressure, typically no more than $10^{-6}$ torr.

Directional terms such as "lateral", "vertical", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here. Similarly, the terms "row" and "column" are arbitrary relative to each other and can be reversed.

While the invention has been described with reference to particular embodiments, this description is solely for the purpose of illustration and is not to be construed as limiting the scope of the invention claimed below. Light-emitting device 52 of FIGS. 4 and 5 can be implemented as generally shown for light-emitting device 130 of FIG. 18 subject to deleting intensity-enhancement coatings 112 and layer 116 of the intensity-enhancement material in FIG. 18. Once again, the thickness of light-emissive regions 66 in such an implementation of device 52 can be greater than, or less than, a monolayer.

Intensity-enhancement coatings 112 can be deleted in light-emitting device 110 of FIG. 11, including the implementation of FIG. 12, so that contrast-enhancement coatings 114 lie directly on phosphor particles 72. Layer 118 of the intensity-enhancement material would then be deleted from device 110 of FIG. 12. Each coating 114 in such a variation of device 110 of FIG. 11 or 12 again typically consists of multiple portions spaced apart from one another.

When the thickness of each light-emissive region 66 is greater than a monolayer, e.g., from 1.5 monolayers up to 3 monolayers or more, contrast-enhancement coatings 114 can sometimes be deleted in light-emitting device 110 of FIG. 11. Light-reflective layer 70 then lies directly on intensity-enhancement coatings 112. In the implementation of device 110 in FIG. 12, layer 120 of the contrast-enhancement material is also deleted along with any pieces of the contrast-enhancement material situated on pieces 116 of the intensity-enhancement material or, if pieces 116 are absent, situated on protective layer 90 in the spaces between phosphor particles 72 of each region 66. The fabrication of such a variation of device 110 is performed in the manner described above except that the deposition of the contrast-enhancement material is deleted from the fabrication process. Device 110 can also sometimes be modified to delete contrast-enhancement coatings 114 when the thickness of each region 66 is significantly less than a monolayer.

Field emission includes the phenomenon generally termed surface conduction emission. Various modifications and applications may thus be made by those skilled in the art without departing from the true scope and spirit of the invention as defined in the appended claims.

We claim:

1. A structure comprising:

a plate;

a light-emissive region overlying light-transmissive material of the plate and comprising a plurality of light-emissive particles each having an outer surface; and a group of light-reflective coatings substantially reflective of visible light, each light-reflective coating generally conformally overlying part of the outer surface of a corresponding different one of the light-emissive particles so as to be spaced apart from where that light-emissive particle is closest to the plate.

2. A structure as in claim 1 further including a light-reflective layer overlying the light-reflective coatings above the light-emissive region, the light-reflective layer being generally flat where it overlies the light-emissive region.

3. A structure as in claim 1 wherein the light-reflective coatings consist largely of metal.

4. A structure as in claim 3 wherein the metal of the light-reflective coatings comprises at least one of beryllium, boron, magnesium, aluminum, chromium, manganese, iron, cobalt, nickel, copper, gallium, molybdenum, palladium, silver, indium, platinum, thallium, and lead.

5. A structure as in claim 4 wherein the light-emissive particles comprise metal sulfide phosphors.

6. A structure as in claim 3 wherein the metal of the light-reflective coatings comprises at least one Group IIIB (13) metal.

7. A structure as in claim 1 further including an electron-emitting device comprising an electron-emissive region for emitting electrons which pass through the light-reflective coatings and cause the light-emissive particles to emit light.

8. A structure as in claim 7 wherein the light-reflective coatings reduce damage that occurs to the light-emissive particles as electrons emitted by the electron-emissive region impinge on the light-emissive particles.

9. A structure as in claim 1 wherein the outer surface of each light-emissive particle consists of (a) a lower half surface closest to the plate and (b) an upper half surface farthest from the plate, each light-reflective coating extending generally conformally along at least part of the upper half surface of the corresponding light-emissive particle.

10. A structure as in claim 9 wherein each of a plural number of the light-reflective coatings extends generally conformally along largely all of the upper half surface of the corresponding light-emissive particle.

11. A structure comprising:

a plate;

a light-emissive region overlying light-transmissive material of the plate and comprising a plurality of light-emissive particles each having an outer surface; and a group of coatings comprising at least one Group IIIB (13) metal, each coating generally conformally overlying part of the outer surface of a corresponding different one of the light-emissive particles so as to be spaced apart from where that light-emissive particle is closest to the plate.

12. A structure as in claim 11 further including a light-reflective layer overlying the coatings above the light-emissive regions, the light-reflective layer being generally flat where it overlies the light-emissive region.

13. A structure as in claim 11 wherein the light-emissive particles comprise metal sulfide phosphors.

14. A structure as in claim 11 further including an electron-emitting device comprising an electron-emissive region for emitting electrons which pass through the coatings and cause the light-emissive particles to emit light.

15. A structure as in claim 14 wherein the coatings reduce damage that occurs to the light-emissive particles as electrons emitted by the electron-emissive region impinge on the light-emissive particles.

16. A structure as in claim 14 wherein the getter coatings reduce damage that occurs to the light-emissive particles as electrons emitted by the electron-emissive regions impinge on the light-emissive particles.

17. A structure as in claim 11 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

18. A structure as in claim 17 wherein each of a plural number of the coatings extends generally conformally along largely all of the upper half surface of the corresponding light-emissive particle.

19. A structure comprising:

a plate;

a light-emissive region overlying light-transmissive material of the plate and comprising a plurality of light-emissive particles for emitting blue light, each light-emissive particle having an outer surface; and a group of coatings comprising at least one of boron, aluminum, gallium, silver, indium, and thallium, each coating generally conformally overlying part of the outer surface of a corresponding different one of the light-emissive particles so as to be spaced apart from where that light-emissive particle is closest to the plate.

20. A structure as in claim 19 wherein the light-emissive particles comprise metal sulfide phosphors with silver substitution.

21. A structure as in claim 19 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

22. A structure as in claim 21 wherein each of a plural number of the light-reflective coatings extends generally conformally along largely all of the upper half surface of the corresponding light-emissive particle.

23. A structure comprising:

a plate;

a light-emissive region overlying light-transmissive material of the plate and comprising a plurality of light-emissive particles for emitting green light, each light-emissive particle having an outer surface; and a group of coatings comprising at least one of boron, aluminum, copper, gallium, indium, and thallium, each coating generally conformally overlying part of the outer surface of a corresponding different one of the light-emissive particles so as to be spaced apart from where that light-emissive particle is closest to the plate.

24. A structure as in claim 23 wherein the light-emissive particles comprise metal sulfide phosphors with copper substitution.

25. A structure as in claim 23 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

26. A structure as in claim 25 wherein each of a plural number of the light-reflective coatings extends generally conformally along largely all of the upper half surface of the corresponding light-emissive particle.

27. A structure comprising:

a plate;

a light-emissive region overlying light-transmissive material of the plate and comprising a plurality of light-emissive particles each having an outer surface; and a group of coatings comprising at least one of beryllium, boron, magnesium, aluminum, titanium, vanadium, chromium, manganese, iron, cobalt, nickel, copper, gallium, zirconium, niobium, molybdenum, palladium, silver, indium, barium, tantalum, tungsten, platinum, thallium, lead, thorium, and oxide of at least one of magnesium, chromium, manganese, cobalt, nickel, and lead, each coating generally conformally overlying part of the outer surface of a corresponding different one of the light-emissive particles so as to be spaced apart from where that light-emissive particle is closest to the plate.

28. A structure as in claim 27 further including a light-reflective layer overlying the coatings above the light-emissive region, the light-reflective layer being generally flat where it overlies the light-emissive region.

29. A structure as in claim 27 wherein the light-emissive particles comprise metal sulfide phosphors.

30. A structure as in claim 27 further including an electron-emitting device comprising an electron-emissive region for emitting electrons which pass through the coatings and cause the light-emissive particles to emit light.

31. A structure as in claim 30 wherein the coatings reduce damage that occurs to the light-emissive particles as electrons emitted by the electron-emissive region impinge on the light-emissive particles.

32. A structure as in claim 27 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

33. A structure as in claim 32 wherein each of a plural number of the light-reflective coatings extends generally confonnally along largely all of the upper half surface of the corresponding light-emissive particle.

34. A structure comprising:

a plate;

a light-emissive region overlying light-transmissive material of the plate and comprising a plurality of light-emissive particles each having an outer surface; and a group of getter coatings, each generally conformally overlying part of the outer surface of a corresponding one of the light-emissive particles so as to be spaced apart from where that light-emissive particle is closest to the plate.

35. A structure as in claim 34 further including a light-reflective layer overlying the getter coatings above the light-emissive region, the light-reflective layer being generally flat where it overlies the light-emissive region.

36. A structure as in claim 34 further including a light-reflective layer overlying the getter coatings above the light-emissive region, the light-reflective layer being perforated where it overlies the light-emissive region.

37. A structure as in claim 34 wherein the getter coatings are light reflective.

38. A structure as in claim 34 wherein the getter coatings comprise at least one of magnesium, titanium, vanadium, chromium, manganese, iron, cobalt, nickel, copper, zirconium, niobium, molybdenum, palladium, silver, barium, tantalum, tungsten, platinum, lead, thorium, and oxide of at least one of magnesium, chromium, manganese, cobalt, nickel, and lead.

39. A structure as in claim 34 wherein the getter coatings sorb sulfur.

40. A structure as in claim 34 further including an electron-emitting device comprising an electron-emissive region for emitting electrons which pass through the getter coatings and cause the light-emissive particles to emit light.

41. A structure as in claim 40 wherein the getter coatings reduce damage that occurs to the light-emissive particles as electrons emitted by the electron-emissive region impinge on the light-emissive particles.

42. A structure as in claim 34 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

43. A structure as in claim 42 wherein each of a plural number of the light-reflective coatings extends generally conformally along largely all of the upper half surface of the corresponding light-emissive particle.

44. A structure comprising:

a plate;

a light-emissive region overlying light-transmissive material of the plate and comprising a plurality of light-emissive particles each having an outer surface; and a group of light-reflective coatings consisting largely of non-oxidized metal, each light-reflective coating generally conformally overlying part of the outer surface of a corresponding different one of the light-emissive particles so as to be spaced apart from where that light-emissive particle is closest to the plate.

45. A structure as in claim 44 wherein the light-reflective coatings consist of substantially pure metal.

46. A structure as in claim 44 further including a light-reflective layer overlying the light-reflective coatings above the light-emissive region, the light-reflective layer being generally flat where it overlies the light-emissive region.

47. A structure as in claim 44 wherein the metal of the light-reflective coatings comprises at least one of beryllium, boron, magnesium, aluminum, chromium, manganese, iron, cobalt, nickel, copper, gallium, molybdenum, palladium, silver, indium, platinum, thallium, and lead.

48. A structure as in claim 44 wherein the outer surface of each light-emissive particle consists of (a) a lower half surface closest to the plate and (b) an upper half surface farthest from the plate, each light-reflective coating extending generally conformally along at least part of the upper half surface of the corresponding light-emissive particle.

49. A structure as in claim 48 wherein each of a plural number of the light-reflective coatings extends generally conformally along largely all of the upper half surface of the corresponding light-emissive particle.

50. A structure as in claim 44 further including an electron-emitting device comprising an electron-emissive region for emitting electrons which pass through the light-reflective coatings and cause the light-emissive particles to emit light.

51. A structure as in claim 50 wherein the light-reflective coatings reduce damage that occurs to the light-emissive particles as electrons emitted by the electron-emissive region impinge on the light-emissive particles.

52. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of light-reflective coatings substantially reflective of visible light, the groups of light-reflective coatings respectively corresponding to the light-emissive regions, each light-reflective coating of each group generally conformally overlying part of the outer surface of a corresponding different one of the light-emissive particles of the corresponding light-emissive region so as to be spaced apart from where that light-emissive particle is closest to the plate.

53. A structure as in claim 52 further including a light-reflective layer overlying the light-reflective coatings above the light-emissive regions, the light-reflective layer being generally flat where it overlies the light-emissive regions.

54. A structure as in claim 52 wherein the light-reflective coatings consist largely of metal.

55. A structure as in claim 54 wherein the metal of the light-reflective coatings comprises at least one of beryllium, boron, magnesium, aluminum, chromium, manganese, iron, cobalt, nickel, copper, gallium, molybdenum, palladium, silver, indium, platinum, thallium, and lead.

56. A structure as in claim 52 wherein the outer surface of each light-emissive particle consists of (a) a lower half surface closest to the plate and (b) an upper half surface farthest from the plate, each light-reflective coating extending generally conformally along at least part of the upper half surface of the corresponding light-emissive particle.

57. A structure as in claim 56 wherein each of a plural number of the light-reflective coatings extends generally conformally along largely all of the upper half surface of the corresponding light-emissive particle.

58. A structure as in claim 52 further including an electron-emitting device comprising a like multiplicity of laterally separated electron-emissive regions respectively situated generally opposite the light-emissive regions, each electron-emissive region emitting electrons which pass through the light-reflective coatings of the light-emissive particles in the oppositely situated light-emissive region and cause those light-emissive particles to emit light.

59. A structure as in claim 58 wherein the light-reflective coatings reduce damage that occurs to the light-emissive particles as electrons emitted by the electron-emissive regions impinge on the light-emissive particles.

60. A structure as in claim 52 further including an electron-emitting device comprising a like multiplicity of laterally separated electron-emissive regions respectively situated generally opposite the light-emissive regions, each electron-emissive region emitting electrons which pass through the coatings of the light-emissive particles in the oppositely situated light-emissive region and cause those light-emissive particles to emit light.

61. A structure as in claim 60 wherein the coatings reduce damage that occurs to the light-emissive particles as electrons emitted by the electron-emissive regions impinge on the light-emissive particles.

62. A structure as in claim 52 further including an electron-emitting device comprising a like multiplicity of laterally separated electron-emissive regions respectively situated generally opposite the light-emissive regions, each electron-emissive region emitting electrons which pass through the getter coatings of the light-emissive particles in the oppositely situated light-emissive region and cause those light-emissive particles to emit light.

63. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of coatings comprising at least one of beryllium, boron, magnesium, aluminum, titanium, vanadium, chromium, manganese, iron, cobalt, nickel, copper, gallium, zirconium, niobium, molybdenum, palladium, silver, indium, barium, tantalum, tungsten, platinum, thallium, lead, thorium, and oxide of at least one of magnesium, chromium, manganese, cobalt, nickel, and lead, the groups of coatings respectively corresponding to the light-emissive regions, each coating of each group generally conformally overlying part of the outer surface of a corresponding different one of the light-emissive particles of the corresponding light-emissive region so as to be spaced apart from where that light-emissive particle is closest to the plate.

64. A structure as in claim 63 further including a light-reflective layer overlying the coatings above the light-emissive regions, the light-reflective layer being generally flat where it overlies the light-emissive regions.

65. A structure as in claim 63 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

66. A structure as in claim 65 wherein each of a plural number of the light-reflective coatings extends generally conformally along largely all of the upper half surface of the corresponding light-emissive particle.

67. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of getter coatings, the groups of getter coatings respectively corresponding to the light-emissive regions, each getter coating of each group generally conformally overlying part of the outer surface of a corresponding different one of the light-emissive particles of the corresponding light-emissive region so as to be spaced apart from where that light-emissive particle is closest to the plate.

68. A structure as in claim 67 further including a light-reflective layer overlying the getter coatings above the light-emissive regions, the light-reflective layer being perforated where it overlies the light-ernissive regions.

69. A structure as in claim 67 wherein the getter coatings are light reflective.

70. A structure as in claim 67 wherein the getter coatings comprise at least one of magnesium, titanium, vanadium, chromium, manganese, iron, cobalt, nickel, copper, zirconium, niobium, molybdenum, palladium, silver, barium, tantalum, tungsten, platinum, lead, thorium, and oxide of at least one of magnesium, chromium, manganese, cobalt, nickel, and lead.

71. A structure as in claim 62 wherein the outer surface of each light-emissive particle consists of (a) a lower half surface closest to the plate and (b) an upper half surface farthest from the plate, each getter coating extending generally conformally along at least part of the upper half surface of the corresponding light-emissive particle.

72. A structure as in claim 71 wherein each of a plural number of the getter coatings extends generally conformally along largely all of the upper half surface of the corresponding light-emissive particle.

* * * * *

UNITED STATES PATENT AND TRADEMARK OFFICE

CERTIFICATE OF CORRECTION

PATENT NO. : 6,812,636 B2
APPLICATION NO. : 09/823815
DATED : November 2, 2004
INVENTOR(S) : Porter et al.

It is certified that error appears in the above-identified patent and that said Letters Patent is hereby corrected as shown below:

Claims 16 - 72 should read as follows:

Col. 46 lines 66-67 and Col. 47 lines 1-2

16. A structure as in claim 11 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 47 lines 3-7

17. A structure as in claim 16 wherein each of a plural number of the coatings extends generally conformally along largely all of the upper half surface of the corresponding light-emissive particle.

Col. 47 lines 8-13

18. A structure comprising:

a plate;

a light-emissive region overlying light-transmissive material of the plate and comprising a plurality of light-emissive particles for emitting blue light, each light-emissive particle having an outer surface; and a group of coatings comprising at least one of boron, aluminum, gallium, silver, indium, and thallium, each coating generally conformally overlying part of the outer surface of a corresponding different one of the light-emissive particles so as to be spaced apart from where that light-emissive particle is closest to the plate.

Col. 47 lines 14-17

19. A structure as in claim 18 wherein the light-emissive particles comprise metal sulfide phosphors with silver substitution.

Col. 47 lines 18-20

20. A structure as in claim 18 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 47 lines 21-22
21. A structure as in claim 20 wherein each of a plural number of the light-reflective coatings extends generally conformally along largely all of the upper half surface of the corresponding light-emissive particle.

Col. 47 lines 23-30
22. A structure comprising:

a plate;

a light-emissive region overlying light-transmissive material of the plate and comprising a plurality of light-emissive particles for emitting green light, each light-emissive particle having an outer surface; and a group of coatings comprising at least one of boron, aluminum, copper, gallium, indium, and thallium, each coating generally conformally overlying part of the outer surface of a corresponding different one of the light-emissive particles so as to be spaced apart from where that light-emissive particle is closest to the plate.

Col. 47 lines 31-32
23. A structure as in claim 22 wherein the light-emissive particles comprise metal sulfide phosphors with copper substitution.

Col. 47 lines 33-35
24. A structure as in claim 22 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 47 lines 36-37
25. A structure as in claim 24 wherein each of a plural number of the light-reflective coatings extends generally conformally along largely all of the upper half surface of the corresponding light-emissive particle.

Col. 47 lines 38-47
26. A structure comprising:

a plate;

a light-emissive region overlying light-transmissive material of the plate and comprising a plurality of light-emissive particles each having an outer surface; and a group of coatings comprising at least one of beryllium, boron, magnesium, aluminum, titanium, vanadium, chromium, manganese, iron, cobalt, nickel, copper, gallium, zirconium, niobium, molybdenum, palladium, silver, indium, barium, tantalum, tungsten, platinum, thallium, lead, thorium, and oxide of at least one of magnesium, chromium, manganese, cobalt, nickel, and lead, each coating generally conformally overlying part of the outer surface of a corresponding different one of the light-emissive particles so as to be spaced apart from where that light-emissive particle is closest to the plate.

Col. 47 lines 48-49

27. A structure as in claim 26 further including a light-reflective layer overlying the coatings above the light-emissive region, the light-reflective layer being generally flat where it overlies the light-emissive region.

Col. 48 lines 1-2

28. A structure as in claim 26 wherein the light-emissive particles comprise metal sulfide phosphors.

Col. 48 lines 3-4

29. A structure as in claim 26 further including an electron-emitting device comprising an electron-emissive region for emitting electrons which pass through the coatings and cause the light-emissive particles to emit light.

Col. 48 lines 5-7

30. A structure as in claim 29 wherein the coatings reduce damage that occurs to the light-emissive particles as electrons emitted by the electron-emissive region impinge on the light-emissive particles.

Col. 48 lines 8-10

31. A structure as in claim 26 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 48 lines 11-12

32. A structure as in claim 31 wherein each of a plural number of the light-reflective coatings extends generally conformally along largely all of the upper half surface of the corresponding light-emissive particle.

Col. 48 lines 13-20

33. A structure comprising:

a plate;

a light-emissive region overlying light-transmissive material of the plate and comprising a plurality of light-emissive particles each having an outer surface; and a group of getter coatings, each generally conformally overlying part of the outer surface of a corresponding one of the light-emissive particles so as to be spaced apart from where that light-emissive particle is closest to the plate.

Col. 48 lines 21-22
34. A structure as in claim 33 further including a light-reflective layer overlying the getter coatings above the light-emissive region, the light-reflective layer being generally where it overlies the light-emissive region.

Col. 48 lines 23-24
35. A structure as in claim 33 further including a light-reflective layer overlying the getter coatings above the light-emissive region, the light-reflective layer being perforated where it overlies the light-emissive region.

Col. 48 lines 25-26
36. A structure as in claim 33 wherein the getter coatings are light reflective.

Col. 48 lines 27-30
37. A structure as claim 33 wherein the getter coatings comprise at least one of magnesium, titanium, vanadium, chromium, manganese, iron, cobalt, nickel, copper, zirconium, niobium, molybdenum, palladium, silver, barium, tantalum, tungsten, platinum, lead, thorium, and oxide of at least one of magnesium, chromium, manganese, cobalt, nickel, and lead.

Col. 48 lines 31-32
38. A structure as in claim 33 wherein the getter coatings sorb sulfur.

Col. 48 lines 33-35
39. A structure as in claim 33 including an electron-emitting device comprising an electron-emissive region for emitting electrons which pass through the getter coatings and cause the light-emissive particles to emit light.

Col. 48 lines 36-37
40. A structure as in claim 39 wherein the getter coatings reduce damage that occurs to the light-emissive particles as electrons emitted by the electron-emissive region impinge on the light-emissive particles.

Col. 48 lines 38-40
41. A structure as in claim 33 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 49 lines 1-2
42. A structure as in claim 41 wherein each of a plural number of the light-reflective coatings extends generally conformally along largely all of the upper half surface of the corresponding light-emissive particle.

Col. 49 lines 3-9
43. A structure comprising:

a plate;

a light-emissive region overlying light-transmissive material of the plate and comprising a plurality of light-emissive particles each having an outer surface; and a group of light-reflective coatings consisting largely of non-oxidized metal, each light-reflective coating generally conformally overlying part of the outer surface of a corresponding different one of the light-emissive particles so as to be spaced apart from where that light-emissive particle is closest to the plate.

Col. 49 lines 10-11
44. A structure as in claim 43 wherein the light-reflective coatings consist of substantially pure metal.

Col. 49 lines 12-13
45. A structure as in claim 43 further including a light-reflective layer overlying the light-reflective coatings above the light-emissive region, the light-reflective layer being generally flat where it overlies the light-emissive region.

Col. 49 lines 14-16
46. A structure as in claim 43 wherein the metal of the light-reflective coatings comprises at least one of beryllium, boron, magnesium, aluminum, chromium, manganese, iron, cobalt, nickel, copper, gallium, molybdenum, palladium, silver, indium, platinum, thallium, and lead.

Col. 49 lines 17-19
47. A structure as in claim 43 wherein the outer surface of each light-emissive particle consists of (a) a lower half surface closest to the plate and (b) an upper half surface farthest from the plate, each light-reflective coating extending generally conformally along at least part of the upper half surface of the corresponding light-emissive particle.

Col. 49 lines 20-22
48. A structure as in claim 47 wherein each of a plural number of the light-reflective coatings extends generally conformally along largely all of the upper half surface of the corresponding light-emissive particle.

Col. 49 lines 23-25
49. A structure as in claim 43 further including an electron-emitting device comprising an electron-emissive region for emitting electrons which pass through the light-reflective coatings and cause the light-emissive particles to emit light.

Col. 49 lines 26-27
50. A structure as in claim 49 wherein the light-reflective coatings reduce damage that occurs to the light-emissive particles as electrons emitted by the electron-emissive region impinge on the light-emissive particles.

Col. 49 lines 28-37
51. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of light-reflective coatings substantially reflective of visible light, the groups of light-reflective coatings respectively corresponding to the light-emissive regions, each light-reflective coating of each group generally conformally overlying part of the outer surface of a corresponding different one of the light-emissive particles of the corresponding light-emissive region so as to be spaced apart from where that light-emissive particle is closest to the plate.

Col. 49 lines 38-39
52. A structure as in claim 51 further including a light-reflective layer overlying the light-reflective coatings above the light-emissive regions, the light-reflective layer being generally flat where it overlies the light-emissive regions.

Col. 49 lines 40-41
53. A structure as in claim 51 wherein the light-reflective coatings consist largely of metal.

Col. 49 lines 42-45
54. A structure as in claim 53 wherein the metal of the light-reflective coatings comprises at least one of beryllium, boron, magnesium, aluminum, chromium, manganese, iron, cobalt, nickel, copper, gallium, molybdenum, palladium, silver, indium, platinum, thallium, and lead.

Col. 49 lines 46-50
55. A structure as in claim 51 wherein the outer surface of each light-emissive particle consists of (a) a lower half surface closest to the plate and (b) an upper half surface farthest from the plate, each light-reflective coating extending generally conformally along at least part of the upper half surface of the corresponding light-emissive particle.

Col. 49 lines 51-53
56. A structure as in claim 55 wherein each of a plural number of the light-reflective coatings extends generally conformally along largely all of the upper half surface of the corresponding light-emissive particle.

Col. 49 lines 54-60
57. A structure as in claim 51 further including an electron-emitting device comprising a like multiplicity of laterally separated electron-emissive regions respectively situated generally opposite the light-emissive regions, each electron-emissive region emitting electrons which pass through the light-reflective coatings of the light-emissive particles in the oppositely situated light-emissive region and cause those light-emissive particles to emit light.

Col. 50 lines 1-3

58. A structure as in claim 57 wherein the light-reflective coatings reduce damage that occurs to the light-emissive particles as electrons emitted by the electron-emissive regions impinge on the light-emissive particles.

Col. 50 lines 4-14

59. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of coatings comprising at least one of beryllium, boron, magnesium, aluminum, titanium, vanadium, chromium, manganese, iron, cobalt, nickel, copper, gallium, zirconium, niobium, molybdenum, palladium, silver, indium, barium, tantalum, tungsten, platinum, thallium, lead, thorium, and oxide of at least one of magnesium, chromium, manganese, cobalt, nickel, and lead, the groups of coatings respectively corresponding to the light-emissive regions, each coating of each group generally conformally overlying part of the outer surface of a corresponding different one of the light-emissive particles of the corresponding light-emissive region so as to be spaced apart from where that light-emissive particle is closest to the plate.

Col. 50 lines 15-16

60. A structure as in claim 59 further including a light-reflective layer overlying the coatings above the light-emissive regions, the light-reflective layer being generally flat where it overlies the light-emissive regions.

Col. 50 lines 17-19

61. A structure as in claim 59 wherein the outer surface of each light-emissive particle consists of (a) a lower half surface closest to the plate and (b) an upper half surface farthest from the plate, each coating extending generally conformally along at least part of the upper half surface of the corresponding light-emissive particle.

Col. 50 lines 20-23

62. A structure as in claim 61 wherein each of a plural number of the light-reflective coatings extends generally conformally along largely all of the upper half surface of the corresponding light-emissive particle.

Col. 50 lines 24-28

63. A structure as in claim 59 further including an electron-emitting device comprising a like multiplicity of laterally separated electron-emissive regions respectively situated generally opposite the light-emissive regions, each electron-emissive region emitting electrons which pass through the coatings of the light-emissive particles in the oppositely situated light-emissive region and cause those light-emissive particles to emit light.

Col. 50 lines 29-31

64. A structure as in claim 63 wherein the coatings reduce damage that occurs to the light-emissive particles as electrons emitted by the electron-emissive regions impinge on the light-emissive particles.

Col. 50 lines 32-40

65. A structure comprising:

a plate;

a multiplicity of laterally separated light-emissive regions overlying light-transmissive material of the plate, each light-emissive region comprising a plurality of light-emissive particles each having an outer surface; and a like multiplicity of groups of getter coatings, the groups of getter coatings respectively corresponding to the light-emissive regions, each getter coating of each group generally conformally overlying part of the outer surface of a corresponding different one of the light-emissive particles of the corresponding light-emissive region so as to be spaced apart from where that light-emissive particle is closest to the plate.

Col. 50 lines 41-42

66. A structure as in claim 65 further including a light-reflective layer overlying the getter coatings above the light-emissive regions, the light-reflective layer being perforated where it overlies the light-emissive regions.

Col. 50 lines 43-44

67. A structure as in claim 65 wherein the getter coatings are light reflective.

Col. 50 lines 45-50

68. A structure as in claim 65 wherein the getter coatings comprise at least one of magnesium, titanium, vanadium, chromium, manganese, iron, cobalt, nickel, copper, zirconium, niobium, molybdenum, palladium, silver, barium, tantalum, tungsten, platinum, lead, thorium, and oxide of at least one of magnesium, chromium, manganese, cobalt, nickel, and lead.

Col. 50 lines 51-53

69. A structure as in claim 65 wherein the outer surface of each light-emissive particle consists of (a) a lower half surface closest to the plate and (b) an upper half surface farthest from the plate, each getter coating extending generally conformally along at least part of the upper half surface of the corresponding light-emissive particle.

Col. 51 lines 1-3

70. A structure as in claim 69 wherein each of a plural number of the getter coatings extends generally conformally along largely all of the upper half surface of the corresponding light-emissive particle.

Col. 51 lines 4-7

71. A structure as in claim 65 further including an electron-emitting device comprising a like multiplicity of laterally separated electron-emissive regions respectively situated generally opposite the light-emissive regions, each electron-emissive region emitting electrons which pass through the getter coatings of the light-emissive particles in the oppositely situated light-emissive region and cause those light-emissive particles to emit light.

Col. 51 lines 8-10

72. A structure as in claim 71 wherein the getter coatings reduce damage that occurs to the light-emissive particles as electrons emitted by the electron-emissive regions impinge on the light-emissive particles.

Signed and Sealed this

Nineteenth Day of January, 2010

David J. Kappos

David J. Kappos
*Director of the United States Patent and Trademark Office*